US007604574B2

(12) United States Patent
Maresh

(10) Patent No.: US 7,604,574 B2
(45) **Date of Patent: *Oct. 20, 2009**

(54) EXERCISE METHODS AND APPARATUS

(76) Inventor: Joseph D. Maresh, P.O. Box 645, West Linn, OR (US) 97068-0645

( * ) Notice: Subject to any disclaimer, the term of this patent is extended or adjusted under 35 U.S.C. 154(b) by 182 days.

This patent is subject to a terminal disclaimer.

(21) Appl. No.: 11/482,232

(22) Filed: Jun. 30, 2006

(65) Prior Publication Data

US 2007/0225129 A1 Sep. 27, 2007

Related U.S. Application Data

(63) Continuation of application No. 09/065,308, filed on Apr. 23, 1998, now Pat. No. 7,086,993, which is a continuation-in-part of application No. 08/914,206, filed on Aug. 19, 1997, now Pat. No. 5,897,463, which is a continuation of application No. 08/497,377, filed on Jun. 30, 1995, now Pat. No. 5,707,321, said application No. 09/065,308 is a continuation-in-part of application No. 09/030,133, filed on Feb. 25, 1998, now Pat. No. 6,083,143, which is a continuation of application No. 08/535,566, filed on Sep. 28, 1995, now Pat. No. 5,725,457.

(60) Provisional application No. 60/044,955, filed on Apr. 26, 1997, provisional application No. 60/044,957, filed on Apr. 26, 1997, provisional application No. 60/044,959, filed on Apr. 26, 1997, provisional application No. 60/044,961, filed on Apr. 26, 1997, provisional application No. 60/044,962, filed on Apr. 26, 1997, provisional application No. 60/044,963, filed on Apr. 26, 1997, provisional application No. 60/044,026, filed on May 5, 1997.

(51) Int. Cl.
*A63B 22/06* (2006.01)
*A63B 22/04* (2006.01)

(52) U.S. Cl. ..... 482/52; 482/57

(58) Field of Classification Search ..... 482/51–53, 482/57, 70, 79–80
See application file for complete search history.

(56) References Cited

U.S. PATENT DOCUMENTS

| | | | | |
|---|---|---|---|---|
| 5,279,529 | A * | 1/1994 | Eschenbach | 482/57 |
| 5,836,855 | A * | 11/1998 | Eschenbach | 482/57 |
| 5,916,065 | A * | 6/1999 | McBride et al. | 482/57 |
| 6,017,295 | A * | 1/2000 | Eschenbach | 482/57 |
| 6,277,056 | B1 * | 8/2001 | McBride et al. | 482/57 |
| 6,527,677 | B2 * | 3/2003 | Maresh | 482/51 |
| 6,908,416 | B2 * | 6/2005 | Mercado et al. | 482/52 |
| 7,364,532 | B2 * | 4/2008 | Maresh | 482/52 |

* cited by examiner

*Primary Examiner*—Steve R Crow

(57) ABSTRACT

An exercise apparatus includes a rigid connector link having a first portion rotatably connected to a crank, a second portion constrained to move in reciprocating fashion, and a third portion connected to a foot support. The resulting assembly links rotation of the crank to movement of the foot support through a generally elliptical path. The connection points may be moved relative to one another and/or a supporting frame to adjust the size, shape, and/or orientation of the path.

33 Claims, 41 Drawing Sheets

EXERCISE METHODS AND APPARATUS

CROSS-REFERENCE TO RELATED APPLICATIONS

This is a continuation of U.S. patent application Ser. No. 09/065,308, filed on Apr. 23, 1998, now U.S. Pat. No. 7,086,993, which (a) is a continuation-in-part of U.S. patent application Ser. No. 08/914,206, filed on Aug. 19, 1997 (U.S. Pat. No. 5,897,463), which in turn, is a continuation of U.S. patent application Ser. No. 08/497,377, filed on Jun. 30, 1995 (U.S. Pat. No. 5,707,321); and (b) is a continuation-in-part of U.S. patent application Ser. No. 09/030,133, filed on Feb. 25, 1998 (U.S. Pat. No. 6,083,143), which in turn, is a continuation of U.S. patent application Ser. No. 08/535,566, filed on Sep. 28, 1995 (U.S. Pat. No. 5,725,457); and (c) discloses subject matter entitled to the filing dates of Provisional Application Ser. Nos. 60/044,955, 60/044,957, 60/044,959, 60/044,961, 60/044,962, 60/044,963, all of which were filed on Apr. 26, 1997, as well as Provisional Application Ser. No. 60/044,026, which was filed on May 5, 1997.

FIELD OF THE INVENTION

The present invention relates to exercise methods and apparatus and more particularly, to exercise equipment which facilitates exercise through a curved path of motion.

BACKGROUND OF THE INVENTION

Exercise equipment has been designed to facilitate a variety of exercise motions. For example, treadmills allow a person to walk or run in place; stepper machines allow a person to climb in place; bicycle machines allow a person to pedal in place; and other place; bicycle machines allow a person to pedal in place; and other machines allow a person to skate and/or stride in place.

Yet another type of exercise equipment has been designed to facilitate relatively more complicated exercise motions and/or to better simulate real life activity. Such equipment typically uses some sort of linkage assembly to convert a relatively simple motion, such as circular, into a relatively more complex motion, such as elliptical. Exercise equipment has also been designed to facilitate full body exercise. For example, reciprocating cables or pivoting arm poles have been used on many of the foregoing types of exercise equipment to facilitate contemporaneous upper body and lower body exercise. Despite many such advances in the art, room for improvement remains.

SUMMARY OF THE INVENTION

The present invention may be seen to provide a novel linkage assembly and corresponding exercise apparatus suitable for linking circular motion to relatively more complex, generally elliptical motion. In one embodiment, for example, a first portion of a connector link is rotatably connected to a crank; a second portion of the connector link is rotatably connected to a rocker link; and a third portion of the connector link is rotatably connected to a foot support. As the crank rotates, the linkage assembly constrains the foot support to travel through a generally elliptical path. complex, generally elliptical motion. For example, a handle may be connected to at least one of the connector link and the rocker link in such a manner that, as the foot supporting end of the foot link moves through its generally elliptical path, the handle moves in reciprocal fashion relative to the frame.

In yet another respect, the present invention may be seen to provide a novel linkage assembly and corresponding exercise apparatus suitable for adjusting the elliptical path of motion. For example, the rocker link may be selectively movable relative to the connector link to alter the size and/or configuration of the foot path. Additional features of the present invention may become more apparent from the more detailed description set forth below.

BRIEF DESCRIPTION OF THE DRAWING

With reference to the Figures of the Drawing, wherein like numerals represent like parts and assemblies throughout the several views.

DETAILED DESCRIPTION OF THE PREFERRED EMBODIMENT

Figure 1:
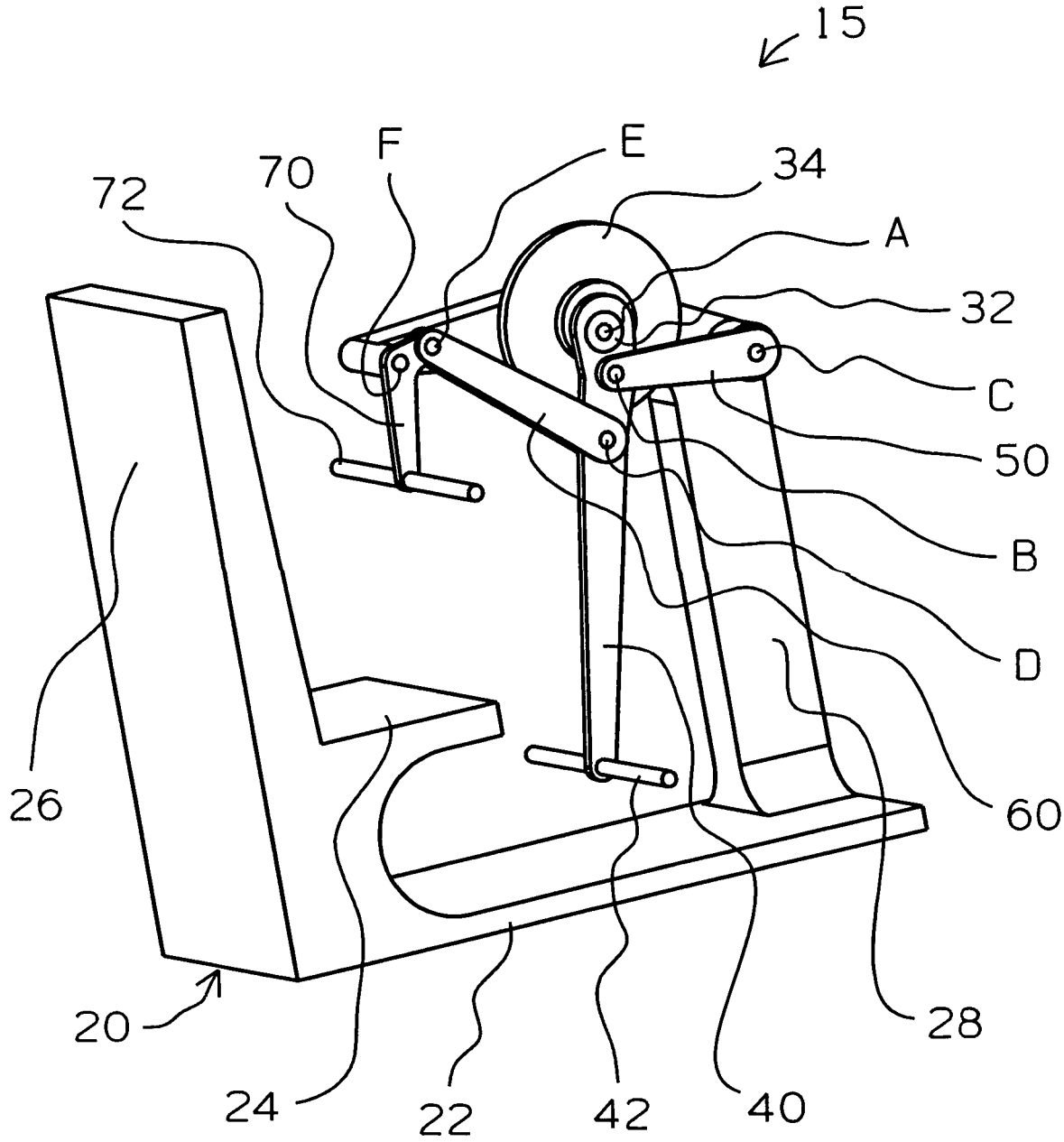
FIG. 1 is a perspective view of an exercise apparatus constructed according to the principles of the present invention.
Figure 2:
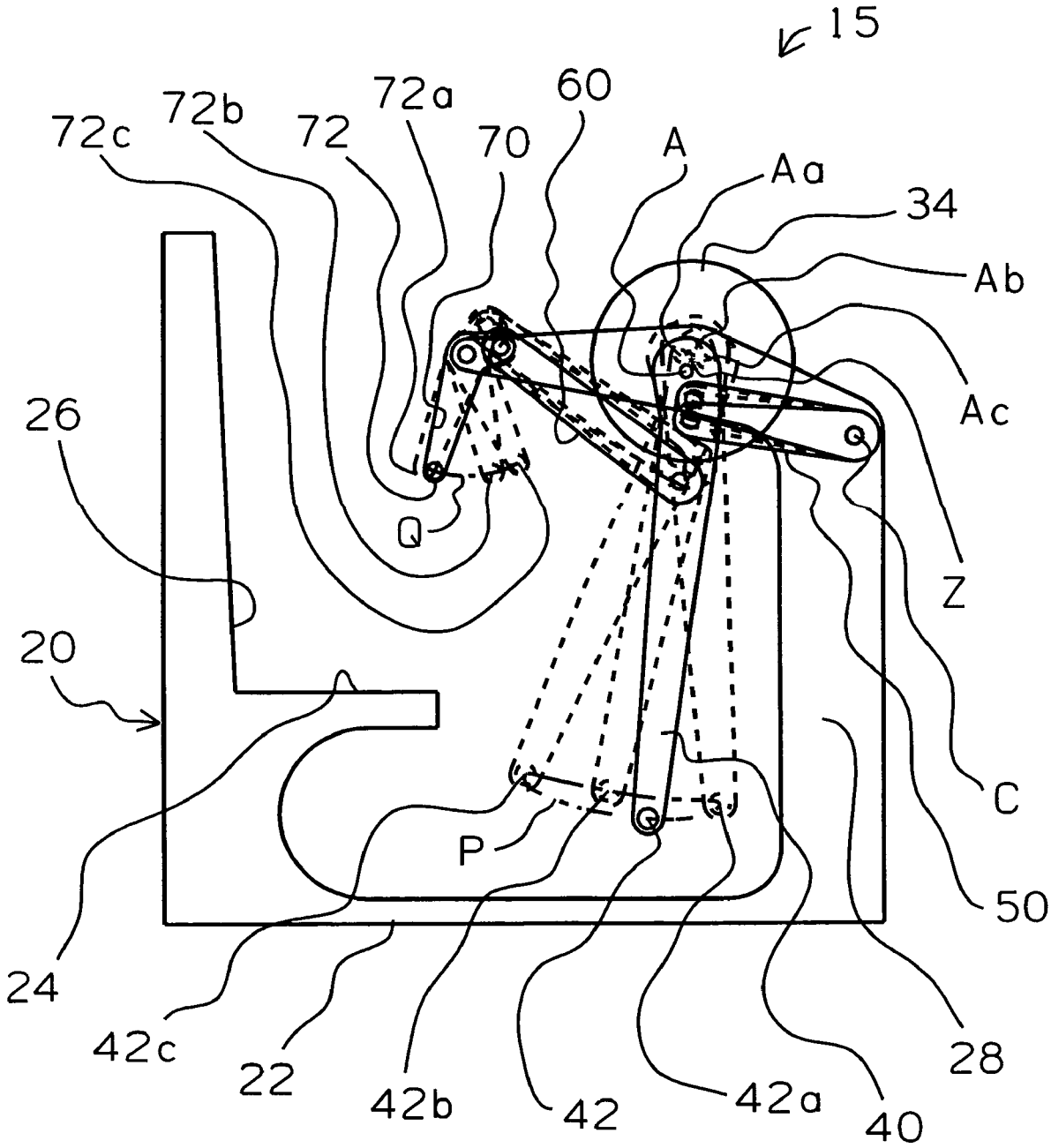
FIG. 2 is a side view of the apparatus of FIG. 1, with the linkage members depicted at four different times during an exercise cycle.
Figure 3:
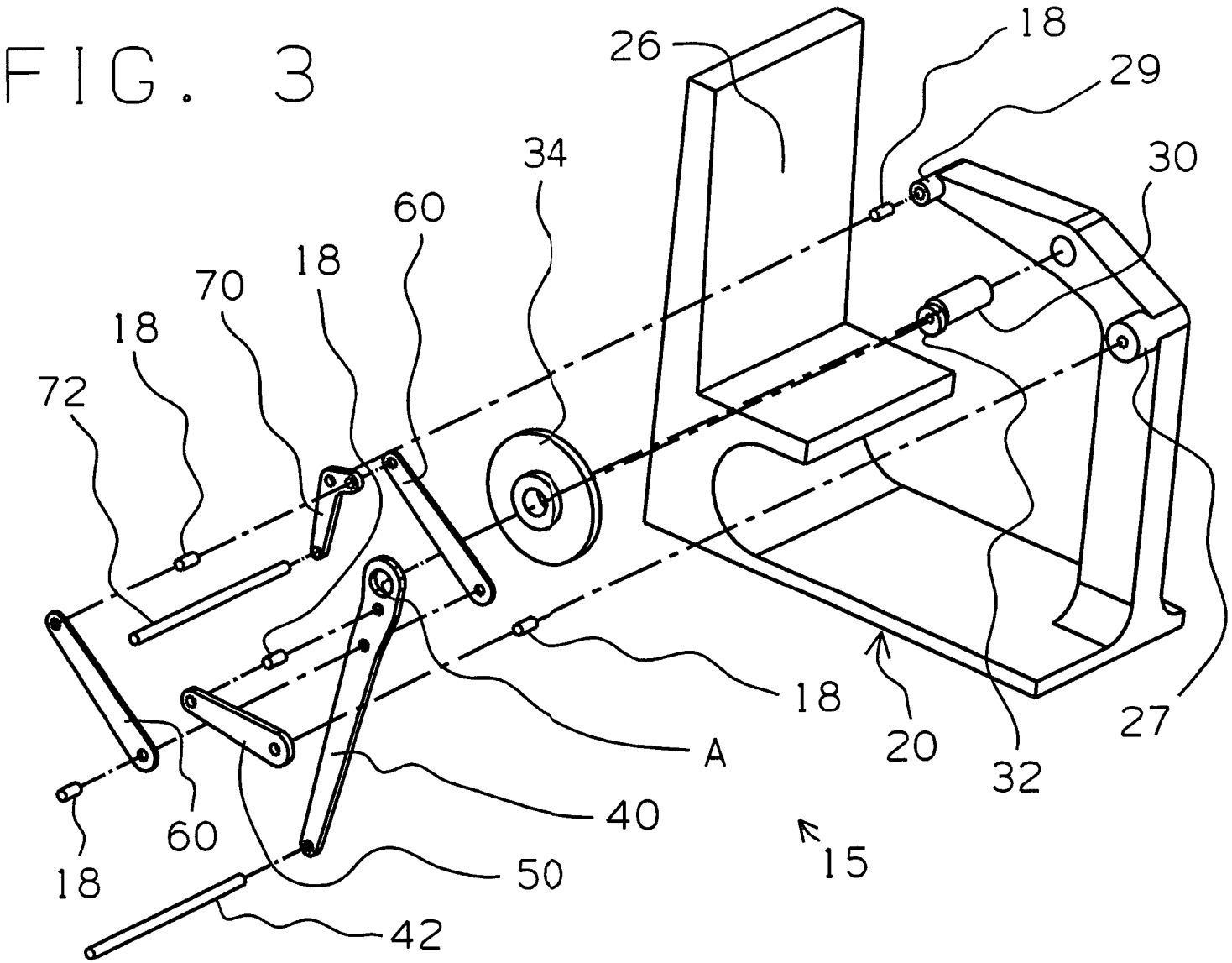
FIG. 3 is an exploded perspective view of the apparatus of FIG. 1.

An exercise apparatus constructed according to the principles of the present invention is designated as 15 in FIGS. 1-3. The apparatus 15 has a frame 20 which includes a base 22 designed to rest upon a floor surface. A seat 24 and a back support 26 are secured to a rearward end of the base 22 to support a user. A stanchion 28 is secured to an opposite, forward end of the base 22 to support a linkage assembly. A user sits in the seat 24 and places both feet on a foot receiving element 42 and both hands on a hand receiving element 72. The user exercises by alternatively pushing against the foot receiving element 42 and the hand receiving element 72.

The linkage assembly includes a camshaft 30 which is rotatably mounted on the stanchion 28. A flywheel 34 is mounted on the camshaft 30 and rotates together therewith about an axis Z relative to the frame 20. A first link 40 has an upper end which is rotatably mounted on an eccentric portion 32.of the camshaft 30. The link 40 rotates about an axis A relative to the eccentric portion 32, and the axis A, in turn, rotates about the axis Z. The foot receiving element 42 is mounted on an opposite, lower end of the first link 40.

A second link 50 has a first end rotatably connected to the first link 40 by means of a pin 18. As a result, the second link 50 rotates about an axis B relative to the first link 40. The axis B may be described as proximate the upper end of the first link 40. The second link 50 has a second, opposite end rotatably connected to the frame 20 at axially extending shoulder portion 27. As a result, the second link 50 also rotates about an axis C relative to the frame 20. The second link 50 may be described as a "rocker link" and/or as a means for constraining the axis B to move in reciprocating fashion.

Third links 60 have first ends rotatably connected to opposite sides of the first link 40 by means of a pin 18. As a result, the third links 60 rotate about an axis D relative to the first link 40. The axis D may be described as proximate the upper end of the first link 40, and/or the axis B may be described as intermediate the axis D and the axis A. The third links 60 have second, opposite ends rotatably connected to an end of a fourth link 70. As a result, the third links 60 also rotate about an axis E relative to the fourth link 70.

The fourth link 70 has an intermediate portion rotatably connected to the frame 20 at axially extending shoulder portion 29. As a result, the fourth link 70 rotates about an axis F relative to the frame 20. The hand receiving member 72 is mounted on an end of the fourth link 70 opposite the axis E. The fourth link 70 may be described as generally L-shaped with the axis F disposed at the vertex (and between the axis E and the hand receiving member 72).

As shown in FIG. 2, rotation of the flywheel 34 is linked to movement of the foot receiving member 42 through a generally elliptical path of motion P, and movement of the hand receiving member 72 through an arcuate path of motion Q. For example: (i) when the eccentric axis A is at seven o'clock relative to the camshaft axis Z, the foot receiving member 42 and the hand receiving member 72 occupy the positions shown in solid lines; (ii) when the eccentric axis is at the ten o'clock orientation (designated as Aa), the foot receiving member and the hand receiving member occupy the positions designated as 42*a* and 72*a* (and the user is likely to begin pushing against the hand receiving element); (iii) when the eccentric axis is at the one o'clock orientation (designated as Ab), the foot receiving member and the hand receiving member occupy the positions designated as 42*b* and 72*b*; and (iv) when the eccentric axis is at the four o'clock orientation (designated as Ac), the foot receiving member and the hand receiving member occupy the positions designated as 42*c* and 72*c* (and the user is likely to begin pushing against the foot receiving element). On the embodiment 15, the rocker link 50 oscillates through a range of approximately seven and one-half degrees during a complete exercise cycle, and the crank radius defined between the axis Z and the axis A is approximately one-half of an inch.

The flywheel 34 adds inertia to the linkage assembly, so that the user need not continuously push against the appropriate force receiving member. On the other hand, the user may continuously exercise his upper body by pushing and pulling against the hand receiving member 72 at the appropriate times. Also, toe loops or straps may be provided on the foot receiving member 42 to allow the user to push and pull against same and thereby continuously exercise his lower body.

Figure 4:
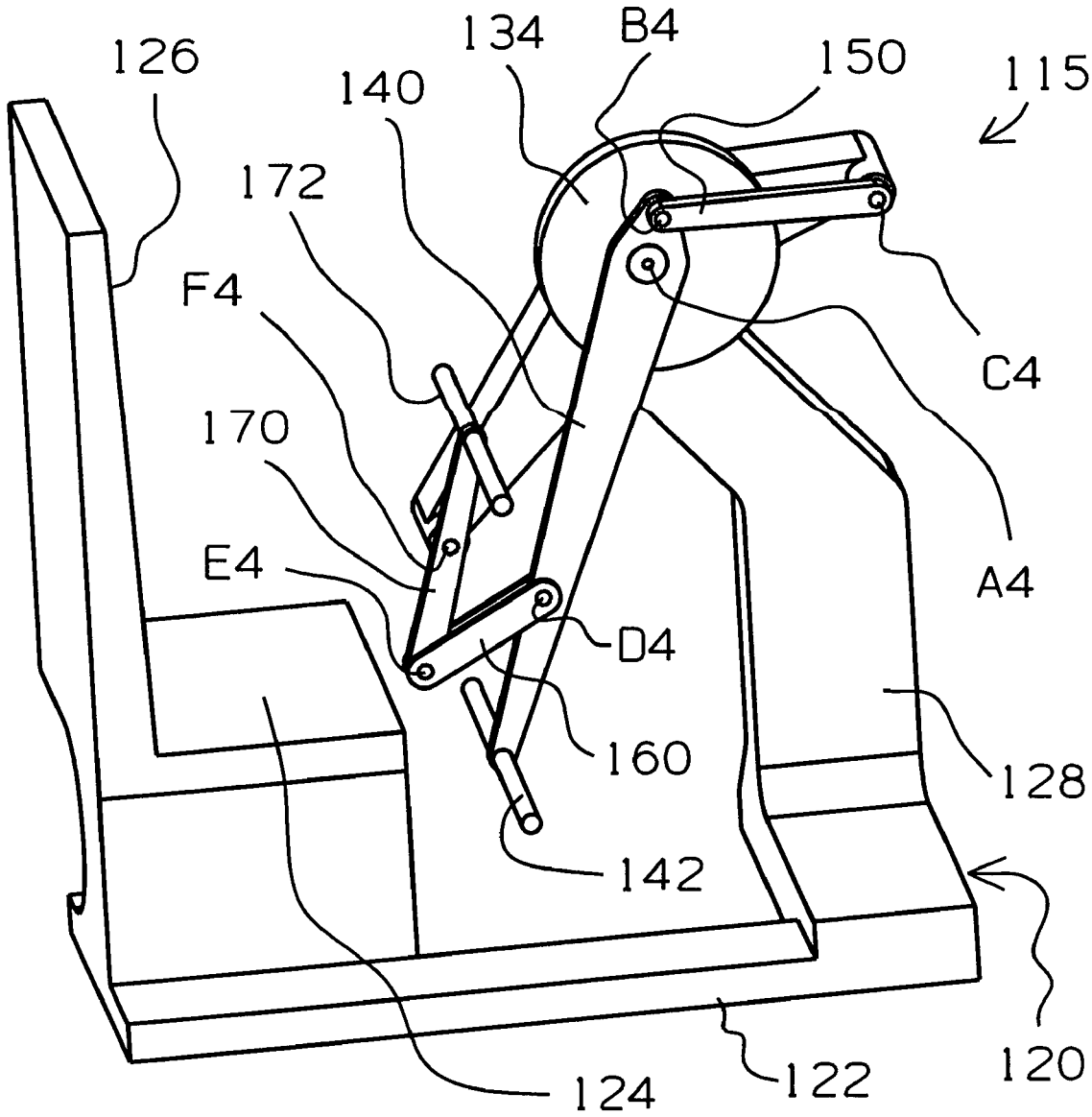
FIG. 4 is a perspective view of another exercise apparatus constructed according to the principles of the present invention.

Another embodiment of the present invention is designated as 115 in FIG. 4. The apparatus 115 has a frame 120 which includes a base 122 designed to rest upon a floor surface. A seat 124 and a back support 126 are secured to a rearward end of the base 122 to support a user. A stanchion 128 is secured to an opposite, forward end of the base 122 to support a linkage, assembly. A user sits in the seat 124 and places both feet on a foot receiving element 142 and both hands on a hand receiving element 172. The user may exercise by alternatively pushing against the foot receiving element 142 and the hand receiving element 172.

The linkage assembly includes a camshaft (like that on the first embodiment 15) which is rotatably mounted on the stanchion 128. A flywheel 134 is mounted on the camshaft and rotates together therewith about a camshaft axis relative to the frame 120. A first link 140 has an upper portion which is rotatably mounted on an eccentric portion of the camshaft. The link 140 rotates about an axis A4, which in turn, rotates about the camshaft axis. The foot receiving element 142 is mounted on a lower distal end of the first link 140.

A second link 150 has a first end rotatably connected to an upper distal end of the first link 140. As a result, the second link 150 rotates about an axis B4 relative to the first link 140. The axis B4 may be described as disposed above the axis A4. The second link 150 has a second, opposite end rotatably connected to the frame 120 at axially extending shoulder portion on the stanchion 128. As a result, the second link 150 also rotates about an axis C4 relative to the frame 120. The second link 150 may be described as a "rocker link" and/or as a means for constraining the axis B4 to move in reciprocating fashion.

Third links 160 have first ends rotatably connected to opposite sides of the first link 140. As a result, the third links 160 rotate about an axis D4 relative to the first link 140. The axis D4 may be described as proximate the lower end of the first link 140 and/or intermediate the axis A4 and the foot receiving member 142. The third links 160 have second, opposite ends rotatably connected to an end of a linear fourth link 170. As a result, the third links 160 also rotate about an axis E4 relative to the fourth link 170.

The fourth link 170 has an intermediate portion rotatably connected to the frame 120 at axially extending shoulder portion on the stanchion 128. As a result, the fourth link 170 rotates about an axis F4 relative to the frame 120. The hand receiving member 172 is mounted on an end of the fourth link 170 opposite the axis E4.

Like on the first embodiment 15, rotation of the flywheel 134 is linked to movement of the foot receiving member 142 through a generally elliptical path of motion, and movement of the hand receiving member 172 through an arcuate path of motion. The rocker link 150 is disposed above the camshaft axis in the second embodiment 115, and the motions are comparable (though generally inverse) to those on the first embodiment 15 (where the rocker link 50 is disposed beneath the camshaft axis Z). The exercise path provided by either embodiment may be varied by rotating the rocker axis (C or C4) about the camshaft axis (so that the rocker link 50 or 150 is no longer horizontal).

Figure 5:
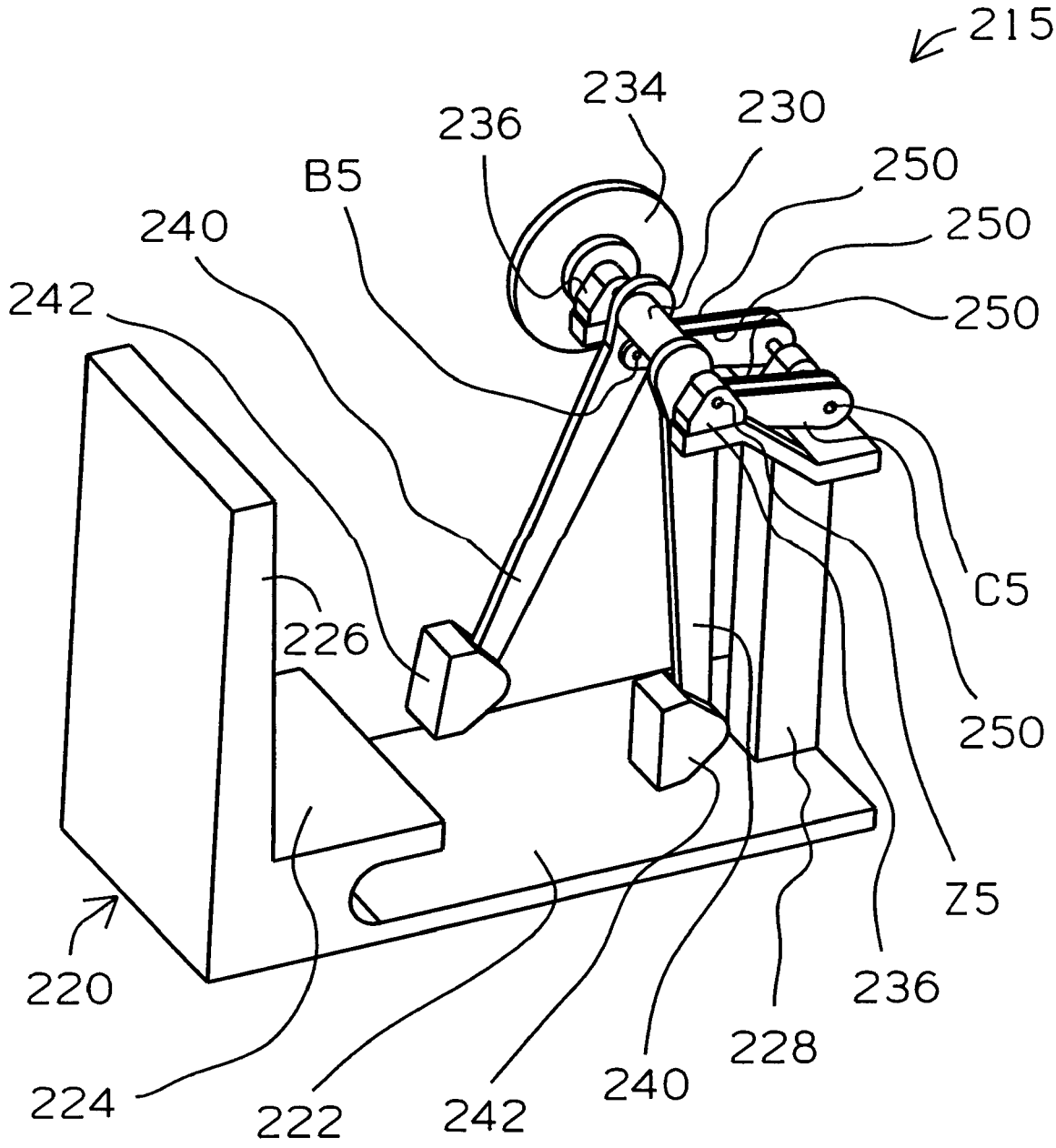
FIG. 5 is a perspective view of another exercise apparatus constructed according to the principles of the present invention.

A third embodiment of the present invention is designated as 215 in FIG. 5. The apparatus 215 has a frame 220 which includes a base 222 designed to rest upon a floor surface. A seat 224 and a back support 226 are secured to a rearward end of the base 222 to support a user. A stanchion 228 is secured to an opposite, forward end of the base 222 to support a linkage assembly. A user sits in the seat 224 and places individual feet on respective foot receiving elements 242. The user exercises by pushing against the foot receiving elements 242 in alternating fashion. The foot receiving members 242 move through generally elliptical paths of motion as a flywheel 234 rotates.

The linkage assembly includes a camshaft 230 which is rotatably mounted on the stanchion 228 by means of bearing assemblies 236. The flywheel 234 shares an axis of rotation Z5 with the camshaft 230 and rotates together therewith relative to the frame 220. On each side of the apparatus 215, a first link 240 has an upper end which is rotatably mounted on an eccentric portion of the camshaft 230. The link 240 rotates about an axis relative to the eccentric portion, which in turn, rotates about the camshaft axis Z5. The eccentric portion on the right side of the apparatus 215 is diametrically opposite the eccentric portion on the left side of the apparatus 215. A foot receiving element 242 is pivotally mounted on an opposite, lower end of each first link 240. Each foot receiving element 242 is movable through a limited range of motion relative to a respective first link 240.

On each side of the apparatus 215, two second links 250 have first ends rotatably connected to a respective first link 240, beneath the camshaft 230 and proximate same, and second, opposite ends rotatably connected to the stanchion 128. As a result, the second links 250 rotate about respective axes B5 relative to respective first links 240 and about a common axis C5 relative to the frame 220. Thus, the second links 250 may be described as "rocker links" and/or as means for constraining respective axes B5 to move in reciprocating fashion.

Figure 6:
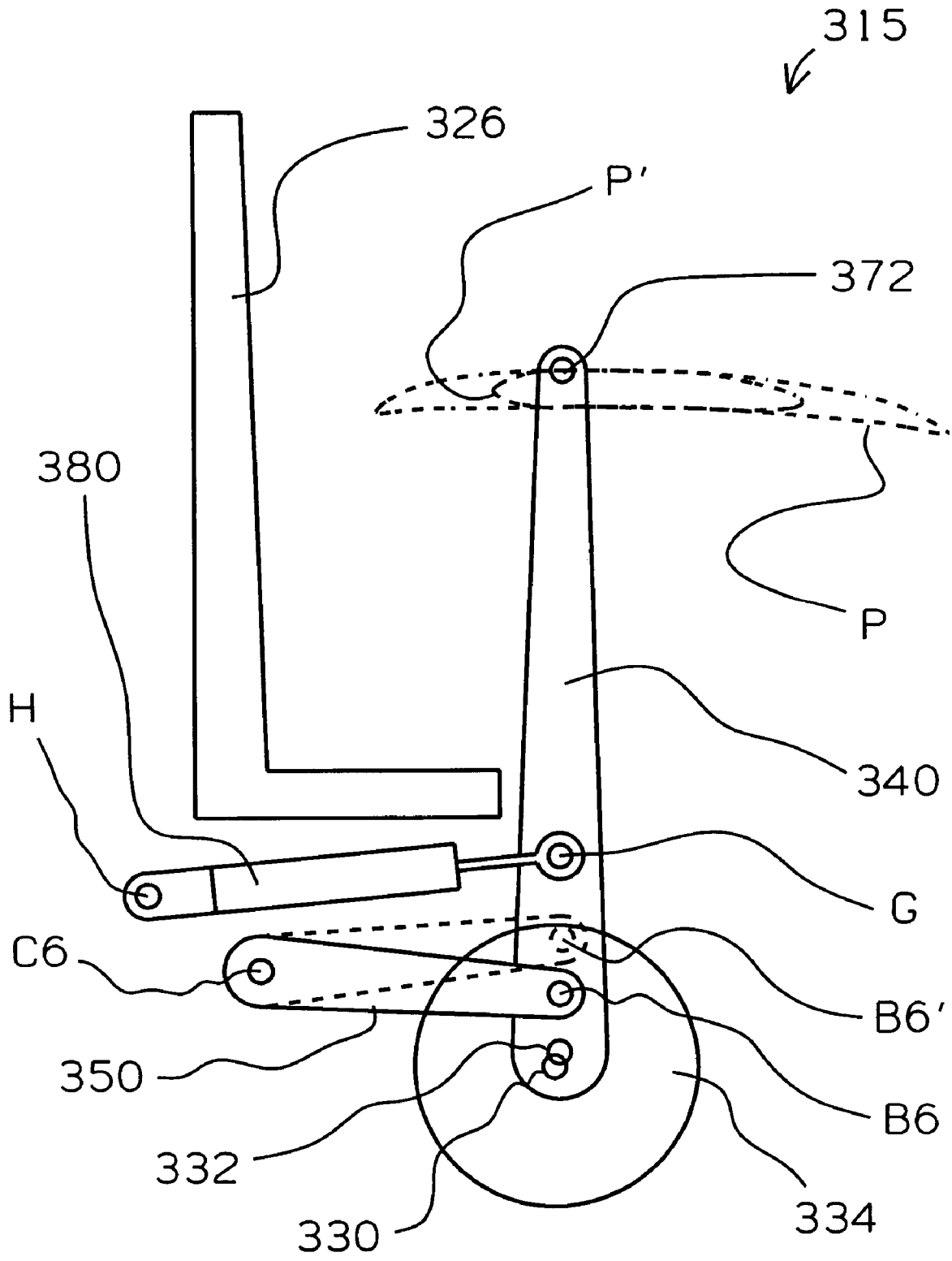
FIG. 6 is a side view of another exercise apparatus constructed according to the principles of the present invention, with adjustments to the linkage members depicted.

A fourth embodiment of the present invention is designated as 315 in FIG. 6. The apparatus 315 has a frame (not shown) and a seat 324 and a back support 326 which are secured to the frame. A linkage assembly is connected to the frame generally beneath the seat 324. A user sits in the seat 324 and places his hands on opposite sides of a hand receiving element 372. The user exercises by moving the hand receiving member 372 through generally elliptical paths of motion as a flywheel 334 rotates.

The linkage assembly includes a camshaft 330 having an eccentric portion 332. The flywheel 334 shares an axis of rotation with the camshaft 330 and rotates together therewith relative to the frame. A first link 340 has a lower end which is rotatably mounted on the eccentric portion 332 of the camshaft 330. The link 340 rotates about an axis relative to the eccentric portion 332, which in turn, rotates about the camshaft axis. The hand receiving element 372 is mounted on an opposite, upper end of the first link 340.

A second link 350 has a first end rotatably connected to the first link 340 above the camshaft 330 and proximate same. As a result, the second link 350 rotates about an axis B6 relative to the first link 340. The second link 350 has a second, opposite end rotatably connected to the frame and thus, also rotates about an axis C6 relative to the frame. The second link 350 may be described as a "rocker link" and/or as a means for constraining the axis B6 to move in reciprocating fashion.

The apparatus 315 provides an optional means for adjusting the length of the exercise stroke or path of motion. In particular, the rocker link 350 may be connected to a different point along the first link 340, as suggested by the dashed line depiction thereof in FIG. 6. The hand receiving member 372 moves through a path P when the rocker link 350 defines the axis B6, and the hand receiving member 372 moves through a smaller path P' when the rocker link 350 defines the axis B6'.

An optional resistance device 380 (which could be a linear damper or a fluid shock absorber, for example) is shown on the apparatus 315. A first end of the resistance device 380 is rotatably connected to the first link 340 and cooperates therewith to define an axis of rotation G. A second, opposite end of the resistance device 380 is rotatably connected to the frame and cooperates therewith to define an axis of rotation H. The resistance device may be configured to provide adjustable resistance and/or resistance in only one direction. Moreover, other resistance devices could be added to or substituted for the damper arrangement. For example, a spring may be disposed between the first link 340 and the frame to resist movement of the first link 340 away from the back support 326.

Those skilled in the art will recognize that the resistance device 380 and/or the adjustable rocker link 350 may be used on other embodiments of the present invention, as well, and conversely, that features of the other embodiments could be included on the apparatus 315. For example, the apparatus 315 could be modified to have reciprocating right and left hand receiving members (and/or foot receiving members) similar in operation to the foot receiving members of the embodiment 215.

Figure 7:
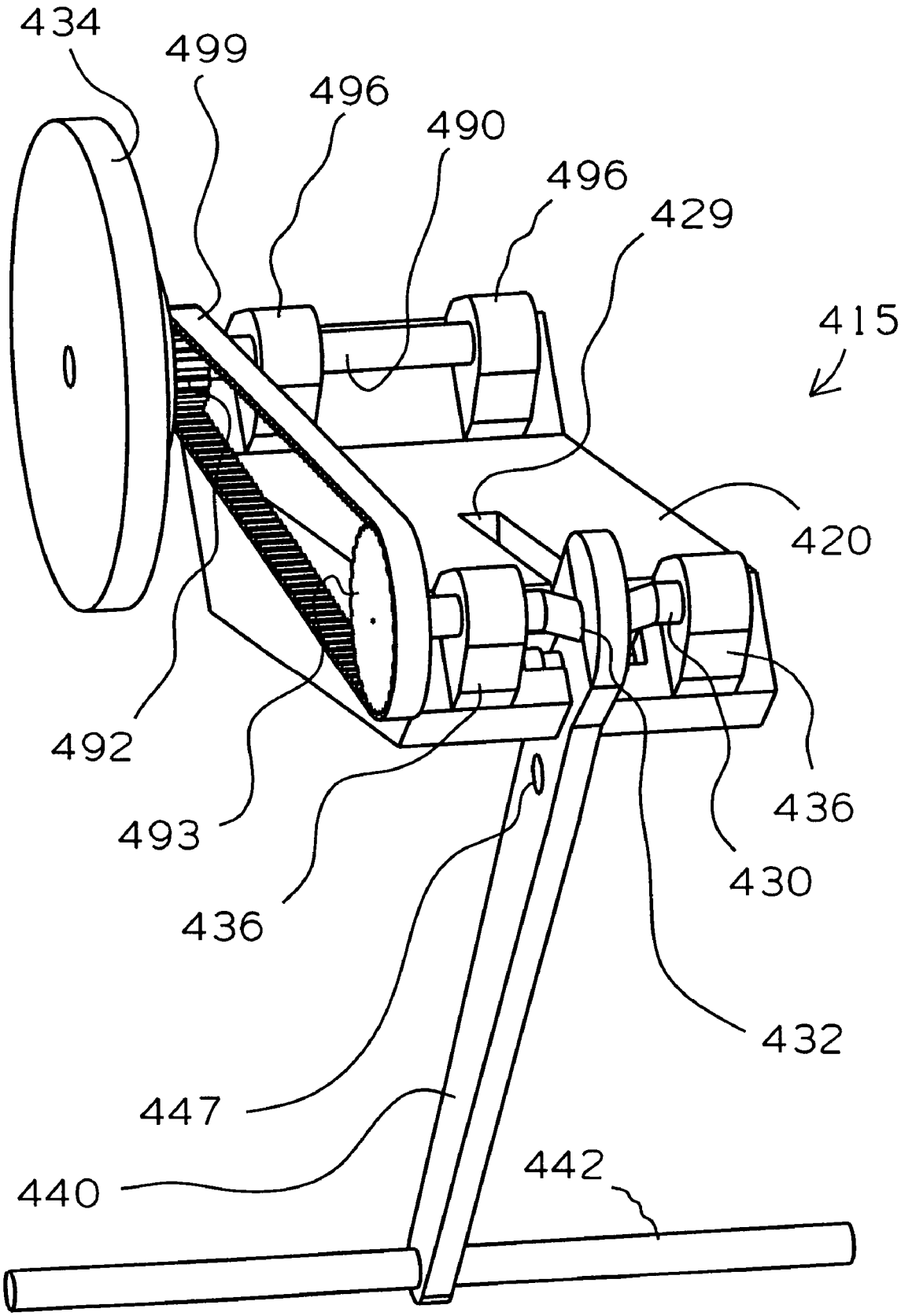
FIG. 7 is a perspective view of another exercise apparatus constructed according to the principles of the present invention.
Figure 8:
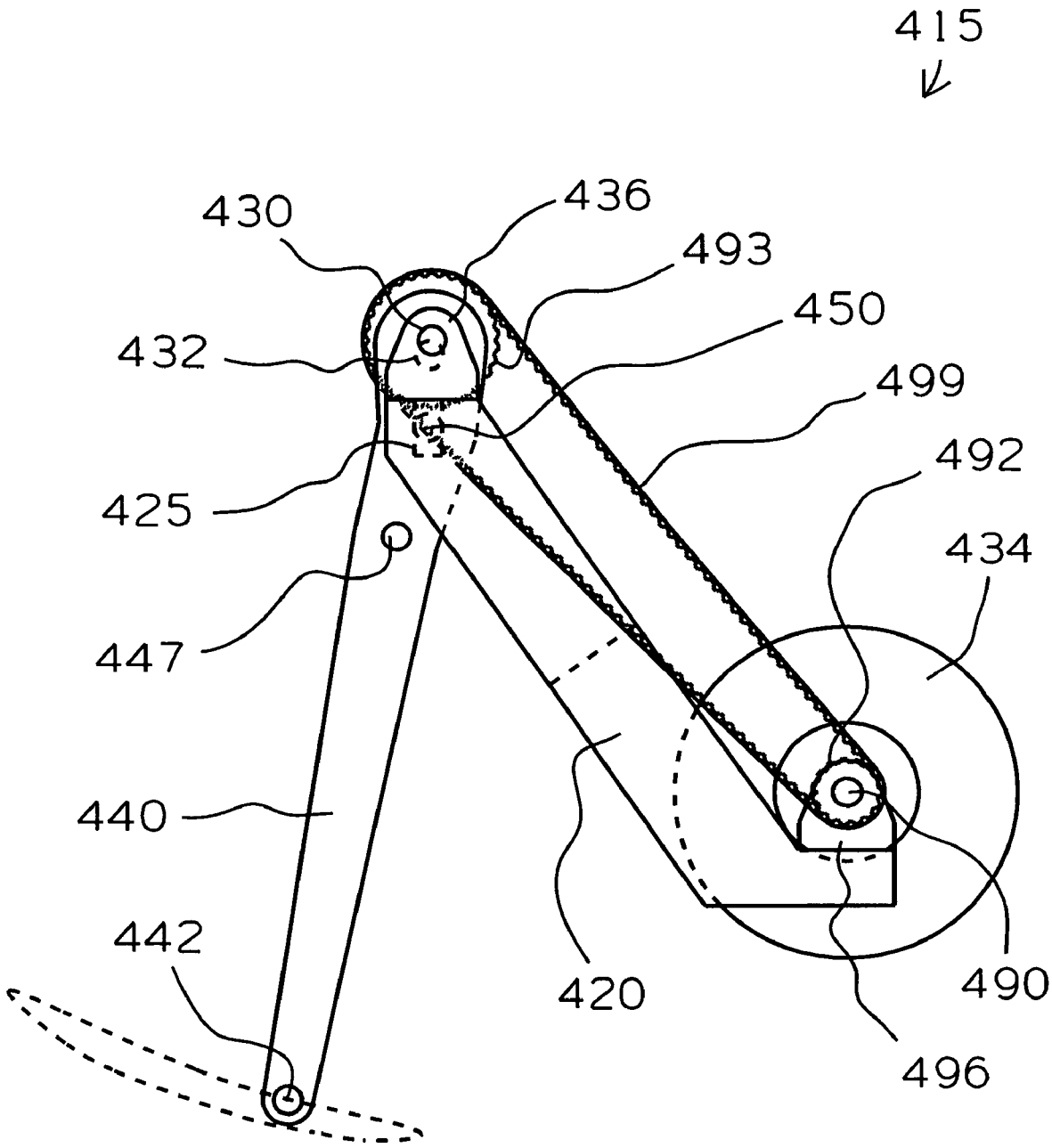
FIG. 8 is a side view of the apparatus of FIG. 7.

A fifth embodiment of the present invention is designated as 415 in FIGS. 7-8. The apparatus 415 has a frame 420 which supports a linkage assembly. As in the foregoing embodiments, the linkage assembly links rotation of a flywheel 434 to generally elliptical movement of a force receiving member 442.

The linkage assembly includes a camshaft 430 which is rotatably mounted on the frame 420 by means of bearing assemblies 436. A relatively large diameter sprocket 493 is mounted on the camshaft 430 and rotates together therewith about a camshaft axis relative to the frame 420. A first link 440 has an upper portion which is rotatably mounted on an eccentric portion 432 of the camshaft 430. This step in the assembly process may be performed by separating the first link 440 into two discrete parts along the line shown intersecting the eccentric portion 432 in FIG. 7. The link 440 rotates about a discrete axis relative to the eccentric portion 432, which in turn, rotates about the camshaft axis. The foot receiving element 442 is mounted on an opposite, lower end of the first link 440. A hole 447 is formed through the first link 440 to receive an optional hand receiving element with or without intermediate linkage components (like those on the first embodiment 15).

The sprocket 493 is connected to a relatively small diameter sprocket 492 by means of a continuous belt 499. The sprocket 492 rotates together with the flywheel 434 relative to the frame 420. The flywheel shaft 490 is rotatably mounted to the frame 420 by means of bearing assemblies 496. Those skilled in the art will recognize this arrangement as a "stepped up" flywheel assembly which adds inertia to the system.

A bearing member 450 projects laterally outward from opposite sides of the first link 440 and into grooves 425 provided in opposing portions of the frame 420. The bearing member 450 travels along the grooves 425 during rotation of the camshaft 430 and limits movement of the first link 440 relative to the frame 420 accordingly. The bearing member 450 may be provided with a non-circular or "cammed" profile, and/or the grooves 425 may be provided with non-linear or "cammed" profiles, in order to impose desired characteristics on the motion of the first link 440. A slot 429 in the frame 420 provides clearance for the link 440 as it cycles.

Figure 9:
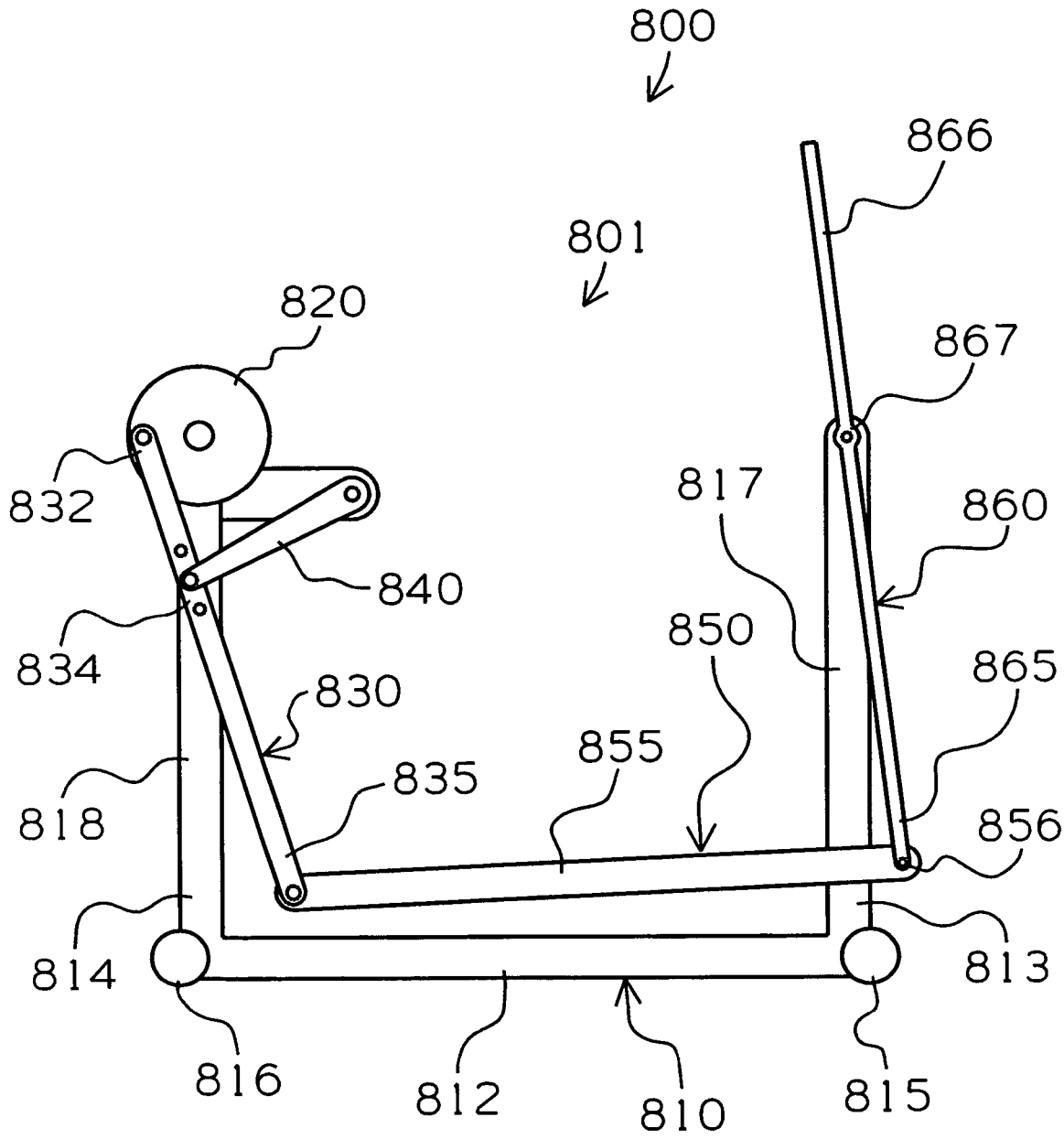
FIG. 9 is a side view of another exercise apparatus constructed according to the principles of the present invention.

A sixth exercise apparatus constructed according to the principles of the present invention is designated as 800 in FIG. 9. The exercise apparatus 800 generally includes a linkage assembly 801 which moves relative to a frame 810 in a manner that links rotation of a crank 820 to generally elliptical motion of a force receiving member 850. The term "elliptical motion" is intended in a broad sense to describe a closed path of motion having a relatively longer first axis and a relatively shorter second axis (which is perpendicular to the first axis).

The frame 810 generally includes a base 812 which extends from a forward end 813 to a rearward end 814. A relatively forward transverse support 815 and a relatively rearward transverse support 816 cooperate to stabilize the apparatus 800 relative to a horizontal floor surface. A first stanchion or upright support 817 extends upward from the base 812 proximate its forward end 813. A second stanchion or upright support 818 extends upward from the base 812 proximate its rearward end 814.

The apparatus 800 is generally symmetrical about a vertical plane extending lengthwise through the base 812 (perpendicular to the transverse ends 815 and 816 thereof), the primary exception being the diametrically opposed linkage assembly components on opposite sides of the plane of symmetry. Like reference numerals are used to designate both the "right-hand" parts and the "left-hand" parts on the apparatus 800, and when reference is made to one or more parts on only one side of the apparatus, it is to be understood that corresponding part(s) are disposed on the opposite side. Those skilled in the art will also recognize that the portions of the frame 810 which are intersected by the plane of symmetry exist individually and thus, do not have any "opposite side" counterparts.

The linkage assembly 801 generally includes left and right cranks 820, left and right first links 830, left and right second links or rocker links 840, left and right third links or foot supporting links 850, and left and right fourth links or rocker links 860. On each side of the apparatus 800, a crank 820 is rotatably mounted to the rear stanchion 818 via a common shaft. In the embodiment 800, each crank 820 is a flywheel which is rigidly secured to the crank shaft, so that each crank 820 rotates together with the crank shaft relative to the frame 810. The flywheels 820 add inertia to the linkage assembly 801, and a drag strap or other known device may be connected to at least one of the flywheels 820 to provide an element of resistance.

An upper distal end 832 of each first link 830 is rotatably connected to a respective crank 820. As a result of this arrangement, the first link 830 is rotatable relative to the crank 820 and thereby defines an axis of rotation which, in turn, is rotatable about the crank shaft or crank axis. Each first link 830 has an intermediate portion 834 which is rotatably connected to a respective second link 840. Each first link 830 has an opposite, second distal portion 835 which is rotatably connected to a rearward end of a respective third link 850.

Each second link 840 is rotatably interconnected between the stanchion 818 and a respective first link 830 and may be described as a rocker link. As part of an optional adjustment feature, each second link 840 may be secured in any of a plurality of positions along the intermediate portion 834 of a respective first link 830. In particular, a fastener is inserted through any of several holes in the first link 830 and an aligned hole in the second link 840. Those skilled in the art will recognize that various known fasteners, such as a snap button or a detent pin, may be used to make the adjustable connection. As a result of the interconnection between the first link 830 and the second link 840, the first link 830 pivots relative to the second link 840 and thereby defines an axis of rotation which, in turn, pivots relative to the stanchion 818. In other words, the intermediate portion 834 of the first link 830 is constrained to move in reciprocating fashion relative to the stanchion 818.

Each third link 850 is rotatably interconnected between a respective first link 830 and a respective fourth link 860. Since the first links 830 are linear in this embodiment 800, the three rotational axes associated therewith lie within a single plane (which extends perpendicular to the drawing sheet of FIG. 9).

Each third link 850 has an intermediate portion 855 which is sized and configured to support a person's foot. In this regard, each third link 850 may be described as a force receiving means and/or a foot supporting member. Each third link 850 has an opposite, forward end 856 which is rotatably connected to a lower end 865 of a respective fourth link 860.

An intermediate portion 867 of each fourth link 860 is rotatably connected to the forward stanchion 817. As a result of this arrangement, each third link 850 pivots relative to a respective fourth link 860 and thereby defines an axis of rotation which, in turn, pivots relative to the frame 810. In other words, each fourth link 860 is rotatably interconnected between a respective third link 850 and the frame 810 and may be described as a rocker link and/or as a means for constraining the forward end 856 of the third link 850 to move in reciprocating fashion relative to the frame 810. An opposite, upper end 866 of each fourth link 860 is sized and configured for grasping by a person standing on the foot supports 855. In this regard, each fourth link 860 may be described as a force receiving means and/or a hand supporting member.

To use the apparatus 800, a person stands with a respective foot on each of the foot supports 855 and begins moving his or her feet in striding fashion. The linkage assembly 801 constrains the person's feet to move through elliptical paths while the cranks 820 rotate relative to the frame 810. The point of interconnection between the first link 830 and the second link 840 may be moved along the length of the former in order to adjust the foot path. The handles 866 move in reciprocal fashion during rotation of the cranks 820, so that the person may exercise his or her arms simply by grasping a respective handle 866 in each hand. In the alternative, the person may simply balance during leg exercise and/or steady himself or herself relative to a stationary support (not shown) on the frame 810.

The apparatus 800 may be modified in a number of ways without departing from the scope of the present invention. For example, the rocker links 860 could be replaced by rollers mounted on the forward ends of the foot supporting links 850 and in rolling contact with a ramp or tracks mounted on the frame. Furthermore, the rearward stanchion 818 could be altered so that the axis defined between the rockers 840 and the stanchion 818 would be disposed behind the crank axis. Moreover, an upper portion of the rear stanchion could be pivotally mounted to a lower portion thereof and selectively moved relative thereto in order to adjust the foot path. The cranks 820 could be replaced by crank arms and a "stepped-up" flywheel and/or supplemented with a drag strap or other known resistance device to provide momentum and/or resistance to exercise movement. Such machines could also be modified so that the rocker axis is oriented differently and/or selectively movable relative to the crank axis.

Figure 10:
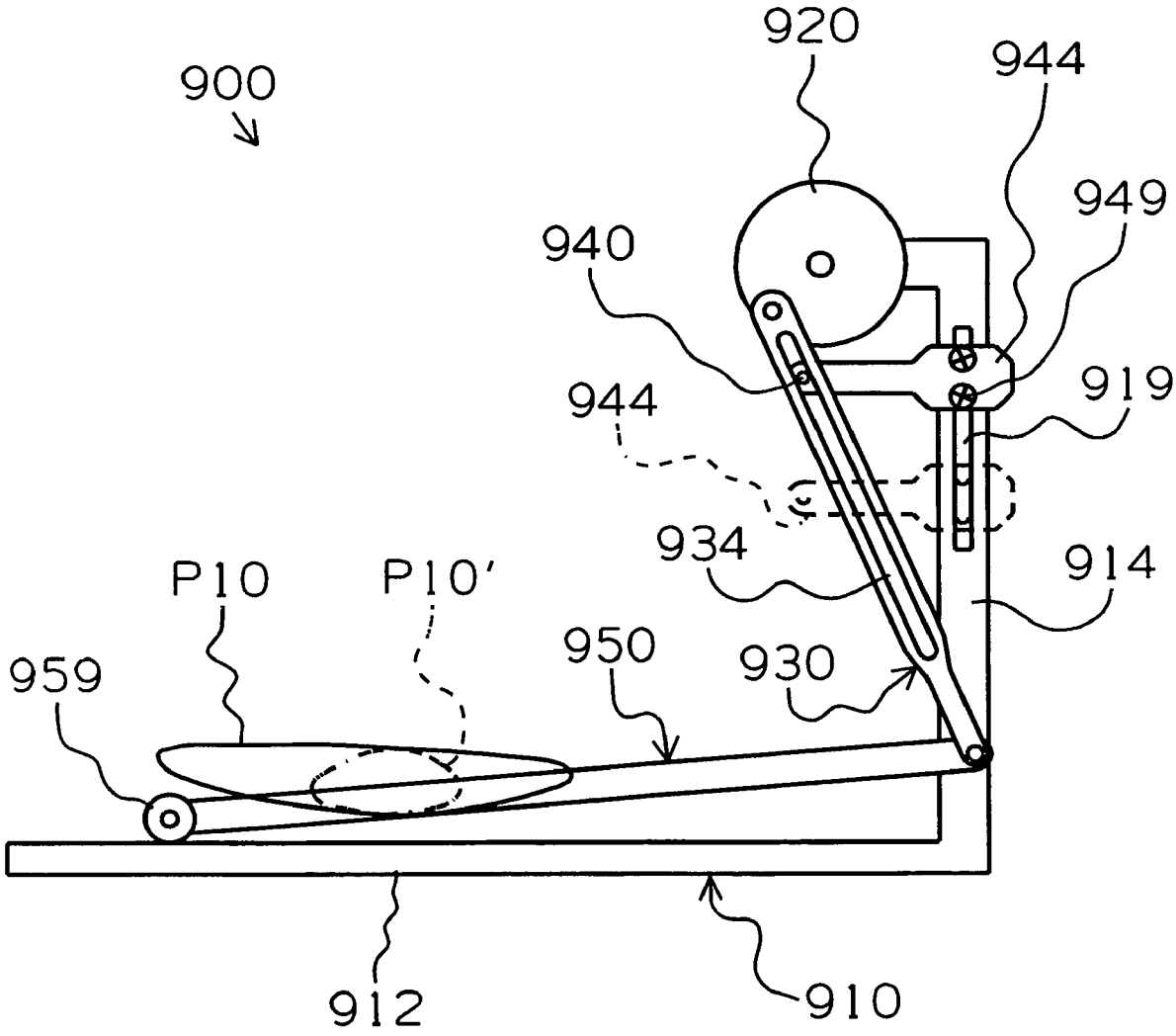
FIG. 10 is a side view of another exercise apparatus constructed according to the principles of the present invention.

FIG. 10 shows a striding apparatus 900 similar in several respects to the foregoing embodiment 800. The apparatus 900 has a frame 910 which includes a base 912 designed to rest upon a floor surface, and a stanchion 914 extending upward from an end of the base 912. Left and right cranks 920 are rotatably mounted on opposite sides of the stanchion 914 and rotate about a common crank axis relative thereto. The cranks 920 may be flywheels or crank arms which are optionally connected to a flywheel, either directly or in "stepped-up" fashion.

On each side of the apparatus 900, a first end of a connector link 930 is rotatably connected to a respective crank 920 (by means of a pin joint). A slot 934 is provided along an intermediate portion of each connector link 934 to receive a bearing member 940. The bearing members 940 are mounted on a common bracket 944 which is rigidly secured in any of several locations along the stanchion 914. More specifically, at least one fastener 949 extends through the bracket 944 and into a slot 919 in the forward stanchion 914. The fasteners 949 selectively lock and unlock the bracket 944 in place relative to the stanchion 914 to facilitate adjustment of the former relative to the latter.

Left and right foot supporting members 950 have first ends which are rotatably connected to second, opposite ends of respective connector links 930 (by means of pin joints). Left and right rollers 959 are rotatably connected to second, opposite ends of respective foot supporting links 950, and the rollers 959 travel along at least one underlying surface on the base 912 (or the floor). An intermediate portion of each foot supporting member 950 is sized and configured to support a respective foot of a standing person.

The arrangement of linkage components is such that rotation of the cranks 920 is linked to generally elliptical movement of the intermediate portions of the foot supporting members. When the bracket 944 occupies the position shown in solid lines in FIG. 10, a person's foot moves through the path designated as P10. When the bracket 944 occupies the position shown in dashed lines in FIG. 10, a person's foot moves through the path designated as P10'. Among other things, a powered actuator could be substituted for the fasteners 949 to facilitate adjustments to the path configuration during exercise and/or in response to a control signal.

The present invention may also be described in terms of methods (with reference to the foregoing embodiments 800 and/or 900, for example). One such method involves linking rotation of a crank to generally elliptical movement of a foot supporting member. The method includes the steps of rotatably mounting a crank on a frame; rotatably mounting a first portion of a link on the crank; constraining a second portion of the link to move in reciprocating fashion relative to the frame; rotatably connecting a third portion of the link to a first end of a foot supporting member; and constraining an opposite end of the foot supporting member to move in reciprocating fashion relative to the frame. As used herein, the term "reciprocating" is intended to describe movement in a first direction through a first path followed by movement in a second, opposite direction through a second path which is comparable and/or identical in size and orientation to the first path. The method may further include the step of changing the location of one or more rotational axes, in order to change the path traveled by the foot supporting member.

Figure 44:
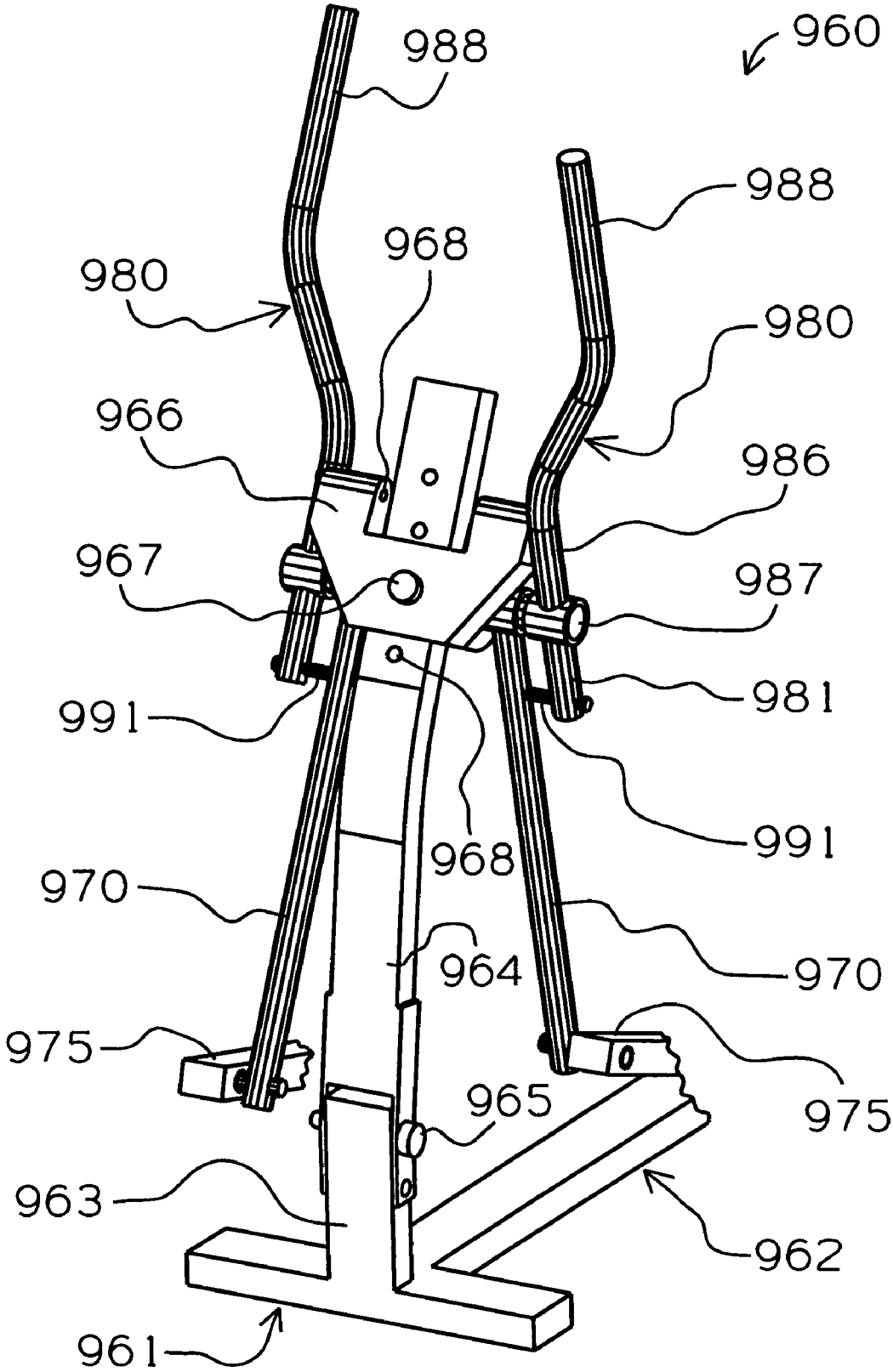
FIG. 44 is a perspective view of an arm exercise assembly suitable for use on some embodiments of the present invention.

Another variation of the present invention may be described with reference to an arm exercise assembly designated as 960 in FIG. 44. The assembly 960 is shown relative to a frame 961 having a base 962 that is designed to rest upon a floor surface. A stanchion or upright 963 extends upward from the base 962 proximate the front end of the frame 961. A post 964 is pivotally mounted on the upright 963 and selectively secured in a generally vertical orientation by means of a ball detent pin 965. The pin 965 may be removed in order to pivot the post 964 to a collapsed or storage position relative to the base 962.

Another frame member or yoke 966 is slidably mounted on the post 964, between an upper distal end of the post 964 and a pair of outwardly extending shoulders near the lower, pivoting end. A spring-loaded pin 967 (or other suitable fastener) extends through the frame member 966 and into any of a plurality of holes 968 in the post 964 to selectively lock the frame member 966 at one of a plurality of positions along the post 964 (and above the underlying floor surface).

Left and right vertical members or rocker links 970 have upper ends which are rotatably mounted to opposite sides of a shaft 987 on the frame member 966. Opposite, lower ends of the links 970 are rotatably connected to forward ends of respective foot supporting members 975. The rearward portions of the foot supporting members 975, as well as the remainder of the linkage assembly components, are comparable to those on the foregoing embodiment 800, for example. The inclination of the path traveled by the foot supporting members 975 is a function of the height of the frame member 966 above the floor surface. In other words, the difficulty of exercise can be increased simply by locking the frame member 966 in a relatively higher position on the post 964.

Left and right handle members 980 are also rotatably connected to opposite ends of the shaft 987 on the frame member 966 and thus, share a common pivot axis with the links 970. The handle members 980 include upper, distal portions 988 which are sized and configured for grasping by a person standing on the foot supporting members 975. A hole is formed through each handle member 980, proximate its lower end 981 (and beneath the pivot axis), and a corresponding hole is formed through each link 970 at an equal radial distance away from the pivot axis.

Pins 991 are selectively inserted through the aligned holes to interconnect respective links 970 and handle members 980 and thereby constrain each pinned combination to pivot as a unit about the pivot axis. In this particular configuration, the pins 991 may be said to be selectively interconnected between respective handle members 980 and links 970, and/or to provide a means for selectively linking respective handle members 980 and links 970. Moreover, the pins 991 may be seen to cooperate with the links 970 to provide a means for selectively linking the handle members 980 to respective foot supporting members 975.

Another hole 986 is formed through each of the handle members 980, above the pivot axis, and corresponding holes 968 are formed in the frame member 966 at an equal radial distance above the pivot axis. The same pins 991 may alternatively be inserted through the aligned holes 986 and 968 to interconnect the handle members 980 and the frame member 966 and thereby lock the former in place relative to the latter. In this configuration, the pins 991 may be seen to provide a means for selectively locking the handle members 980 (but not the links 970) to the frame 961. In the absence of any such pin connections, the handle members 980 and the links 970 are free to pivot relative to the frame 961 and one another.

Figure 11:
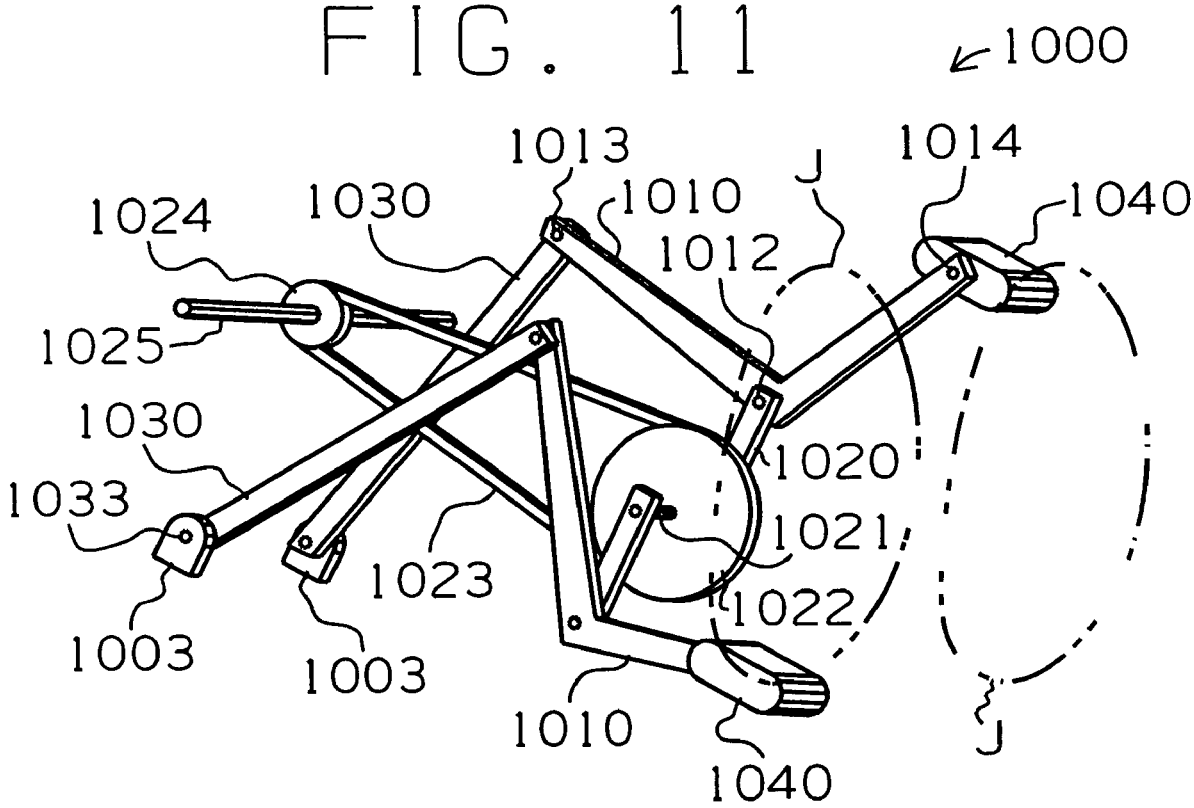
FIG. 11 is a perspective view of another exercise apparatus constructed according to the principles of the present invention.
Figure 12:
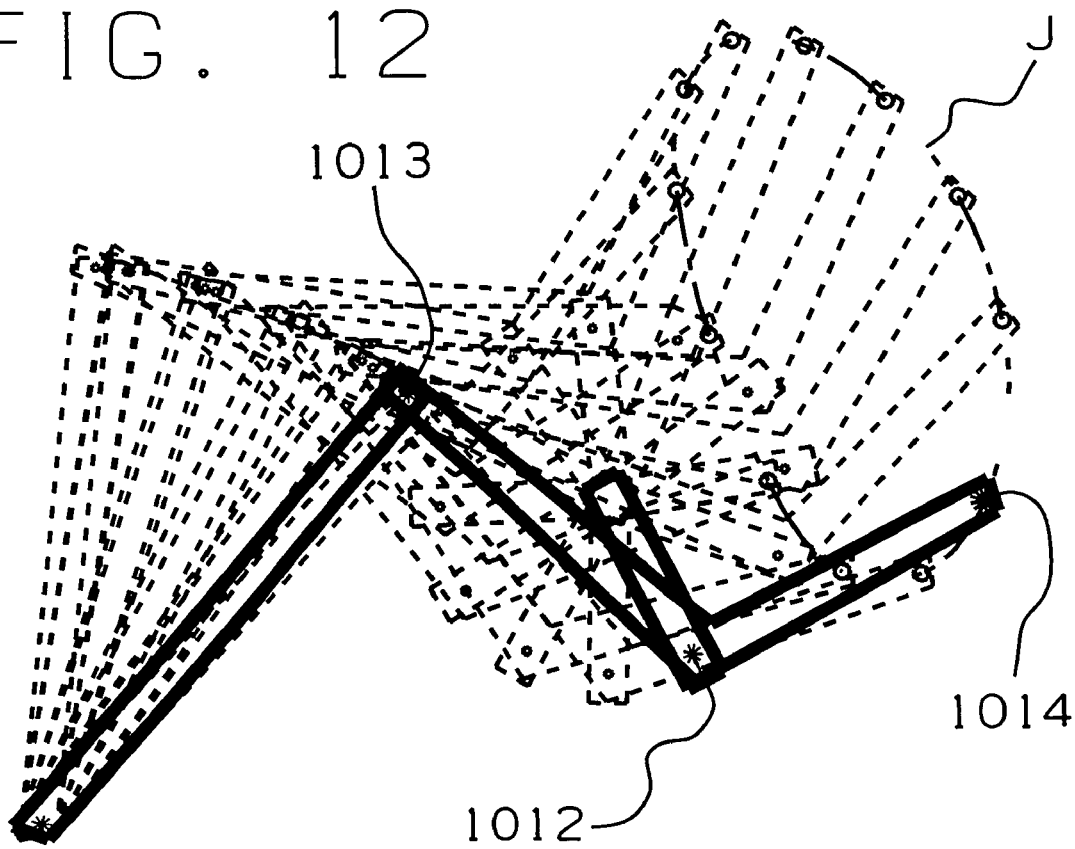
FIG. 12 is a side view of the linkage assembly on the apparatus of FIG. 11, with the linkage members depicted at different times during an exercise cycle.

Another exercise apparatus constructed according to the principles of the present invention is designated as 1000 in FIGS. 11-12. The apparatus 1000 generally includes a frame and a linkage assembly which moves relative to the frame in a manner that links rotation of left and right cranks to generally elliptical motion of left and right force receiving members.

The linkage assembly may be described in terms of connector links 1010 having three discrete connection points which may be described as three vertices of a triangle. The connector links 1010 maintain fixed distances between the connection points but is not necessarily triangular in shape. On the embodiment 1000, the connector links 1010 have first connection points 1012 which are rotatably connected to radially offset portions of respective cranks 1020; second connection points 1013 which are rotatably connected to distal ends of respective rocker links 1030; and third connection points 1014 which are rotatably connected to respective foot supporting members 1040. Opposite ends of the rocker links 1030 are rotatably connected to respective trunnions 1003 on the frame.

A first portion of each connector link 1010 extends in linear fashion between the first connection point 1012 and the second connection point 1013, and a second portion of each connector link 1010 extends in linear fashion between the first connection point 1012 and the third connection point 1014. Each connector link 1010 could be provided with a third portion which extends in linear fashion between the second connection point 1013 and the third connection point 1014 (in addition to or in lieu of either other portion) without affecting the motion of the linkage assembly. FIG. 12 shows the connection points 1012-1014 at various points throughout an exercise cycle.

The cranks 1020 are keyed to a crank shaft 1021 together with a relatively large diameter pulley 1022. A belt 1023 connects the pulley 1022 to a relatively small diameter pulley 1024 which is keyed to a remote shaft 1025. The foot supports 1040 move through generally elliptical paths J, the crank shaft 1021 rotates at a first speed, and the remote shaft 1025 rotates at a second, relatively greater speed. The remote shaft 1025 is suitable for linking movement of the foot supports 1040 to movement of arm exercise members and/or rotation of a flywheel, which in turn, may be acted upon by a drag strap or other known resistance device. In the absence of one-way clutches or the like, the shafts 1021 and 1025 are free to rotate in either direction.

Figure 13A:
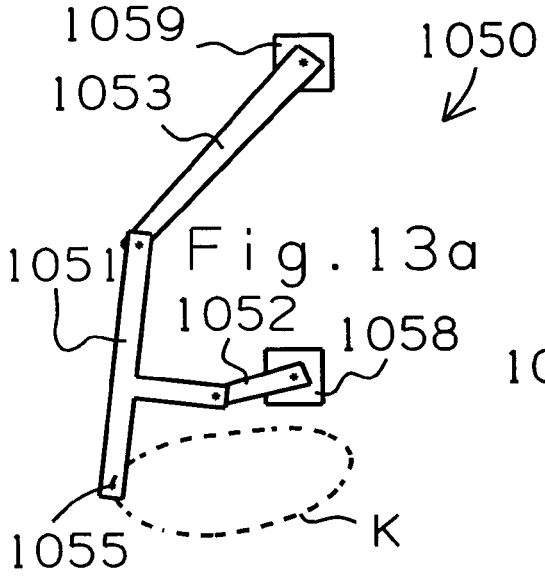
FIGS. 13*a*-13*e* are side views of five distinct linkage assemblies which produce generally elliptical exercise motion.

FIG. 13*a* shows a linkage assembly 1050 which is similar in many respects to that on the apparatus 1000. A connector link 1051 and a crank 1052 are rotatably interconnected to define a first connection point; the connector link 1051 and a rocker link 1053 are rotatably interconnected to define a second connection point; and the connector link 1051 and a foot support are rotatably interconnected to define a third connection point 1055. The T-shape configuration of the connector link 1051 maintains the three connection points in fixed relationship to one another.

A radially inward end of the crank 1052 is rotatably connected to a first frame member 1058, and a radially inward end of the rocker link 1053 is rotatably connected to a second frame member 1059. The resulting linkage assembly 1050 links rotation of the crank 1052 to movement of the foot support through a path of motion K. The axes associated with the frame members 1058 and 1059 define a line therebetween which is approximately perpendicular to the major axis of the path K.

Figure 13B:
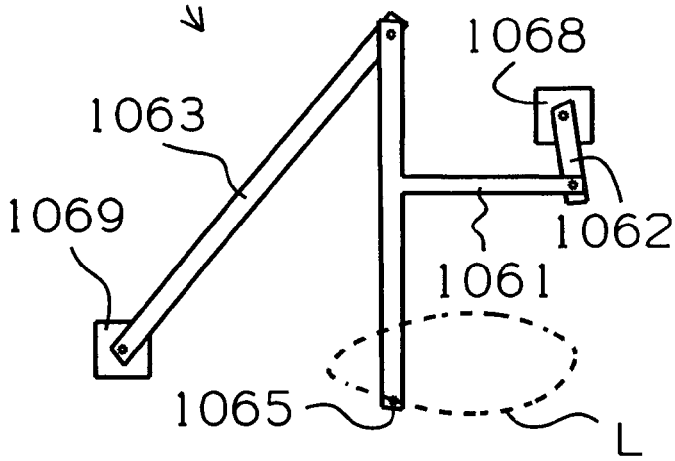

FIG. 13*b* shows a linkage assembly 1060 which is similar in some respects to the previous assembly 1050. A connector link 1061 and a crank 1062 are rotatably interconnected to define a first connection point; the connector link 1061 and a rocker link 1063 are rotatably interconnected to define a second connection point; and the connector link 1061 and a foot support are rotatably interconnected to define a third connection point 1065. The T-shape configuration of the connector link 1061 maintains the three connection points in fixed relationship to one another.

A radially inward end of the crank 1062 is rotatably connected to a first frame member 1068, and a radially inward end of the rocker link 1063 is rotatably connected to a second frame member 1069. The resulting linkage assembly 1060 links rotation of the crank 1062 to movement of the foot support through a path of motion L. The axes associated with the frame members 1068 and 1069 define a line therebetween which is approximately parallel to the major axis of the path L, and at least a portion of the connector link 1061 remains between said axes throughout an exercise cycle. Also, the arrangement and proportions of the linkage components allow a person's hand to rotate with the crank while the person's foot moves with the foot support.

Figure 13C:
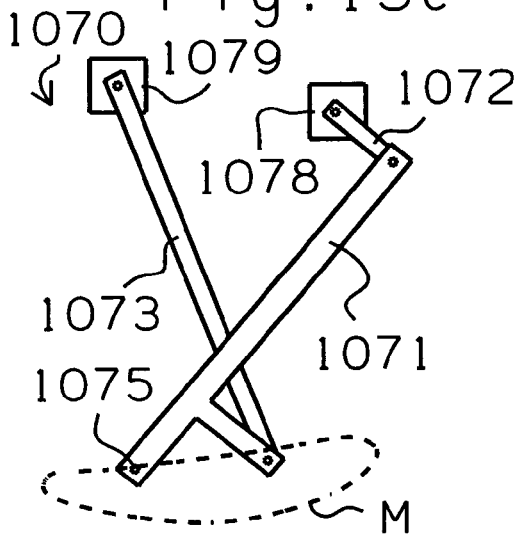

FIG. 13*c* shows a linkage assembly 1070 which is similar in some respects to the assemblies 1050 and 1060. A connector link 1071 and a crank 1072 are rotatably interconnected to define a first connection point; the connector link 1071 and a rocker link 1073 are rotatably interconnected to define a second connection point; and the connector link 1071 and a foot support are rotatably interconnected to define a third connection point 1075. The T-shape configuration of the connector link 1071 maintains the three connection points in fixed relationship to one another.

A radially inward end of the crank 1072 is rotatably connected to a first frame member 1078, and a radially inward end of the rocker link 1073 is rotatably connected to a second frame member 1079. The resulting linkage assembly 1070 links rotation of the crank 1072 to movement of the foot support through a path of motion M. The axes associated with the frame members 1078 and 1079 define a line therebetween which is approximately parallel to the major axis of the path M.

Figure 13D:
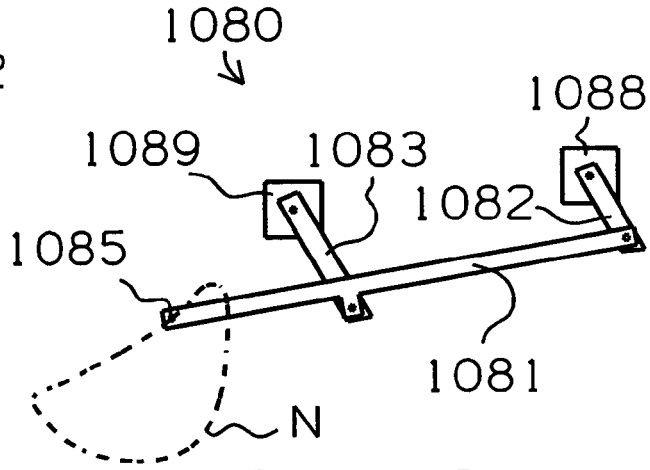

FIG. 13*d* shows a linkage assembly 1080 which is similar in some respects to the previous assembly 1070. A connector link 1081 and a crank 1082 are rotatably interconnected to define a first connection point; the connector link 1081 and a rocker link 1083 are rotatably interconnected to define a second connection point; and the connector link 1081 and a foot support are rotatably interconnected to define a third connection point 1085. The substantially linear connector link 1081 maintains the three connection points in fixed relationship to one another.

A radially inward end of the crank 1082 is rotatably connected to a first frame member 1088, and a radially inward end of the rocker link 1083 is rotatably connected to a second frame member 1089. The resulting linkage assembly 1080 links rotation of the crank 1082 to movement of the foot support through a path of motion N. The axes associated with the frame members 1088 and 1089 define a line therebetween which is approximately parallel to the major axis of the path N.

Figure 13E:
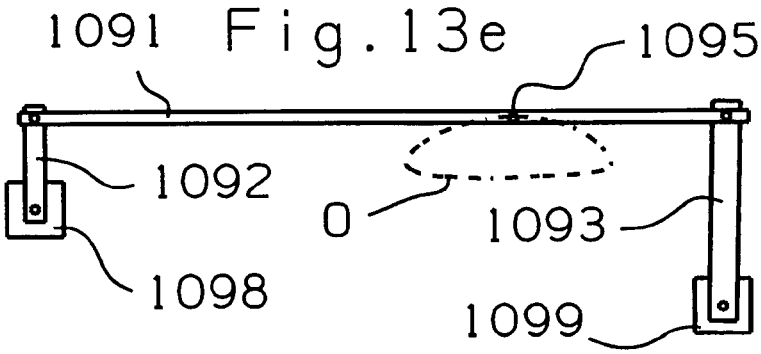

FIG. 13*e* shows a linkage assembly 1090 which is similar in some respects to the previous assembly 1080. A connector link 1091 and a crank 1092 are rotatably interconnected to define a first connection point; the connector link 1091 and a rocker link 1093 are rotatably interconnected to define a second connection point; and the connector link 1091 and a foot support are rotatably interconnected to define a third connection point 1095. The substantially linear connector link 1091 maintains the three connection points in fixed relationship to one another.

A radially inward end of the crank 1092 is rotatably connected to a first frame member 1098, and a radially inward end of the rocker link 1093 is rotatably connected to a second frame member 1099. The resulting linkage assembly 1090 links rotation of the crank 1092 to movement of the foot support through a path of motion M. The axes associated with the frame members 1098 and 1099 define a line therebetween which is approximately parallel to the major axis of the path O.

Figure 14:
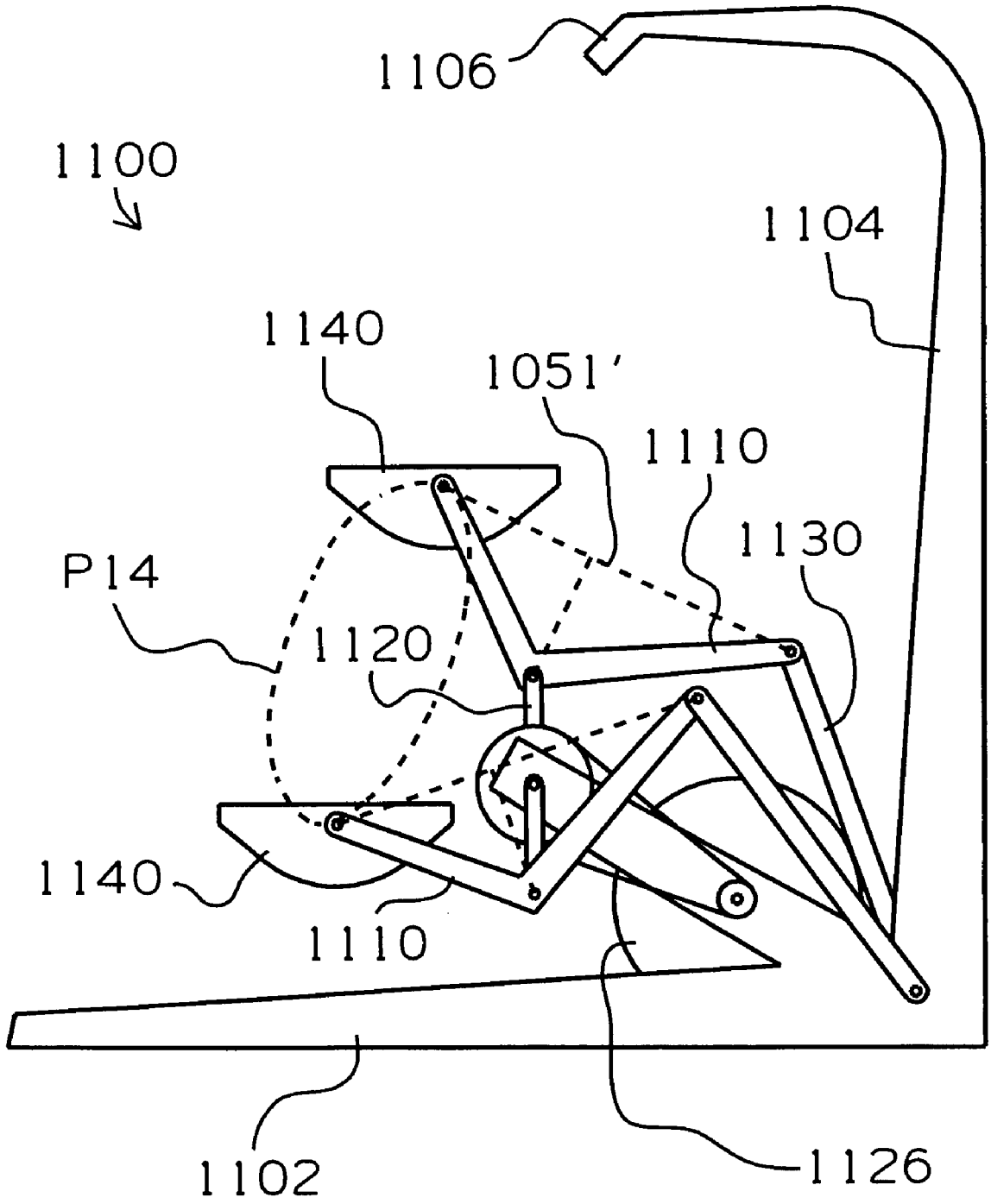
FIG. 14 is a side view of another exercise apparatus constructed according to the principles of the present invention.

FIG. 14 shows a "stand up" exercise apparatus 1100 having a linkage assembly similar to that designated as 1050 in FIG. 13*a*. The apparatus frame includes a base 1102 designed to rest upon a floor surface; a forward stanchion 1104 extending upward from the base 1102; and fixed handle bars 1106 extending rearward from an upper end of the stanchion 1104.

Crank arms 1120 are rotatably mounted relative to the frame and operatively connected to a "stepped up" flywheel 1126. Radially displaced ends of the crank arms 1120 are connected to respective connector links 1110. The dashed lines designated as 1051' are included in FIG. 14 to suggest an alternative connector link configuration. Rocker links 1130 are movably interconnected between the frame and respective connector links 1110. Foot supports 1140 are connected to respective connector links 1110.

Rotation of the crank arms 1120 is linked to reciprocal pivoting of the rocker links 1130 and movement of the foot supports 1140 through generally elliptical paths of motion designated as P14. The foot supports 1140 are preferably connected to the connector links 1110 in a manner which allows rotation of the former approximately nineteen degrees in either direction relative to the latter. An alternative way to facilitate "leveling" of the foot supports is to suspend them from the connector links 1110, so that a user's weight tends to remain under center of the rotational axis defined between the foot support and the connector link.

Figure 15:
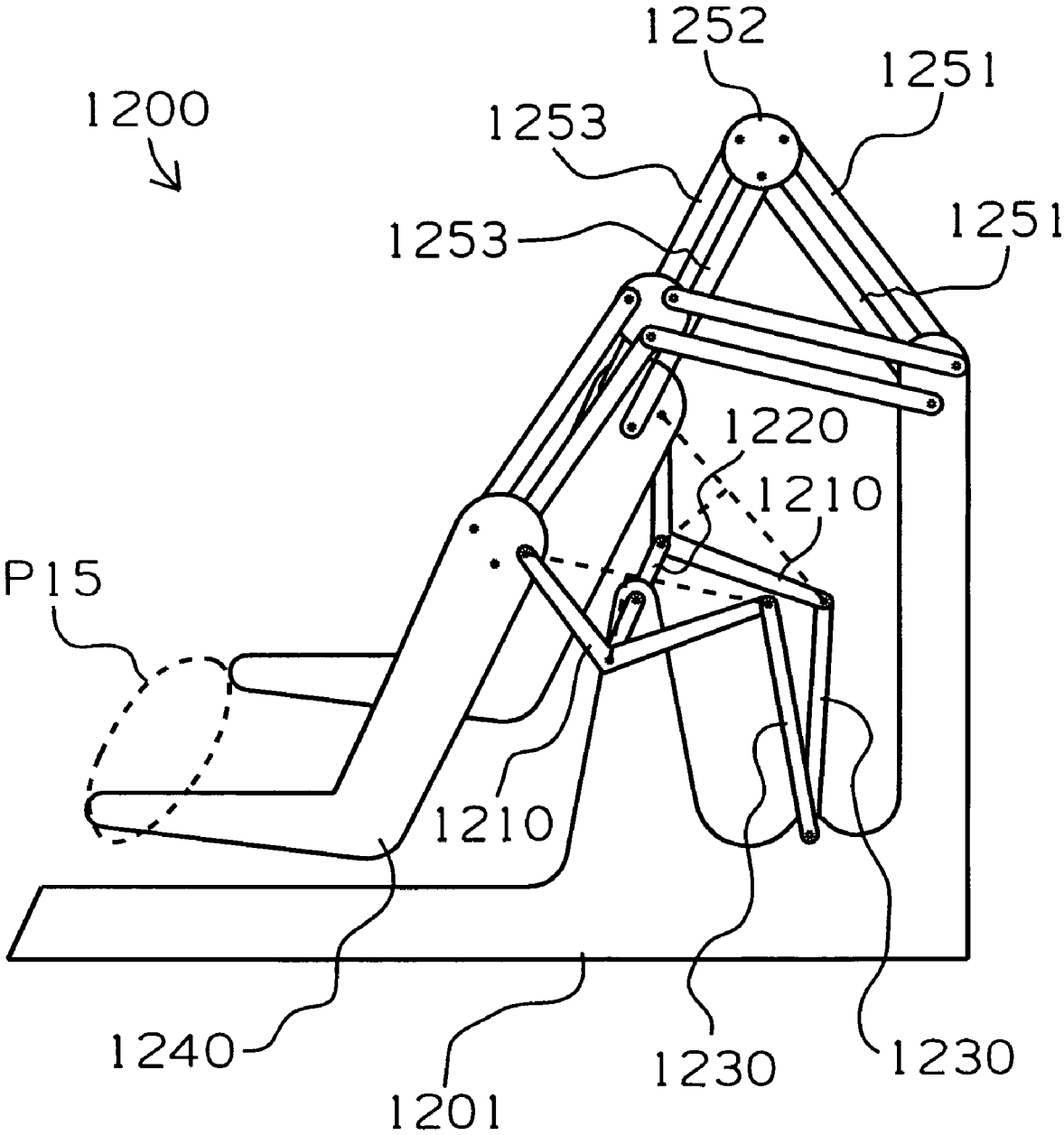
FIG. 15 is a side view of another exercise apparatus constructed according to the principles of the present invention.

FIG. 15 shows another "stand up" exercise apparatus 1200 which is similar in many respects to the previous embodiment 1100. Connector links 1210 have first portions connected to respective crank arms 1220; second portions connected to respective rocker links 1230; and third portions connected to respective foot supports 1240. Rotation of the crank arms 1220 relative to the frame 1201 is linked to reciprocal pivoting of the rocker links 1230 and movement of the foot supports 1240 through generally elliptical paths of motion designated as P15.

The foot supports 1240 are maintained in level orientations by means of guide linkages movably interconnected between the foot supports 1240 and the frame 1201. On this embodiment, each guide linkage includes a first pair of parallel bars 1251 rotatably interconnected between the frame 1201 and a plate 1252, and a second pair of parallel bars 1253 rotatably interconnected between the plate 1252 and a respective foot support 1240.

Figure 16:
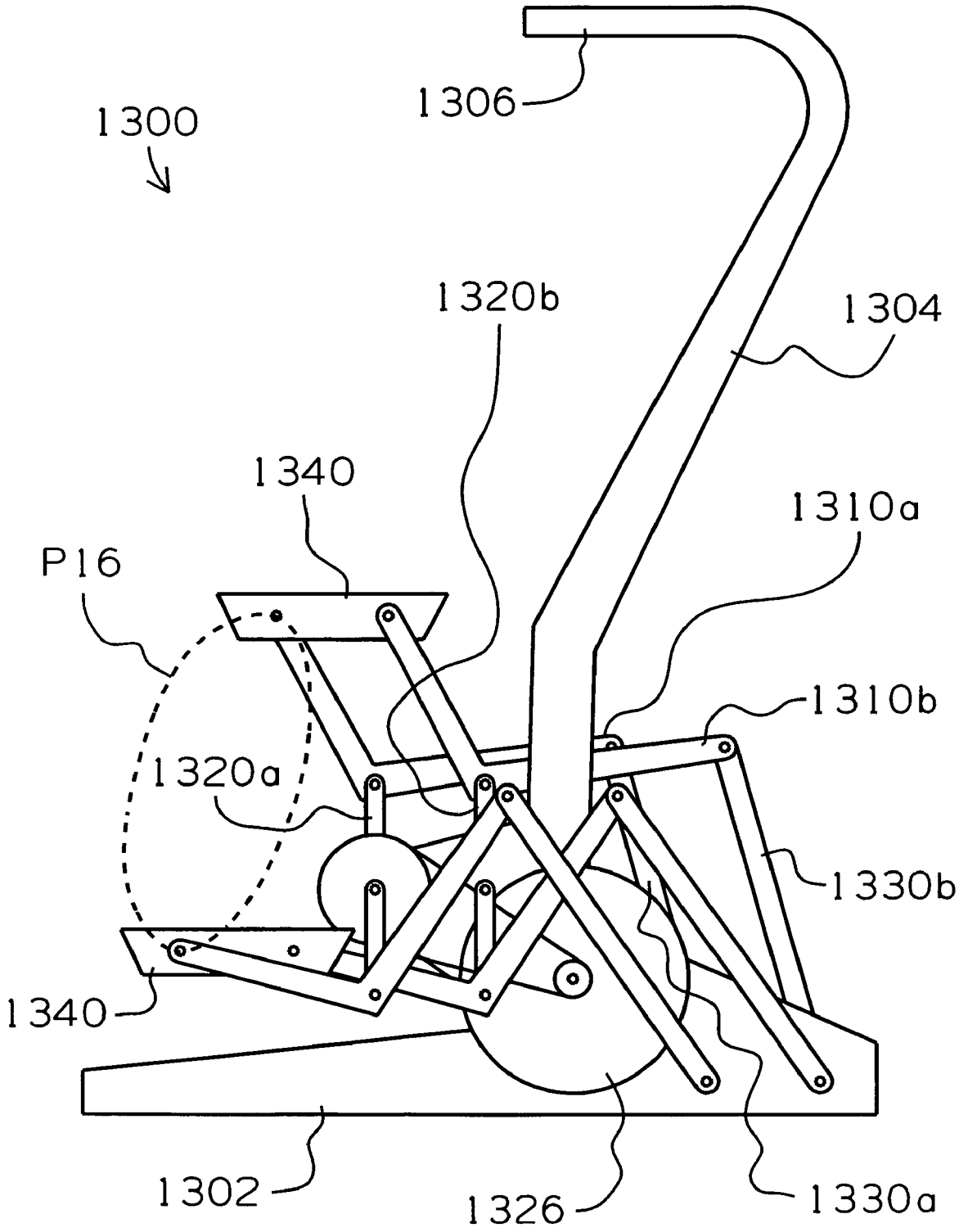
FIG. 16 is a side view of another exercise apparatus constructed according to the principles of the present invention.

FIG. 16 shows another "stand up" exercise apparatus 1300 which is similar in many respects to the previous embodiments 1100 and 1200. The apparatus frame includes a base 1302 designed to rest upon a floor surface; a stanchion 1304 extending upward from the base 1302; and fixed handle bars 1306 extending rearward from an upper end of the stanchion 1304.

On each side of the apparatus 1300, first and second connector links 1310*a* and 1310*b* have first portions connected to respective first and second crank arms 1320*a* and 1320*b*; second portions connected to respective first and second rocker links 1330*a* and 1330*b*; and third portions connected to a respective foot support 1340. Rotation of the crank arms 1320*a* and 1320*b* relative to the frame is linked to reciprocal pivoting of the rocker links 1330*a* and 1330*b* and movement of the foot supports 1340 through generally elliptical paths of motion designated as P16. The rocker links 1330 pivot through a range of approximately 36 degrees and are within eleven degrees of the their forwardmost orientation when a respective foot platform 1340 reaches its apex. The foot supports 1340 are maintained in level orientations by means of the dual linkage assemblies associated with each foot support 1340. At least one of the crank arms 1320*a* and 1320*b* is operatively connected to a "stepped up" flywheel 1326.

Figure 17:
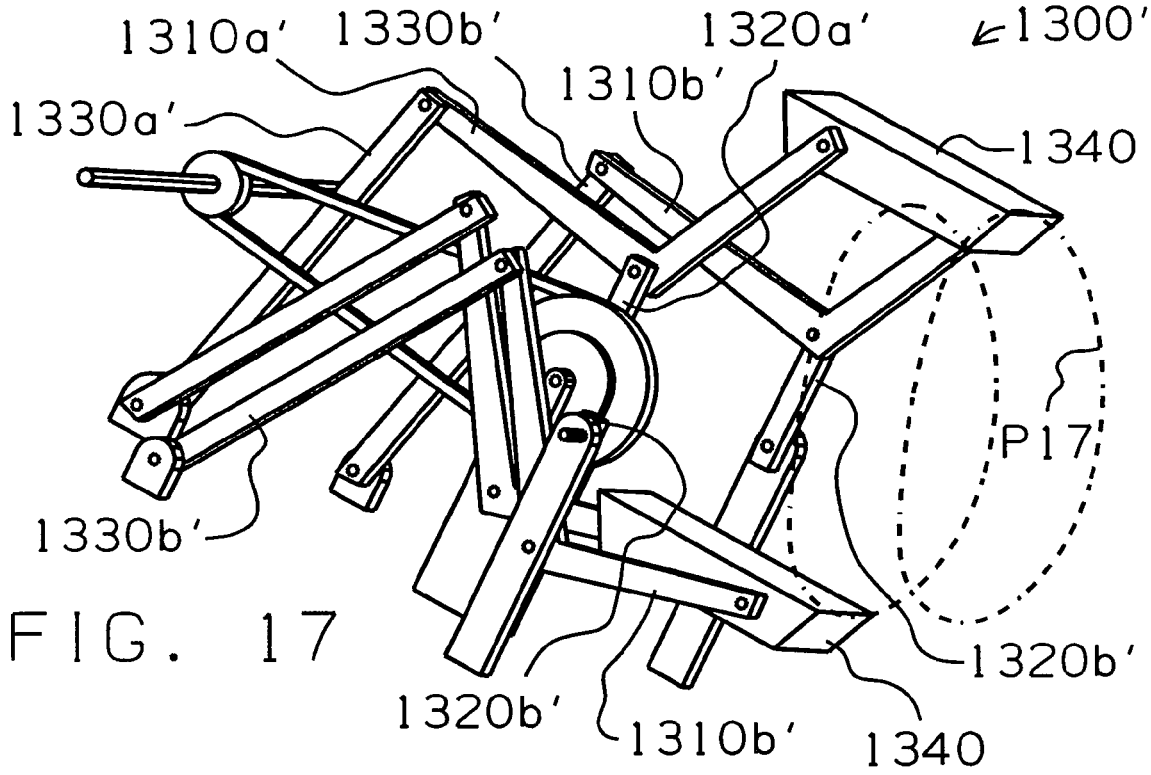
FIG. 17 is a perspective view of the linkage assembly on the apparatus of FIG. 16.

FIG. 17 shows a linkage assembly 1300' which is similar in many respects to that on the apparatus 1300. On each side of the assembly 1300', first and second connector links 1310*a*' and 1310*b*' have first portions connected to respective first and second crank arms 1320*a*' and 1320*b*'; second portions connected to respective first and second rocker links 1330*a*' and 1330*b*'; and third portions connected to a respective foot support 1340. Rotation of the crank arms 1320*a*' and 1320*b*' relative to the frame is linked to reciprocal pivoting of the rocker links 1330*a*' and 1330*b*' and movement of the foot supports 1340 through generally elliptical paths of motion designated as P17. Although the crank arms 1320*b*' are not keyed to a common shaft, they are still constrained to rotate in synchronous fashion.

Figure 18:
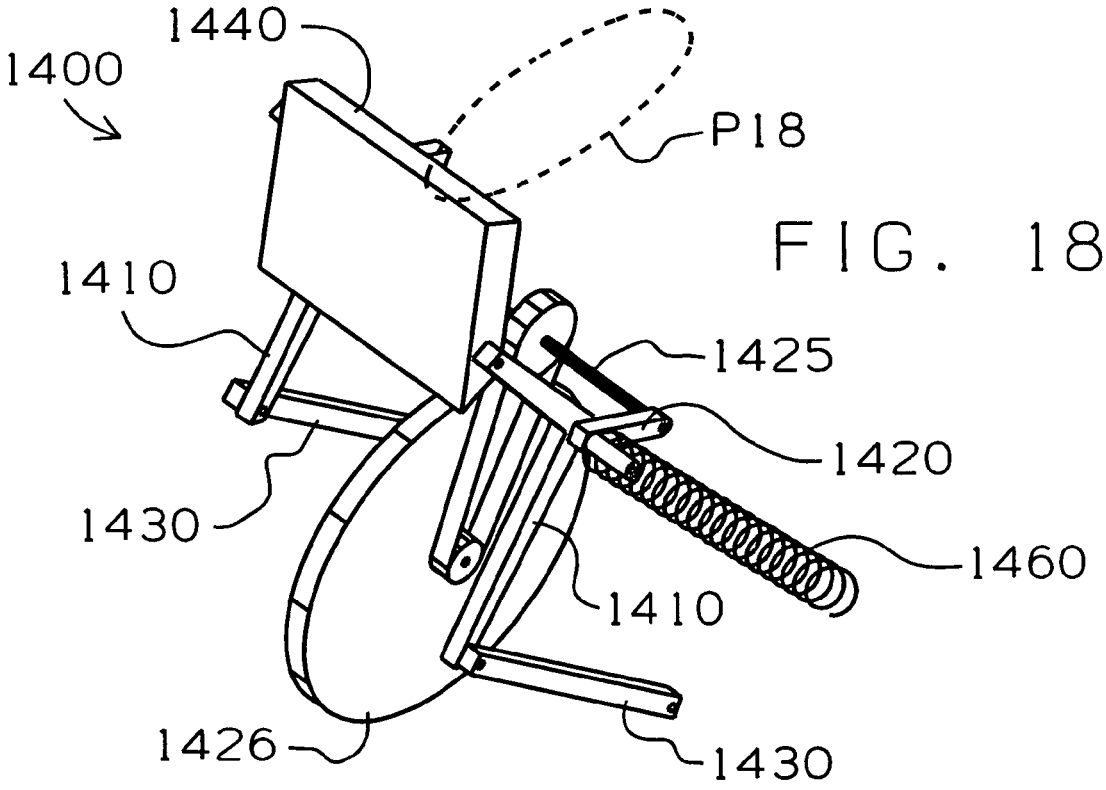
FIG. 18 is a perspective view of another exercise apparatus constructed according to the principles of the present invention.

FIG. 18 shows a linkage assembly 1400 which is similar in some respects to the previous assembly 1300'. First and second connector links 1410 have first portions connected to respective first and second crank arms 1420; second portions connected to respective first and second rocker links 1430; and third portions connected to a foot support 1440. Rotation of the crank arms 1420 relative to the frame is linked to reciprocal pivoting of the rocker links 1430 and movement of the foot support 1440 through a generally elliptical path of motion designated as P18.

The foot support 1440 is maintained in a constant orientation relative to the frame by offsetting the rotational axes and connection points on one side of the assembly 1400 relative to those on the other side of the assembly 1400. Although the crank arms 1420 are not keyed to a common shaft, they are still constrained to rotate in synchronous fashion.

The foot support 1440 is sized and configured to accommodate both feet of a user seated and facing toward the foot support 1440, and the linkage assembly 1400 is designed to provide a leg press type exercise motion. A "stepped up" flywheel 1426 is connected to a crank shaft 1425 to add inertia to the assembly 1400, and a spring 1460 is disposed in compression between the frame and the first portion of a connector link 1410 to bias the foot support 1440 toward the user. Similar springs could be used on other embodiments in addition to or in lieu of a flywheel.

Figure 19:
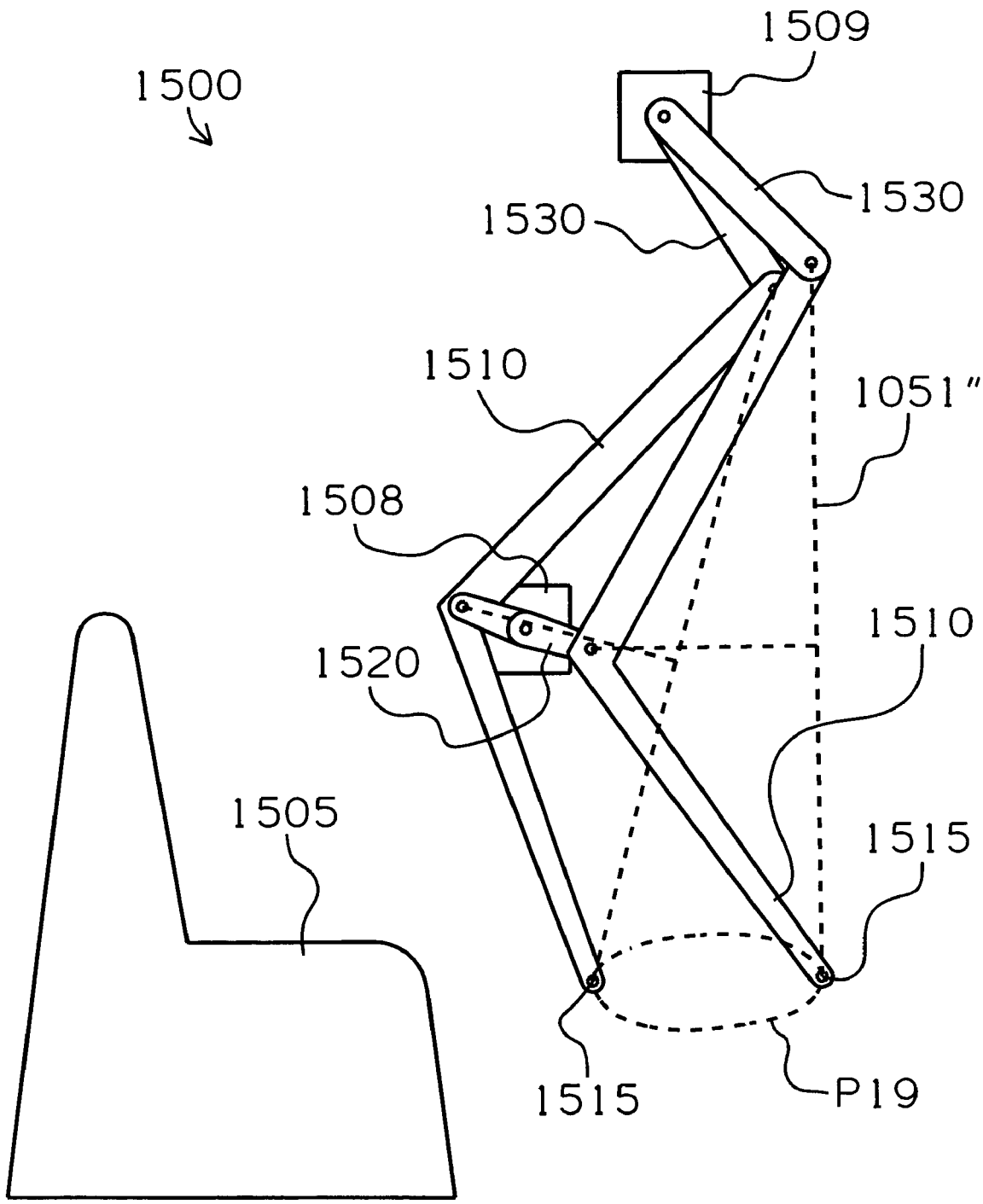
FIG. 19 is a side view of another exercise apparatus constructed according to the principles of the present invention.

FIG. 19 shows another "sit down" exercise apparatus 1500 which includes a chair 1505 and a linkage assembly similar to that shown in FIG. 13*a*. Connector links 1510 have first portions connected to respective crank arms 1520; second portions connected to respective rocker links 1530; and third portions connected to respective foot supports at connection points 1515. A radially inward end of each crank 1520 is rotatably connected to a first frame member 1508, and a radially inward end of the rocker link 1530 is rotatably connected to a second frame member 1509. The resulting linkage assembly links rotation of the crank arms 1520 relative to the frame to pivoting of the rocker links 1530 and movement of the foot support connection points 1515 through generally elliptical paths of motion designated as P19. The dashed lines 1051" suggest an alternative configuration for the connector links 1510. On embodiments like the apparatus 1500, where the crank arms are keyed to a common shaft, a flywheel could be substituted for the crank arms, and the connector links could be rotatably connected directly to diametrically opposed points on the flywheel.

Figure 20:
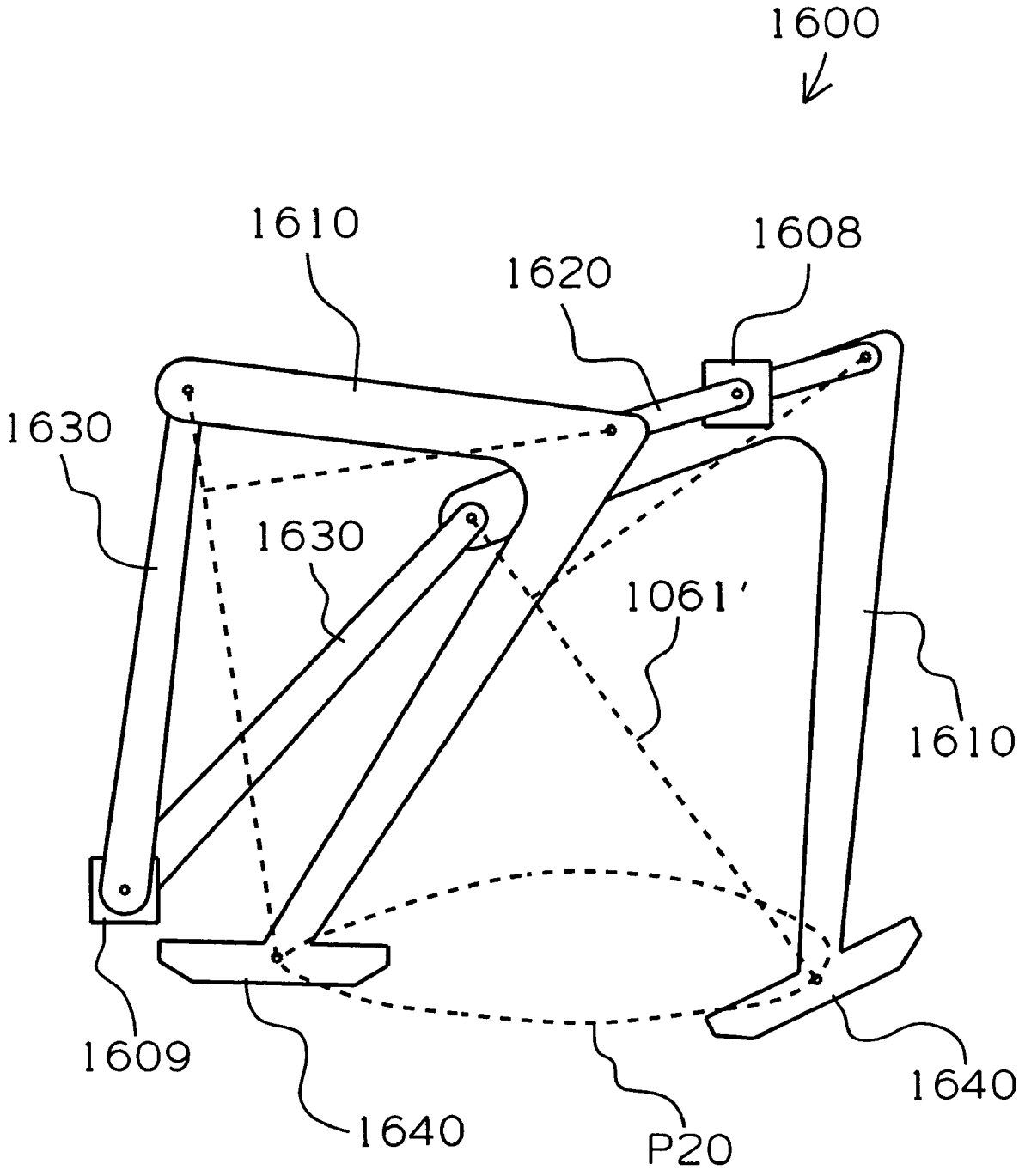
FIG. 20 is a side view of another exercise apparatus constructed according to the principles of the present invention.

FIG. 20 shows a "stand up" exercise apparatus 1600 having a linkage assembly which is similar in many respects to that shown in FIG. 13*b*. Connector links 1610 have first portions connected to respective crank arms 1620; second portions connected to respective rocker links 1630; and third portions connected to respective foot supports 1640. A radially inward end of each crank 1620 is rotatably connected to a first frame member 1608, and a radially inward end of the rocker link 1630 is rotatably connected to a second frame member 1609. The resulting linkage assembly links rotation of the crank arms 1620 relative to the frame to pivoting of the rocker links 1630 and movement of the foot supports 1640 through generally elliptical paths of motion designated as P20. The foot supports 1640 are rigidly secured to the connector links 1610 and change orientations during the exercise cycle. The dashed lines 1061' suggest an alternative configuration for the connector links 1610.

Figure 21:
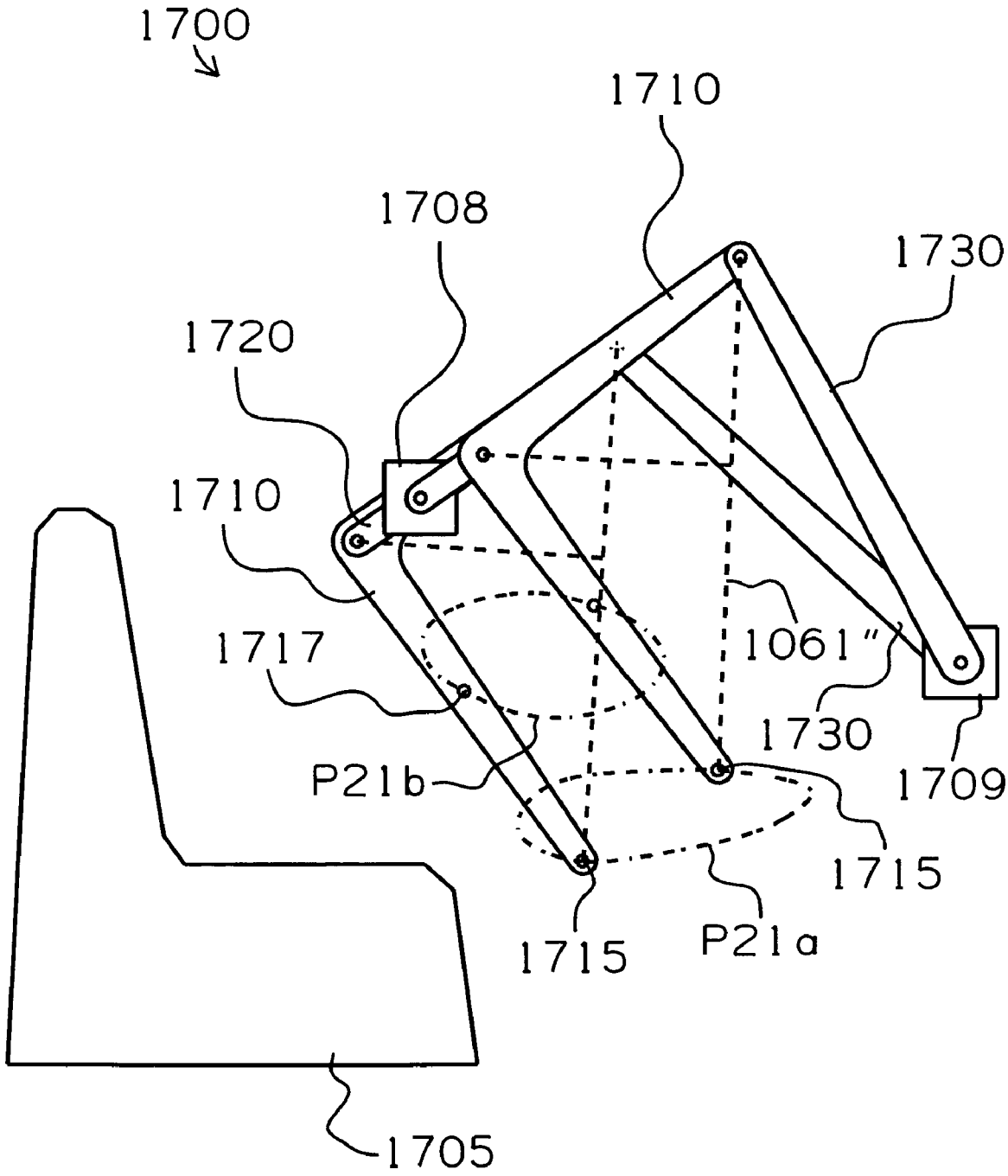
FIG. 21 is a side view of another exercise apparatus constructed according to the principles of the present invention.

FIG. 21 shows another "sit down" exercise apparatus 1700 which includes a chair 1705 and a linkage assembly similar to that shown in FIG. 13*b*. Connector links 1710 have first portions connected to respective crank arms 1720; second portions connected to respective rocker links 1730; and third portions connected to respective foot supports at connection points 1715. A radially inward end of each crank 1720 is rotatably connected to a first frame member 1708, and a radially inward end of the rocker link 1730 is rotatably connected to a second frame member 1709. The resulting linkage assembly links rotation of the crank arms 1720 relative to the frame to pivoting of the rocker links 1730 and movement of the foot support connection points 1715 through generally elliptical paths of motion designated as P21*a*. The dashed lines 1061" suggest an alternative configuration for the connector links 1710.

Optional fourth connection points 1717 are provided on the connector links 1710 to receive handles and direct them through generally elliptical paths of motion designated as P21*b*. In this regard, the present invention may be seen to provide elliptical motion exercise for both the lower body and the upper body. In a preferred mode of operation, a person pulls against a handle when it occupies a relatively low position along the path P21*b*, and a person pushes against a foot support when it occupies a relatively high position along the path P21*a*. In other words, the user may pull with his left hand while pushing with his right leg and then pull with his right hand while pushing with his left leg.

Handles may be connected to connector links on some of the other embodiments, as well. For example, an apparatus with a single, relatively larger foot support (like that shown in FIG. 18) could facilitate exercise wherein a person pulls with both arms during a "lower" one-half of an exercise cycle and subsequently pushes with both legs during an "upper" one-half of the exercise cycle. Contrary to conventional rowing exercisers, such an apparatus exercises the upper body and lower body at different times in the exercise cycle (approximately 180 degrees out of phase) and maintains relatively continuous motion.

Figure 22:
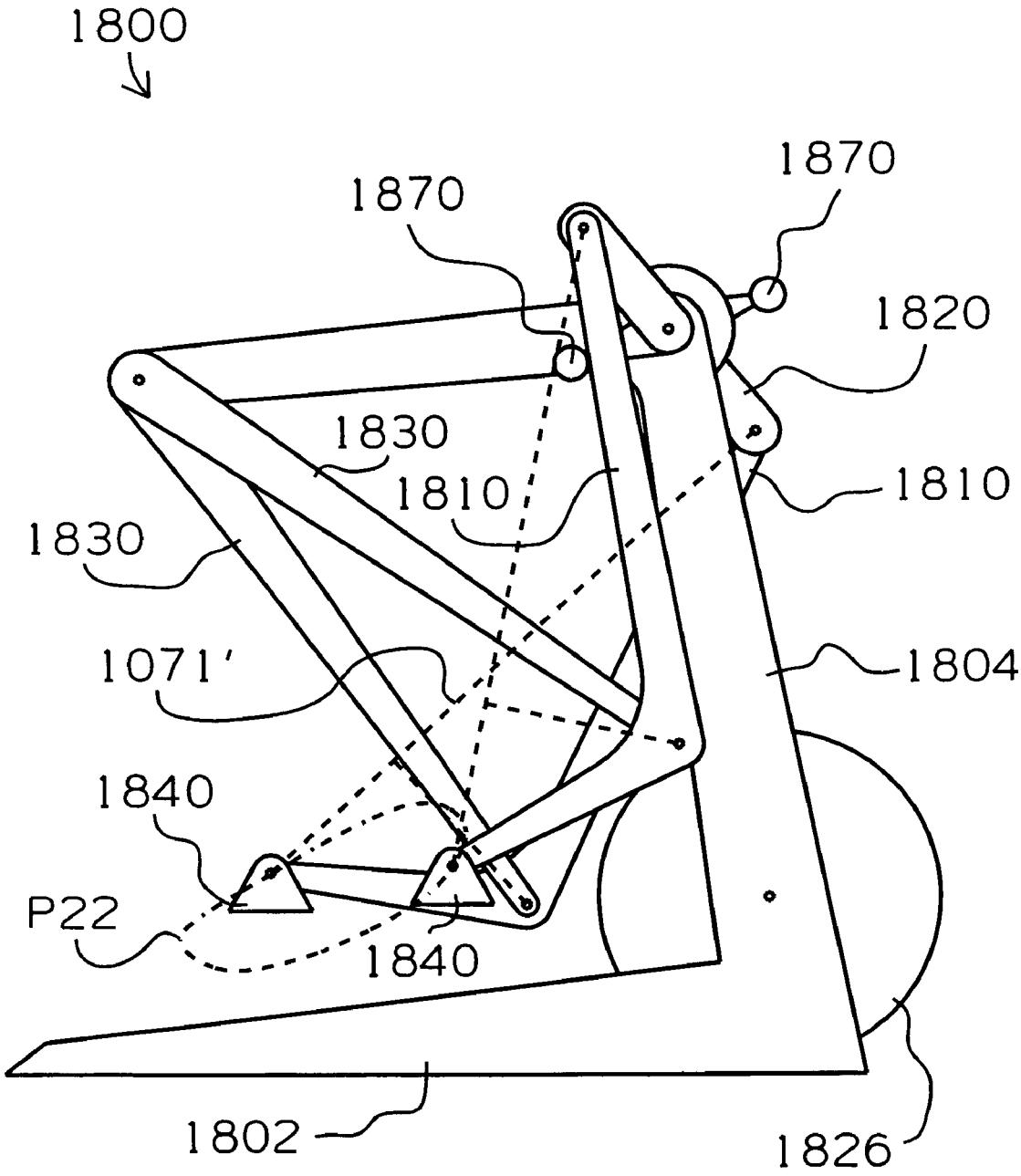
FIG. 22 is a side view of another exercise apparatus constructed according to the principles of the present invention.

FIG. 22 shows a "stand up" exercise apparatus 1800 having a linkage assembly similar to that shown in FIG. 13*c*. The apparatus frame includes a base 1802 designed to rest upon a floor surface, and a stanchion 1804 extending upward from the base 1802.

On each side of the apparatus 1800, a connector link 1810 has a first portion connected to a respective crank arm 1820; a second portion connected to a respective rocker link 1830; and a third portion connected to a respective foot support 1840. Rotation of the crank arms 1820 relative to the frame is linked to pivoting of the rocker links 1830 and movement of the foot supports 1840 through generally elliptical paths of motion designated as P22. The dashed lines 1071' suggest an alternative configuration for the connector links 1810. The foot supports 1840 are suspended from the connector links 1810 and therefore "self-leveling" relative to the underlying ground surface.

Optional handles 1870 are rotatably mounted on the stanchion 1804 within reach of a person standing on the foot supports 1840. Rotation of the handles 1870 is linked to rotation of the cranks 1820 to facilitate contemporaneous exercise of the lower body and the upper body. An optional "stepped up" flywheel 1826 may be operatively connected to the cranks 1820 to add inertia to the linkage assembly.

Figure 23:
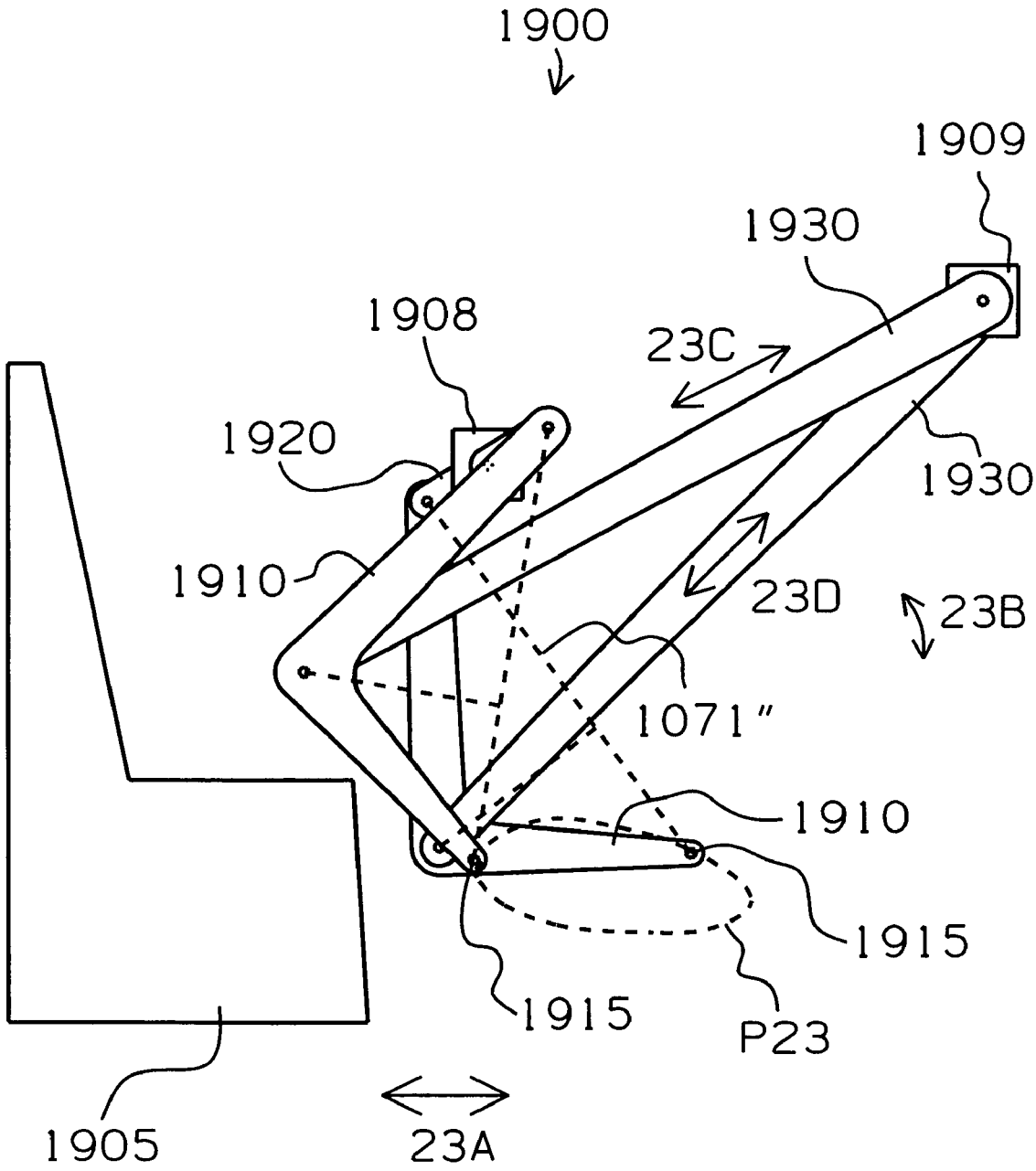
FIG. 23 is a side view of another exercise apparatus constructed according to the principles of the present invention.

FIG. 23 shows another "sit down" exercise apparatus 1900 which includes a chair 1905 and a linkage assembly similar to that shown in FIG. 13*c*. Connector links 1910 have first portions connected to respective crank arms 1920; second portions connected to respective rocker links 1930; and third portions connected to respective foot supports at connection points 1915. A radially inward end of each crank 1920 is rotatably connected to a first frame member 1908, and a radially inward end of the rocker link 1930 is rotatably connected to a second frame member 1909. The resulting linkage assembly links rotation of the crank arms 1920 relative to the frame to pivoting of the rocker links 1930 and movement of the foot support connection points 1915 through generally elliptical paths of motion designated as P23. The dashed lines 1071" suggest an alternative configuration for the connector links 1910.

Optional handles may be connected to the crank arms 1920 (at the first connection points on the connector links 1910 or at discrete locations) to facilitate upper body exercise, as well as lower body exercise. Adjustments may be made to the apparatus 1900 (or another embodiment of the present invention) to optimize motion of the handles and/or the foot supports relative to a seated user. For example, the distance between the user and the linkage assembly may be adjusted by moving the seat 1905 relative to the linkage assembly (as suggested by the arrows 23A); the orientation of the elliptical paths P23 relative to the user may be adjusted by rotating the frame relative to the seat 1905 (as suggested by the arrows 23B); and/or the configuration of the elliptical paths P23 may be adjusted by changing the distance between the frame members 1908 and 1909 (as suggested by the arrows 23C), and/or by changing the length of one or more of the linkage assembly components (as suggested by the arrows 23D). A common way to make adjustments of this sort involves provision of at least one hole in a member on one side of the adjustment; provision of multiple holes in a member on the other side of the adjustment; and insertion a fastener through an aligned pair of holes. For example, each rocker link 1930 might include first and second telescoping members which are selectively fixed relative to one another by means of a detent pin.

Additional methods may also be described with reference to the foregoing embodiment 1900. For example, the present invention may be seen to provide various methods of exercise, comprising the steps of interconnecting a crank between a first frame member and a first connection point on a rigid link; constraining a second connection point on the rigid link to move in reciprocal fashion relative to a second frame member; connecting a foot support to a third connection point on the rigid link; and moving the resulting linkage assembly relative to a seat, rotating the frame members relative to a seated user, changing the distance between the frame members, and/or changing the length of one or more linkage assembly components.

Figure 24:
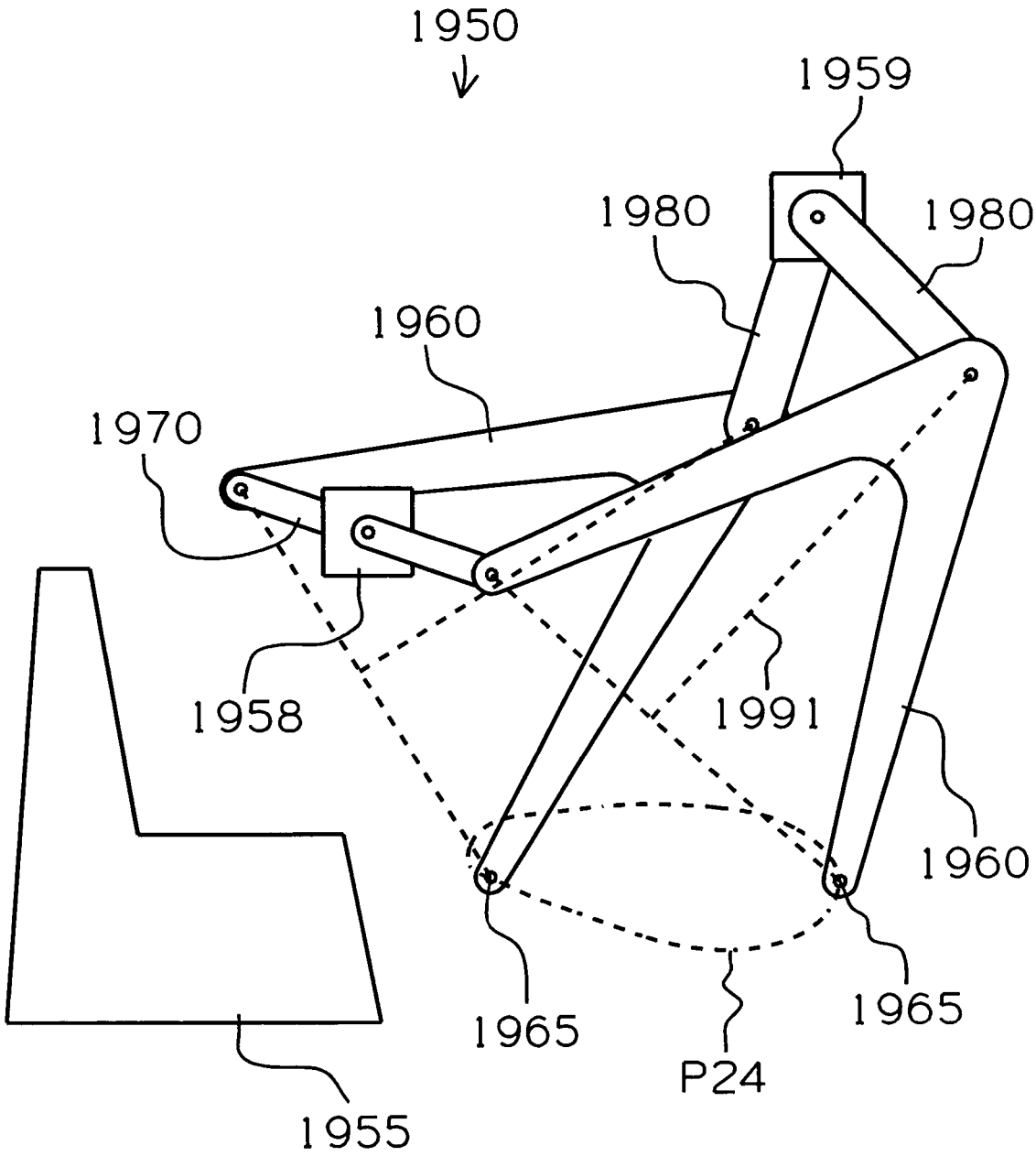
FIG. 24 is a side view of another exercise apparatus constructed according to the principles of the present invention.

FIG. 24 shows another "sit down" exercise apparatus 1950 which includes a chair 1955 and a connector link 1960 having connection points similar to those on the assembly shown in FIG. 13*c* but a dashed line representation 1991 more comparable to the assembly shown in FIG. 13*a*. In any event, connector links 1960 have first portions connected to respective crank arms 1970; second portions connected to respective rocker links 1980; and third portions connected to respective foot supports at connection points 1965. A radially inward end of each crank 1970 is rotatably connected to a first frame member 1958, and a radially inward end of the rocker link 1980 is rotatably connected to a second frame member 1959. The resulting linkage assembly links rotation of the crank arms 1970 relative to the frame to pivoting of the rocker links 1980 and movement of the foot support connection points 1965 through generally elliptical paths of motion designated as P24. Like on previous embodiments, handles may be connected to the crank arms 1970, and/or adjustments may be made to the linkage assembly and/or its relationship to the chair 1955.

Figure 25:
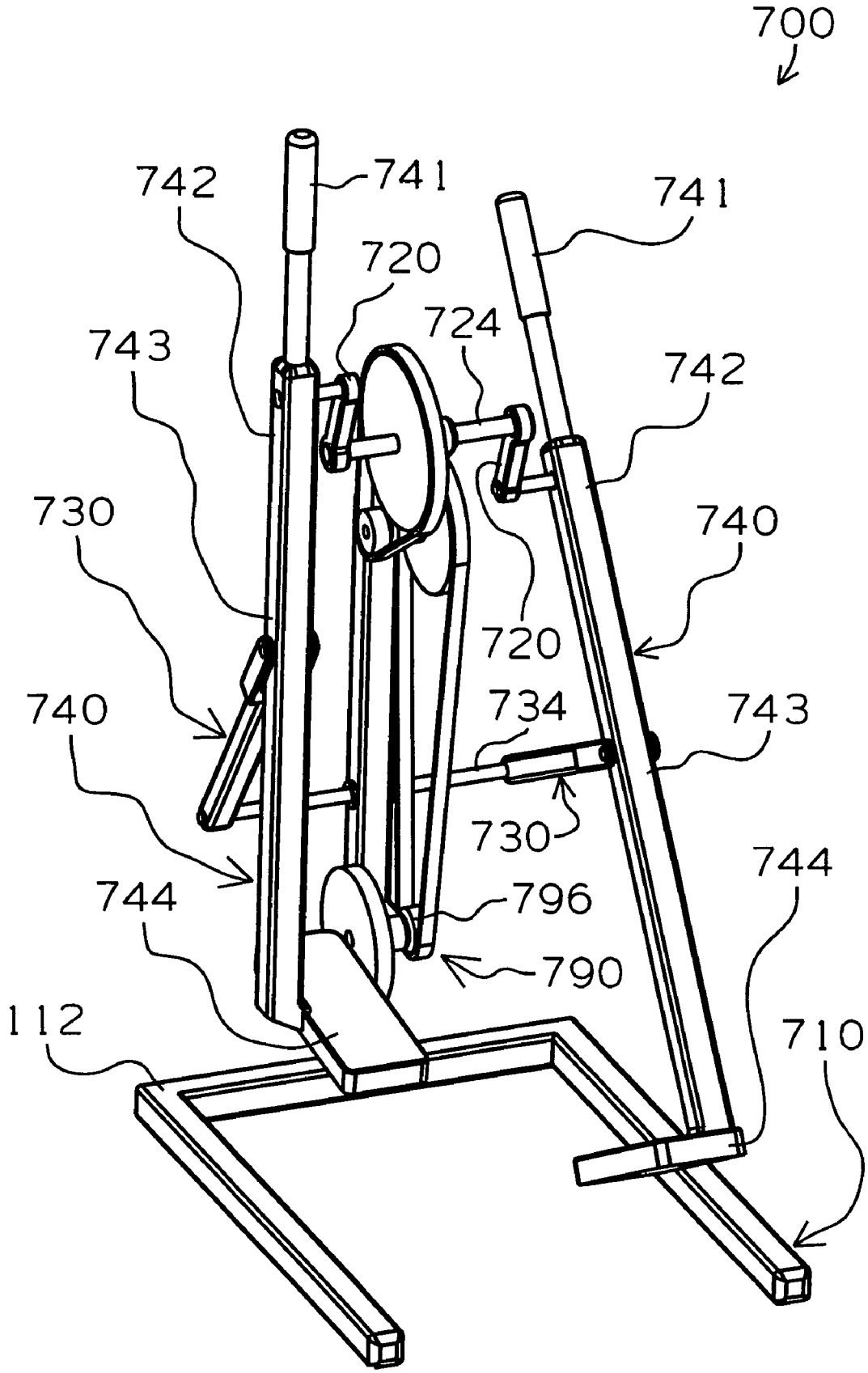
FIG. 25 is a perspective view of another exercise apparatus constructed according to the principles of the present invention.
Figure 26:
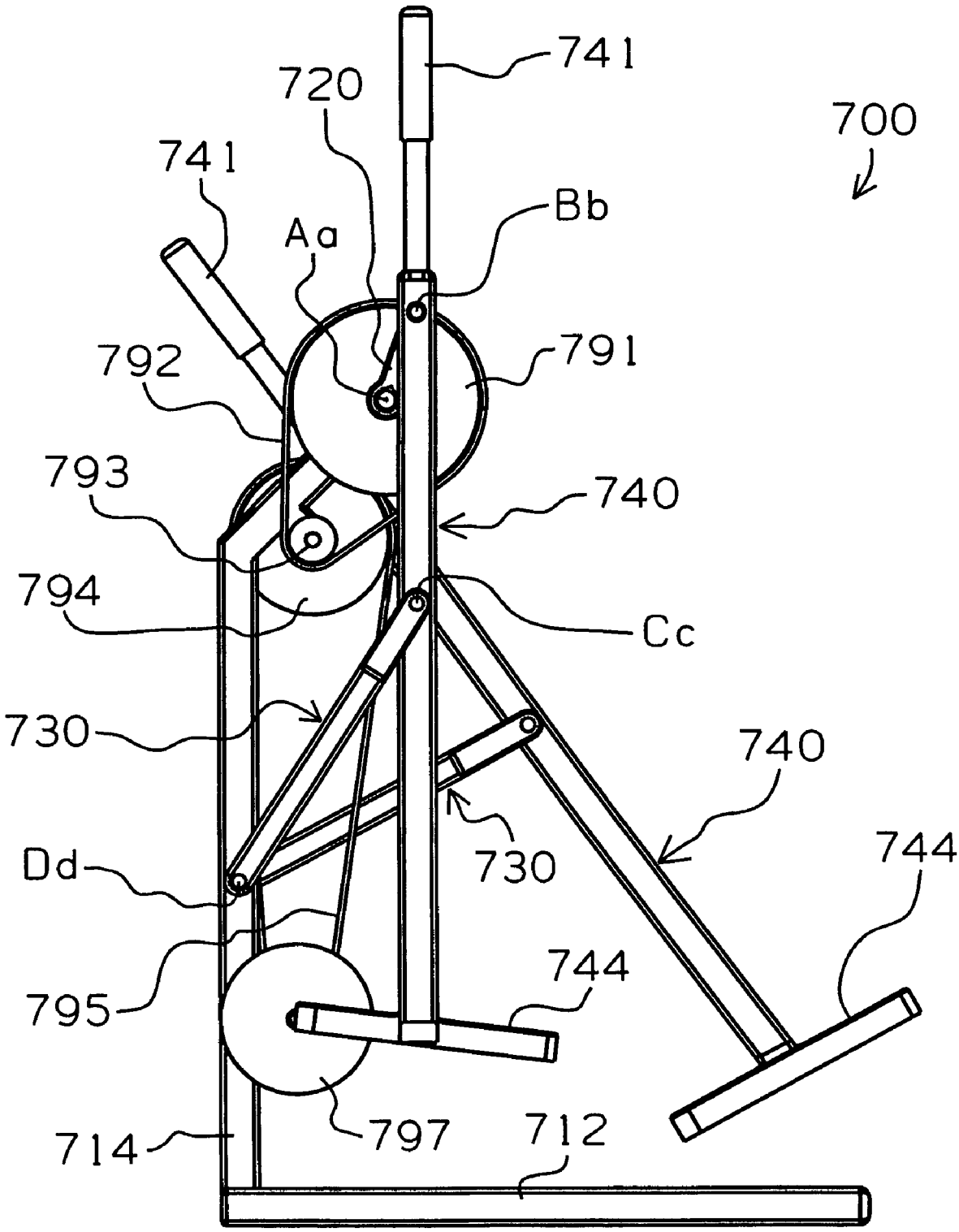
FIG. 26 is a side view of the apparatus of FIG. 25.

Yet another exercise apparatus constructed according to the principles of the present invention is designated as 700 in FIGS. 25-26. The exercise apparatus 700 generally includes a linkage assembly which moves relative to the frame 710 in a manner that links rotation of crank(s) 720 to generally elliptical motion of force receiving member(s) 741 or 744. The frame 710 includes a generally U-shaped base 712 which rests upon a floor surface. A forward stanchion 714 extends upward from the base 712 and supports the crank(s) 720 and the linkage assembly.

The apparatus 700 is generally symmetrical about a vertical plane extending lengthwise through the frame 710, the only exceptions being an inertia altering system 790 and the relative orientation of certain parts of the linkage assembly on opposite sides of the plane of symmetry. In the embodiment 700, the "right-hand" components are one hundred and eighty degrees out of phase relative to the "left-hand" components. However, like reference numerals are used to designate both the "right-hand" and "left-hand" parts on the apparatus 700, and when reference is made to one or more parts on only one side of the apparatus, it is to be understood that corresponding part(s) are disposed on the opposite side of the apparatus 700. Those skilled in the art will also recognize that the portions of the frame 710 which are intersected by the plane of symmetry, as well as the components of the inertia system 790, exist individually and thus, do not have any "opposite side" counterparts.

On each side of the apparatus 700, a crank 720 is rotatably mounted to the stanchion 714 via a common shaft 724. In particular, each crank 720 has a first end which is rigidly secured to the crank shaft 724, so that each crank 720 rotates together with the crank shaft 724 relative to the frame 710. Each crank 720 has a second, opposite end which rotates about an axis Aa (shown in FIG. 26) and thereby defines a crank radius.

The inertia altering system 790 includes a relatively large diameter pulley 791 which is rigidly secured to the crank shaft 724 and rotatable about the axis Aa. A closed loop or belt 792 connects the large pulley 791 to a relatively small diameter pulley 793 which rotates (together with another large diameter pulley 794 and a discrete shaft) relative to the frame 710. A second, longer belt 795 connects the second large pulley 794 to a second small diameter pulley 796 which rotates (together with a flywheel 797 and another discrete shaft) relative to the frame 710. The result is a "stepped-up" flywheel 797 which rotates faster than the crank shaft 724 and the cranks 720. Other inertia altering devices, such as a frictional drag strap, may be added to or substituted for the flywheel arrangement to provide momentum and/or resistance to exercise movement.

The opposite end of each crank 720 is rotatably connected to an intermediate portion 742 of a respective main link 740. As a result of this arrangement, the first link 740 is rotatable about an axis Bb (shown in FIG. 26) relative to the crank 720. The axis Bb is disposed at a fixed distance or crank radius from the axis Aa and is rotatable about the axis Aa. In other words, the crank 720 may be described as a means for constraining a portion 742 of the main link 740 to rotate relative to the frame 710.

Each first link 740 has a relatively lower intermediate portion 743 which is rotatably connected to an end of a respective rocker link 730. An opposite end of each rocker link 730 is rotatably connected to the stanchion 714 at axis Dd (shown in FIG. 26). As a result of this arrangement, the first link 740 is rotatable about an axis Cc (shown in FIG. 26) relative to the rocker link 730. The axis Cc is disposed at a fixed distance from the axis Dd and is rotatable about the axis Dd. In other words, the rocker link 730 may be described as a means for constraining a portion 743 of the main link 740 to move in reciprocal fashion relative to the frame 710.

Each first link 740 has an upper distal end 741 which is sized and configured for grasping, and a lower distal end 744 which is sized and configured to support a discrete foot of a standing person. Both ends 741 and 744 are constrained to move through a generally elliptical path of motion in response to rotation of the cranks 720 and pivoting of the rocker links 730.

Those skilled in the art will recognize additional embodiments, modifications, and/or applications involving the foregoing embodiment 700. For example, the exercise motion could be adjusted by providing telescoping cranks and/or rocker links with holes that align to receive fasteners in more than one location, and/or by adjusting the location of the rocker axis relative to the frame. Moreover, the size, configuration, and/or arrangement of the components of the foregoing embodiment 700 may be modified as a matter of design choice.

Figure 27:
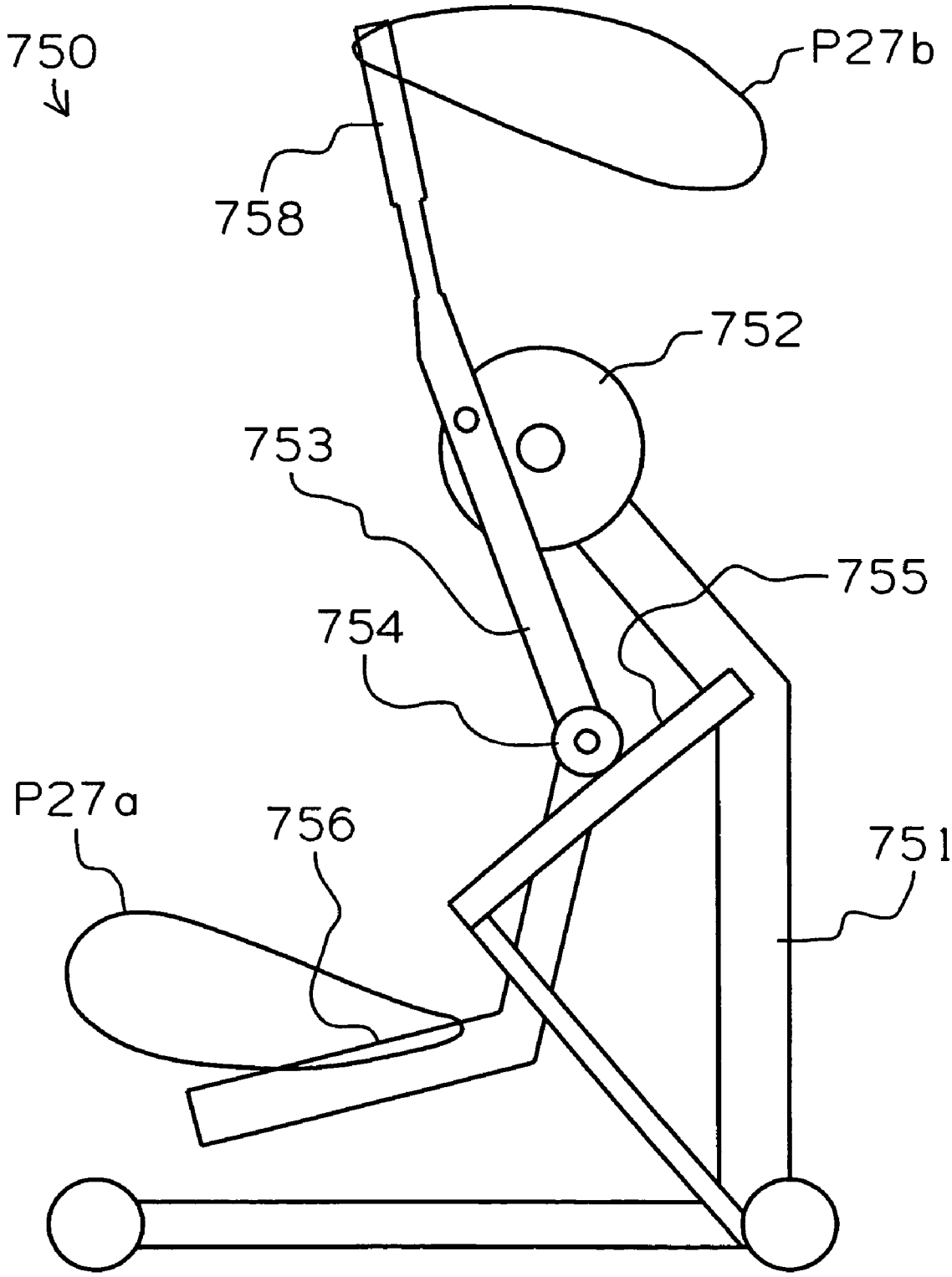
FIG. 27 is a side view of an exercise apparatus similar in some respects to the apparatus of FIGS. 25-26.

A variation of the foregoing embodiment 700 is designated as 750 in FIG. 27. The exercise apparatus 750 uses a roller arrangement in lieu of a rocker link to constrain a portion of each connector link to move in reciprocal fashion relative to a frame.

The exercise apparatus 750 may be generally described in terms a frame 751 designed to occupy a fixed position relative to a floor surface; left and right cranks 752 rotatably mounted on the frame 751; a ramp 755 mounted on the frame 751; and left and right connector links 753 having upper distal ends 758 which are sized and configured for grasping, relatively higher intermediate portions which are rotatably connected to radially offset portions of respective cranks 752, relatively lower intermediate portions which support respective rollers 754 that bear against the ramp 755, and lower distal ends which are connected to respective foot supporting members 756. The resulting linkage assembly links rotation of the cranks 752 to generally elliptical movement of the foot supporting members 756 and the handles 758 through respective paths P27*a* and P27*b*. The ramp 755 may be modified to be selectively movable relative to the frame 751 in order to provide different paths of exercise motion.

Figure 28:
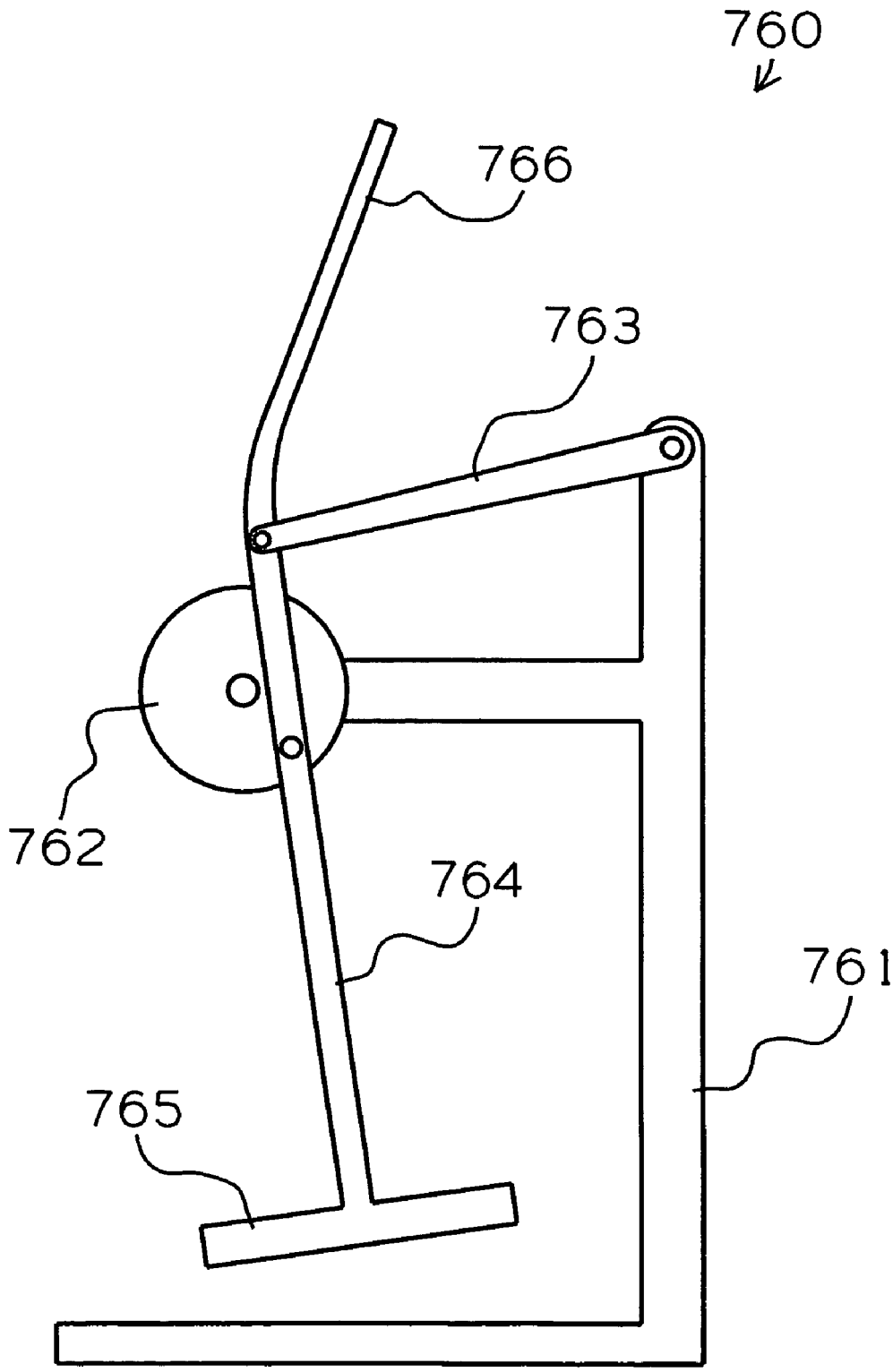
FIG. 28 is a side view of another exercise apparatus similar in some respects to the apparatus of FIGS. 25-26.

Another variation of the foregoing embodiment 700 is designated as 760 in FIG. 28. The exercise apparatus 760 essentially switches the relative locations of the crank joint and the rocker joint on each connector link.

The exercise apparatus 760 may be generally described in terms a frame 761 designed to rest upon a floor surface; left and right cranks 762 rotatably mounted on the frame 761; left and right rocker links 763 rotatably connected to the frame 761; and left and right connector links 764 having lower distal end which are connected to respective foot supporting members 765, relatively lower intermediate portions which are rotatably connected to radially offset portions of respective cranks 762, relatively higher intermediate portions which are rotatably connected to distal ends of respective rocker links 763, and upper distal ends 766 which are sized and configured for grasping. The resulting linkage assembly links rotation of the cranks 762 to pivoting of the rocker links 763 and generally elliptical movement of the foot supporting members 765 and the handles 766.

Figure 29:
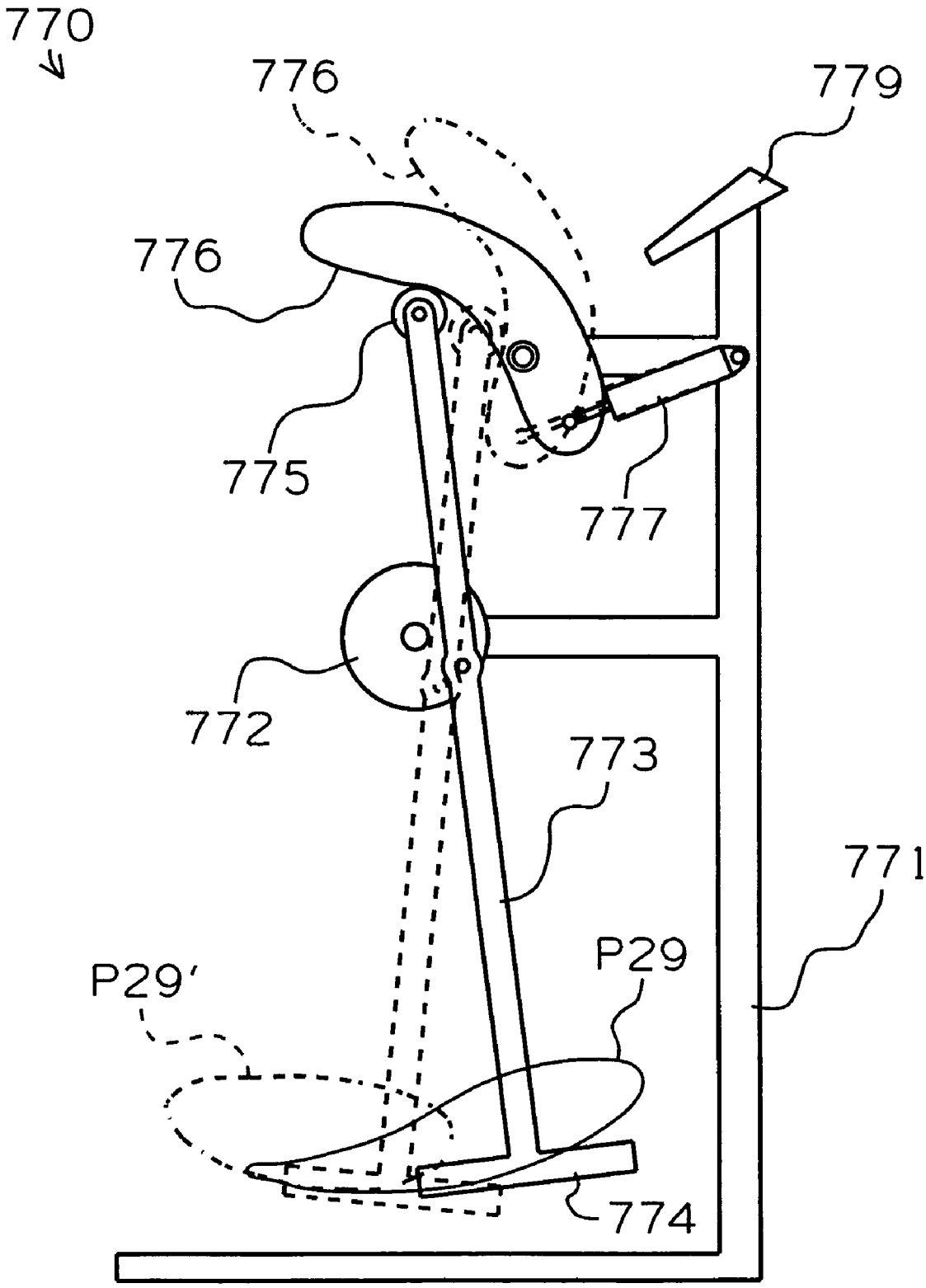
FIG. 29 is a side view of an exercise apparatus similar in some respects to the apparatus of FIG. 27 and in some respects to the apparatus of FIG. 28.

FIG. 29 shows an exercise apparatus 770 which may be described as a variation of the previous embodiment 760 to the extent that it essentially uses a roller arrangement in lieu of a rocker link to constrain a portion of each connector link to move in reciprocal fashion relative to a frame, and/or as a variation of the foregoing embodiment 750 to the extent that it essentially switches the relative locations of the crank joint and the roller on each connector link.

The exercise apparatus 770 may be generally described in terms a frame 771 designed to occupy a fixed position relative to a floor surface; left and right cranks 772 rotatably mounted on the frame 771; at least one bearing surface 776 mounted on the frame 771; and left and right connector links 773 having lower distal end which are connected to respective foot supporting members 774, intermediate portions which are rotatably connected to radially offset portions of respective cranks 772, and upper distal ends which are rotatably connected to respective rollers 775 that bear against the bearing surface 776. The resulting linkage assembly links rotation of the cranks 772 to generally elliptical movement of the foot supporting members 774.

The bearing surface 776 has a first support portion which is rotatably connected to the frame 771, and a second support portion which is rotatably connected to an end of an actuator 777. An opposite end of the actuator 777 is rotatably connected to the frame 771. A display 779 provides information to a user of the apparatus 770 and sends control signals to the actuator 777 to adjust same. When the bearing surface 776 occupies the position shown in solid lines in FIG. 29, the foot supporting members 774 move through the path designated as P29. When the bearing surface 776 occupies the position shown in dashed lines, the foot supporting members 774 move through the path designated as P29'. The bearing surface 776 could be replaced by a more complicated structural member disposed about the roller and configured to constrain same to travel in either true reciprocating fashion or along a closed curve path.

Figure 30:
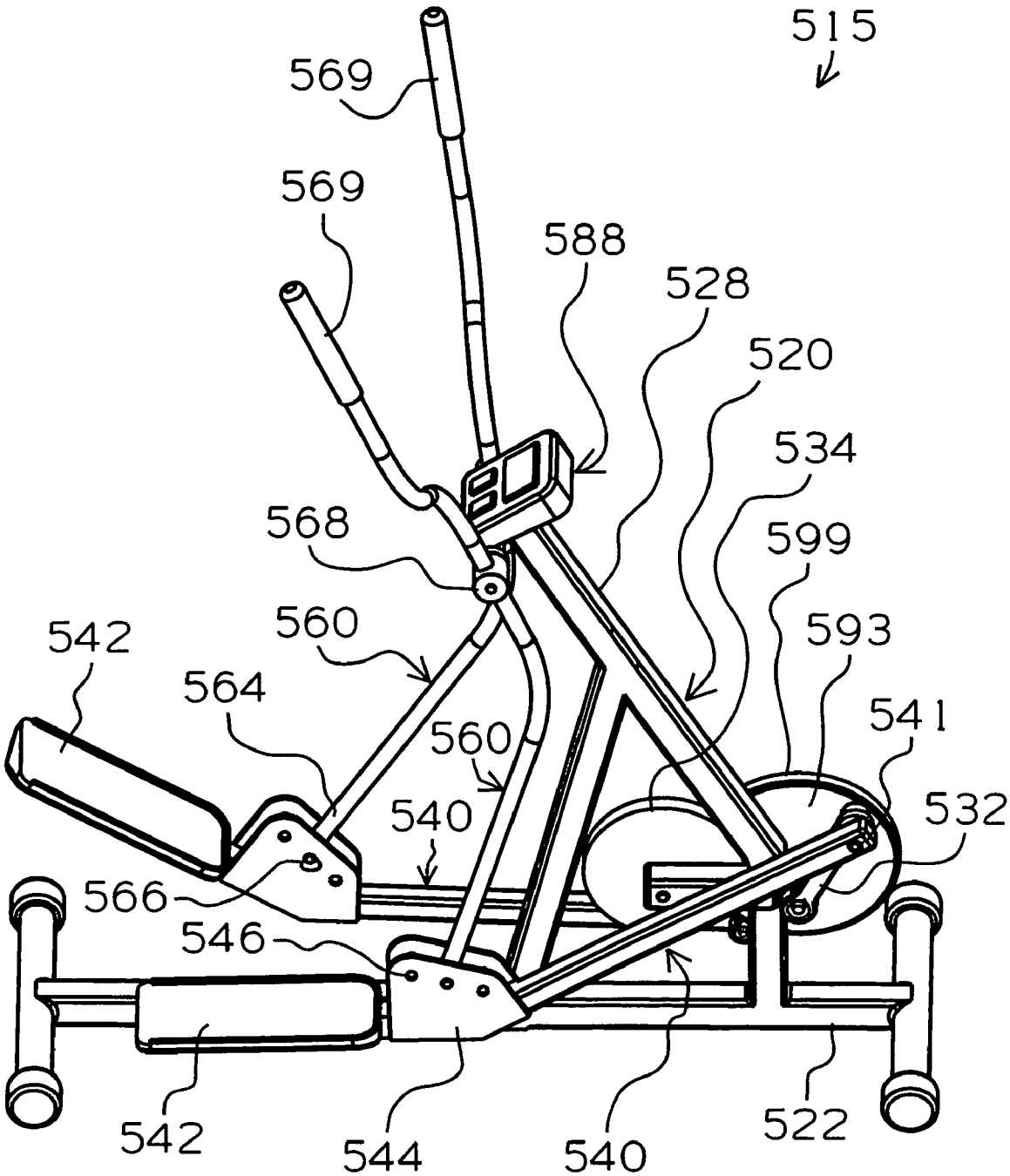
FIG. 30 is a perspective view of another exercise apparatus constructed according to the principles of the present invention.
Figure 31:
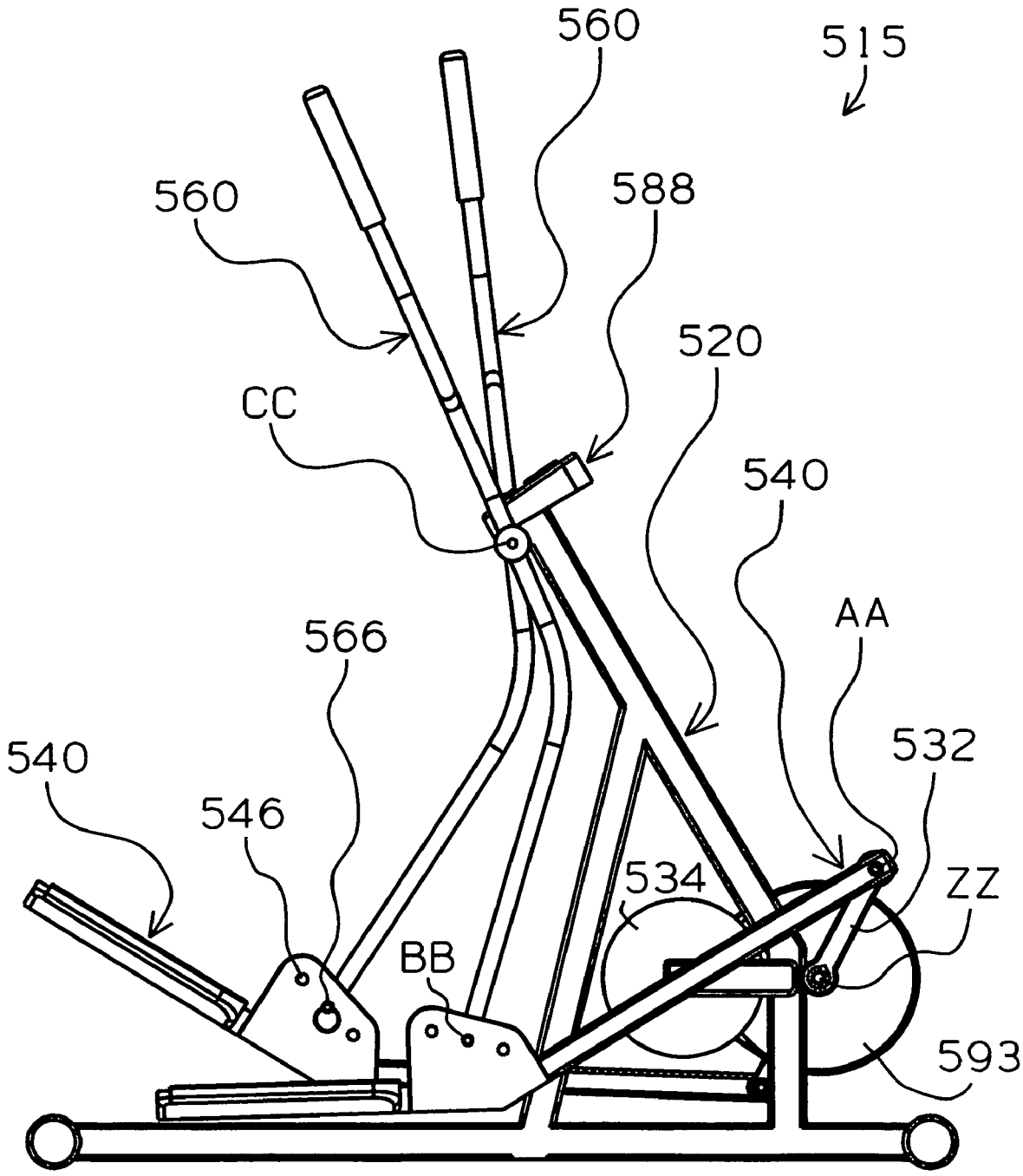
FIG. 31 is a side view of the apparatus of FIG. 30.

Still another exercise apparatus constructed according to the principles of the present invention is designated as 515 in FIGS. 30-31. The apparatus 515 generally includes a frame 520 and a linkage assembly movably mounted on the frame 520. Generally speaking, the linkage assembly moves relative to the frame 520 in a manner that links rotation of cranks 532 to generally elliptical motion of foot supporting, force receiving members 542.

The frame 520 includes a base 522 and a forward stanchion 528. The base 522 may be described as generally I-shaped and is designed to rest upon a horizontal floor surface. The apparatus 515 is generally symmetrical about a vertical plane extending lengthwise through the base 522 (perpendicular to the transverse members at each end thereof), the only exceptions being components of a resistance assembly and the relative orientation of certain parts of the linkage assembly on opposite sides of the plane of symmetry. In the embodiment 515, the "right-hand" components are one hundred and eighty degrees out of phase relative to the "left-hand" components. However, like reference numerals are used to designate both the "right-hand" and "left-hand" parts on the apparatus 515, and when reference is made to one or more parts on only one side of the apparatus, it is to be understood that corresponding part(s) are disposed on the opposite side of the apparatus 515. Those skilled in the art will also recognize that the portions of the frame 515 which are intersected by the plane of symmetry exist individually and thus, do not have any "opposite side" counterparts.

The forward stanchion 528 may be described as an inverted y-shape which extends upward and rearward from the base 522 and supports a user accessible display 588. The display 588 is suitable for providing exercise information and/or facilitating adjustments to exercise constraints.

Crank arms 532 are rotatably mounted to the forward stanchion 528 by means known in the art and rotate about a crank axis ZZ. A flywheel 534 is also rotatably mounted to the forward stanchion 528 by means known in the art and rotates about a discrete flywheel axis. The crank arms 532 are connected to the flywheel 534 by means known in the art to provide a "stepped up" flywheel arrangement. In particular, a belt 599 is formed into a closed loop about a relatively large diameter pulley 593 secured to the crank shaft and a relative small diameter pulley secured to the flywheel shaft. As a result of this arrangement, the members 532 and 534 rotate together, but the latter rotates faster than the former.

Those skilled in the art will recognize that other known types of inertia altering mechanisms may be added to or substituted for the stepped up flywheel arrangement. For example, a drag strap or brake assembly may be provided to selectively impede rotation of the flywheel 534 and/or the crank 532. Moreover, the apparatus 515 could be built so that friction forces acting on the joints provide sufficient resistance to exercise movement. Those skilled in the art will also recognize that a housing or shroud may be disposed over the stepped-up crank and flywheel assembly.

First rigid links 540 are movably interconnected between the frame 520 and respective cranks 532. In particular, each link 540 has a first end or distal portion 541 which is rotatably connected to a respective crank arm 532. Each link 540 and crank arm 532 combination defines a rotational axis AA which is disposed a radial distance away from the crank axis ZZ.

Each first link 540 has an intermediate portion which is rotatably connected to a lower end 564 of a respective rocker link 560. A bracket 544 is rigidly secured to the intermediate portion of each first link 540, and several holes 546 are formed through the bracket 544. A detent pin 566 or other suitable fastener is inserted through a particular hole 546 and through an aligned bearing assembly on the lower end 564 of the rocker link 560 to rotatably interconnect the two links 560 and 540. In other words, each first link 540 and rocker link 560 combination defines a rotational axis BB which is adjustable relative to the former.

In an alternative embodiment, the intermediate portion of each link 540 is rotatably connected to a respective bearing member that rocks back and forth along an underlying bearing surface. In another alternative embodiment, the intermediate portion of each link 540 is rotatably connected to a respective bearing member that travels along a rail on the frame. In each case, the rotational axes defined between the links 540 and the bearing members travel in a straight line, as opposed to a relatively large radius arc on the depicted embodiment 515.

Each first link 540 has an opposite, second end or distal portion which is sized and configured to support a discrete foot of a standing person. In particular, a foot platform 542 is rigidly secured to the second end of each first link 540. The bracket 544 is disposed proximate the foot platform 542 and conceals a bend in the first link 540 which places the two distal portions at an obtuse angle relative to one another.

Each rocker link 560 has an intermediate portion 568 which is rotatably connected to the forward stanchion 528. As a result, the rocker links 560 rotate about an axis CC relative to the frame 520. Each rocker link 560 has an opposite, distal portion or upper end 569 which is sized and configured for grasping by a person standing on the foot platforms 542.

Movement of either foot platform 542 causes rotation of the cranks 532 and reciprocal movement of the rockers 560. The arrangement of parts is such that the foot platforms 542 are constrained to travel through substantially elliptical paths. In other words, the links 540 and 560 may be described as a linking means, movably interconnected between the frame 520 and the cranks 532, for linking rotation of the cranks 532 to elliptical movement of the foot supports 542 and/or for linking rotation of the cranks 532 to reciprocal movement of the handles 569.

An optional feature of the embodiment 515 is that the orientation of the path traveled by the foot supporting members 542 may be adjusted by moving the position of the axis BB relative to the first links 540. In particular, a plurality of holes 546 are formed through adjacent flanges on each first link 540, and a lower end of each rocker link 560 is disposed between the flanges. A bearing on the rocker end 564 is aligned with any of the holes 546, and a bolt or other fastener 566 is inserted through the aligned holes to selectively interconnect the two links 540 and 560. In the alternative, the two links 540 and 560 may simply be interconnected by a fastener which is not selectively removable.

Another optional adjustment feature may be provided by selectively moving the position of the axis CC relative to the crank axis ZZ. Such an adjustment may be accomplished, for example, by making an upper portion of the forward stanchion 528 movable relative to a lower portion and using a detent pin to secure the upper portion in a plurality of positions.

A working embodiment of the exercise apparatus 515 provided acceptable foot motion with the axis ZZ and the axis AA spaced approximately seven inches apart, the axis AA and the axis BB spaced approximately twenty-three inches apart, the axis BB and the axis CC spaced approximately twenty-eight inches apart, and the axis CC and the axis ZZ spaced approximately thirty inches apart. The thirty degree bend in each first link 540 provides sufficient clearance for operation relative to an underlying support surface, and the forty degree bend in each rocker link 560 provides sufficient clearance for a person's knees.

Figure 32:
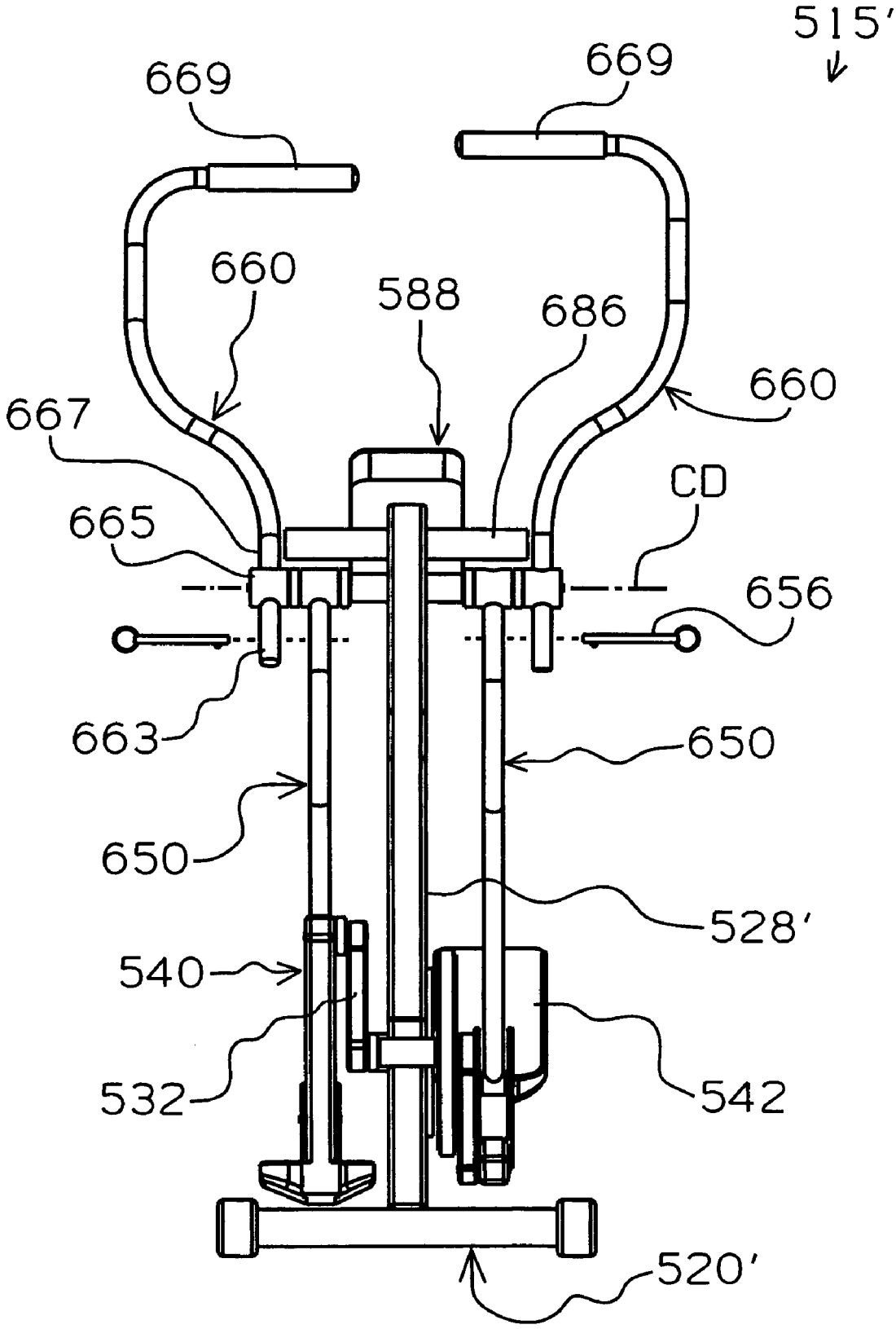
FIG. 32 is a front view of an exercise apparatus similar to that shown in FIGS. 30-31 but provided with an alternative arm exercise assembly.

An alternative embodiment arm exercise assembly is shown in FIG. 32 on an exercise apparatus 515' which is similar in all other respects to the previous embodiment 515 (as suggested by the common reference numerals). A shaft is rigidly secured to the forward stanchion 528' and protrudes beyond opposite sides thereof. Rocker links 650 have lower ends rotatably connected to respective first links 540, and upper ends rotatably mounted on opposite ends of the protruding shaft. The rocker links 650 are rotatable relative to the frame 520' about an axis CD. Arm driven members 660 have upper ends 669 sized and configured for grasping, and lower portions 665 rotatably mounted on opposite sides of the protruding shaft. The arm driven members 660 rotate about the same axis CD relative to the frame 520'.

In the absence of any additional interconnections, the arm driven members 660 and the leg driven members 650 are free to rotate relative to the frame member 520' and one another. However, pins 656 may be inserted through aligned holes in respective arm driven members 660 and leg driven members 650 (indicated generally at 663), in order to constrain them to rotate together about the axis CD. In other words, the pins 656 provide a means for selectively linking the arm driven members 660 and the leg driven members 650 and/or cooperate with the leg driven members 650 to provide a means for selectively linking the arm driven members 660 and the foot supporting members 542. In the alternative, pins 656 may be inserted through aligned holes in respective arm driven members 660 and a frame member 686 (indicated generally at 667), in order to lock the former in place relative to the latter. In this configuration, the leg driven members 650 remain free to rotate relative to both the frame 520' and the arm driven members 660. In other words, the pins 656 also provide a means for selectively locking the arm driven members 660 to the frame 520'.

The apparatus 515' provides the options of stationary arm supports, independent arm and leg exercise members, and dependent arm and leg exercise members. A resistance device which, for example, may include friction pads and thrust bearings, may be provided to resist movement of the arm driven members 660 independent of the leg driven members 650.

Figure 33:
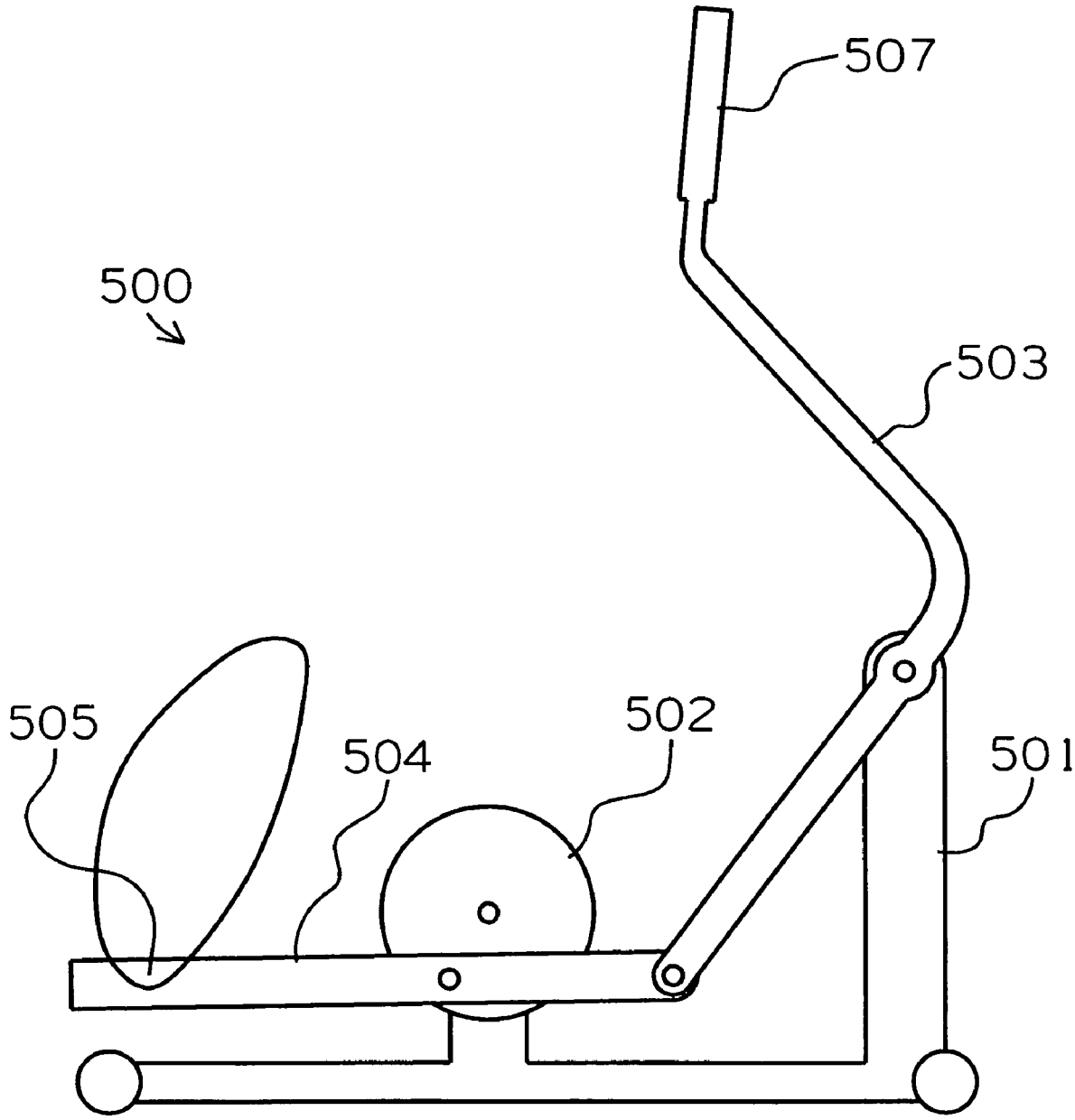
FIG. 33 is a side view of an exercise apparatus similar in many respects to the apparatus of FIGS. 30-31.

A variation of the foregoing embodiment 515 is designated as 500 in FIG. 33. The exercise apparatus 500 essentially switches the relative locations of the crank joint and the rocker joint on each of the foot supporting links, as compared to the previous embodiments 515 and 515'.

The exercise apparatus 500 may be generally described in terms a frame 501 designed to occupy a fixed position relative to a floor surface; left and right cranks 502 rotatably mounted on the frame 501; left and right rocker links 503 rotatably connected to the frame 501; and left and right connector links 504 having rearward distal ends which are connected to respective foot supporting members 505, intermediate portions which are rotatably connected to radially offset portions of respective cranks 502, and forward distal ends which are rotatably connected to lower distal ends of respective rocker links 503. Upper distal ends 507 of the rocker links 503 are sized and configured for grasping. The resulting linkage assembly links rotation of the cranks 502 to pivoting of the rocker links 503 and handles 507 and generally elliptical movement of the foot supporting members 505.

Figure 34:
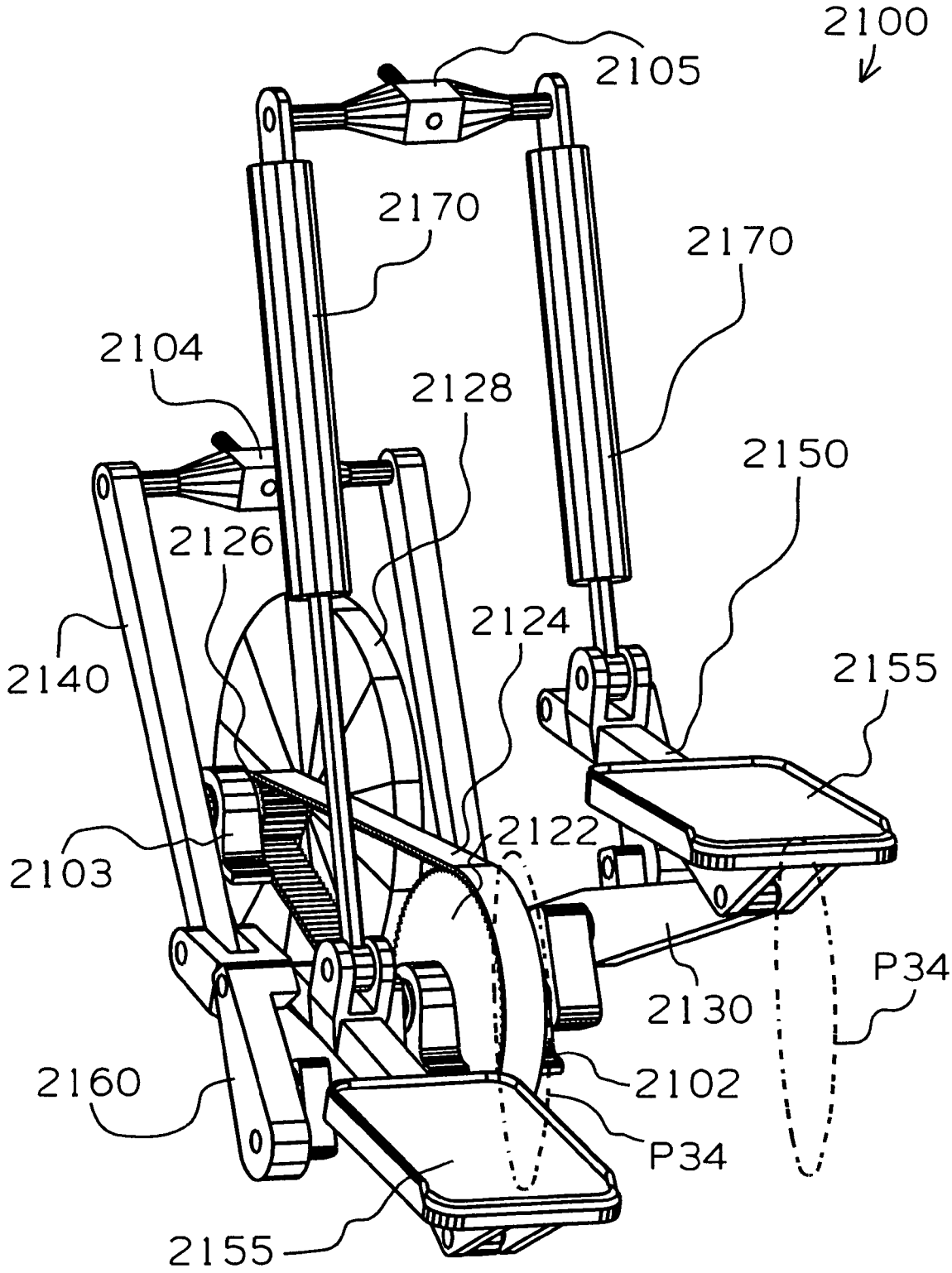
FIG. 34 is a perspective view of another exercise apparatus constructed according to the principles of the present invention.
Figure 35:
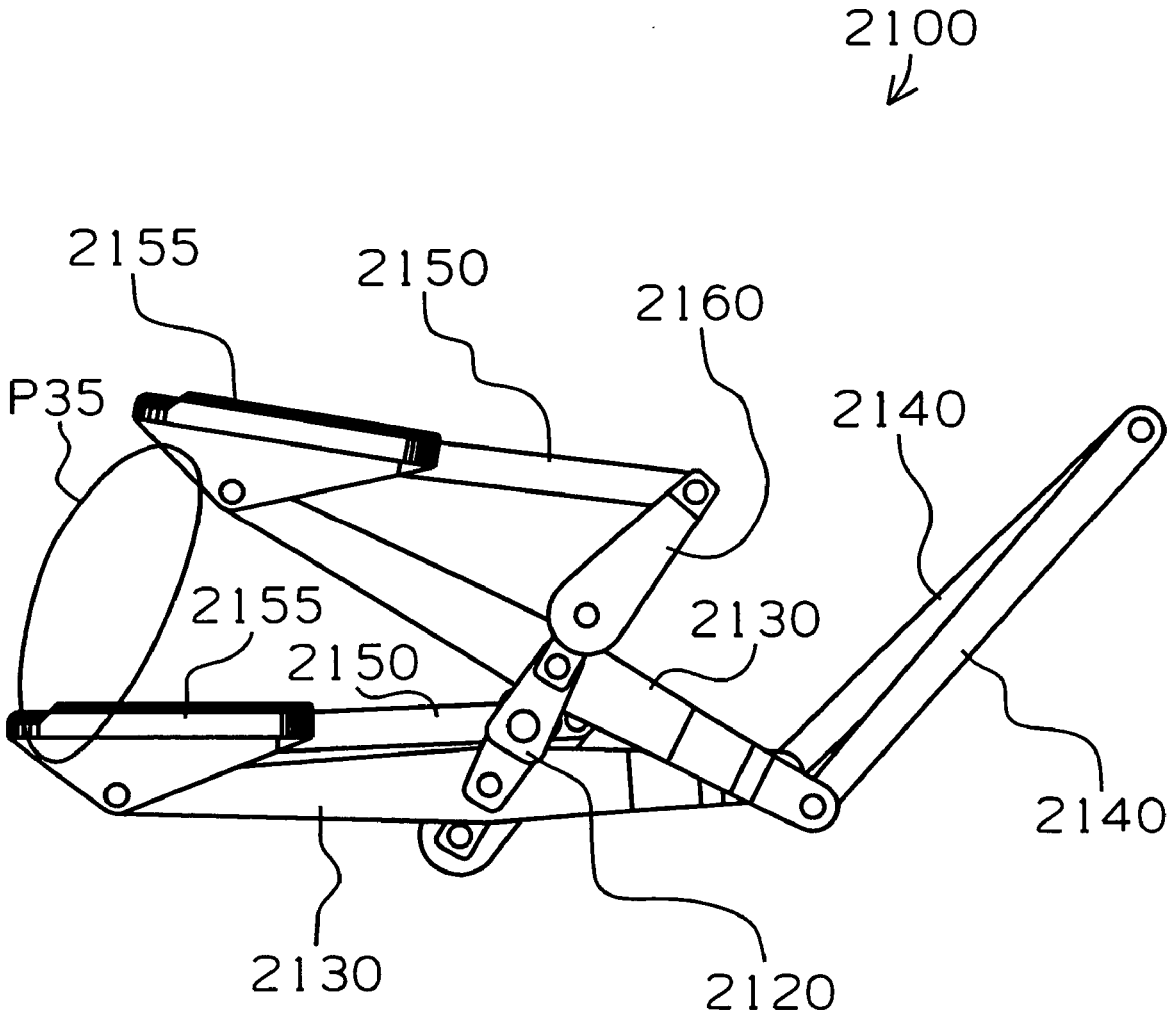
FIG. 35 is a side view of a portion of the apparatus of FIG. 34.

FIGS. 34-35 show a "stepping" type exerciser 2100 constructed according to the principles of the present invention. The apparatus 2100 includes left and right cranks 2120 rotatably connected to a frame by means of a crank shaft and bearing assemblies 2102. A larger diameter pulley 2122 is keyed to the crank shaft and rotates together with the cranks 2120 about a common crank axis. A belt 2124 connects the pulley 2122 to a smaller diameter pulley 2126 which is rigidly secured to a flywheel 2128. The pulley 2126 and the flywheel 2128 are rotatably connected to the frame by means of a flywheel shaft and bearing assemblies 2103. As a result, the pulley 2126 and the flywheel 2128 rotate at a relative faster rotational velocity than the cranks 2120 and pulley 2122. A conventional resistance device may be connected to the flywheel 2128 to resist rotation thereof.

Left and right connector links 2130 have intermediate portions which are rotatably connected to radially displaced portions of respective cranks 2120. The connector links 2130 have first ends which are rotatably connected to first ends of respective rocker links 2140, and second, opposite ends which are connected to respective foot supporting members 2150. The rocker links 2140 have second, opposite ends which are rotatably connected to the frame by means of frame member 2104.

One end of each foot supporting member 2150 is rotatably connected to a respective connector link 2130, and an opposite end of each foot supporting member 2150 is rotatably connected to an end of a respective floating crank 2160. An opposite end of each floating crank 2160 is rotatably connected to a distal end of a respective crank 2120. Left and right foot platforms 2155 are mounted on respective foot supporting members 2150 proximate their pivotal connections with respective connector links 2130. The floating cranks 2160 and pivoting foot supporting members 2150 cooperate to maintain the foot platforms 2155 in relatively favorable orientations throughout an exercise cycle.

Optional left and right dampers 2170 are rotatably interconnected between frame member 2105 and intermediate portions of respective foot supporting members 2150. The arrangement is such that the dampers 2170 tend to resist vertical movement of the foot platforms 2155 without unduly interfering with "over center" rotation of the cranks 2120.

Figure 36:
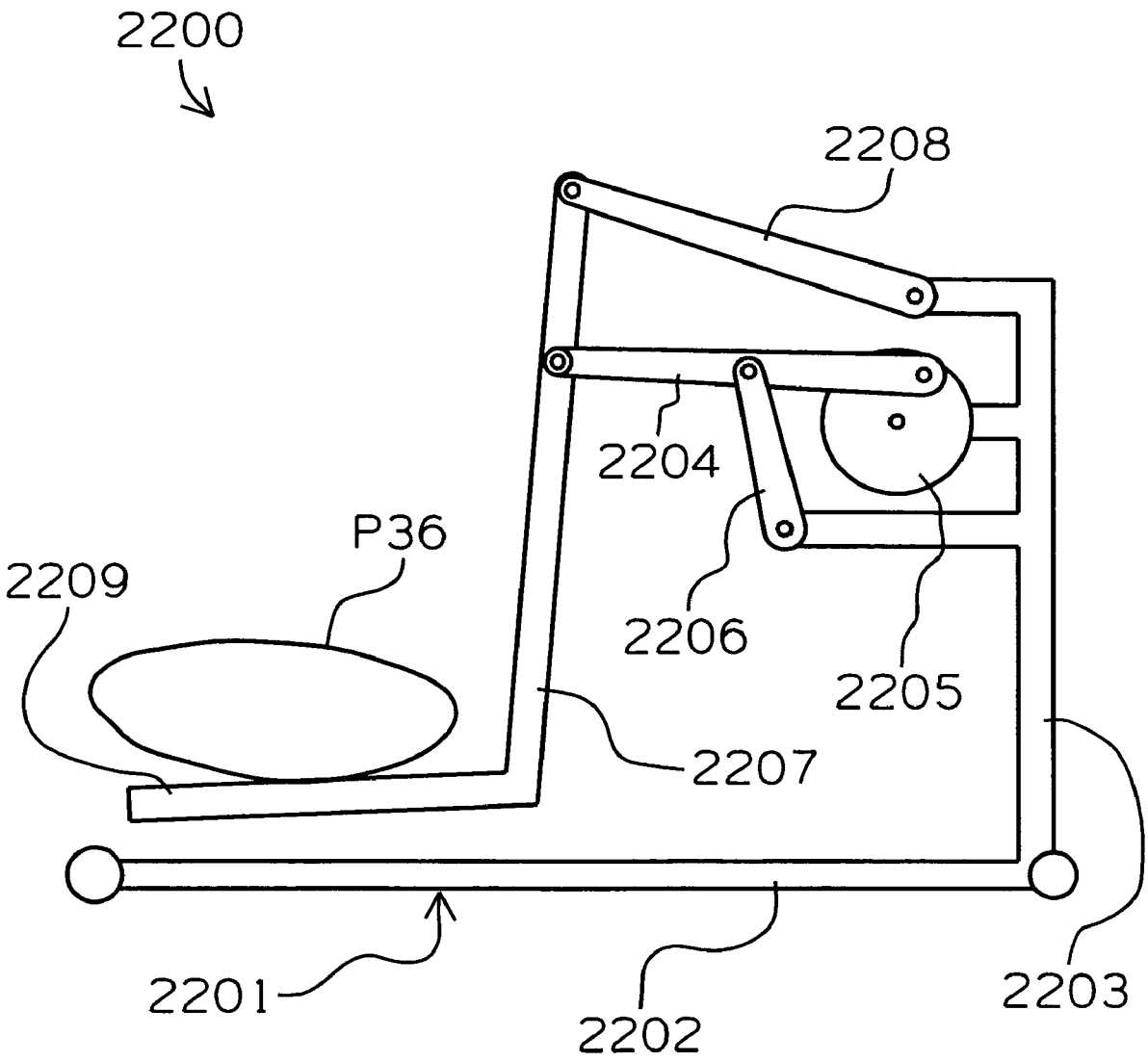
FIG. 36 is a side view of another exercise apparatus constructed according to the principles of the present invention.

Yet another embodiment of the present invention is designated as 2200 in FIG. 36. The exercise apparatus 2200 includes a frame 2201 having a base 2202 designed to occupy a fixed position relative to a floor surface, and a stanchion 2203 extending upward from an end of the base 2202. Left and right connector links 2204 have (a) first ends rotatably connected to respective cranks 2205, which in turn, are rotatably mounted on opposite sides of the stanchion 2203; (b) intermediate portions rotatably connected to respective rocker links 2206, which in turn, are rotatably connected to opposite sides of the stanchion 2203; and (c) second, opposite ends rotatably connected to intermediate portions of respective foot supporting members 2207. Upper ends of the foot supporting members 2207 are rotatably connected to respective rocker links 2208, which in turn, are rotatably connected to opposite-sides of the stanchion 2203 (above the cranks 2205). The lower end 2209 of each foot supporting members 2207 is sized and configured to support a respective foot of a standing person.

The foot supports 2209, rocker links 2208, and connector links 2204 extend substantially parallel to an underlying floor surface, and the foot supporting members 2207 and rocker links 2206 extend substantially perpendicular to the underlying floor surface. The resulting linkage assembly links rotation of the cranks 2205 to generally elliptical movement of the foot supports 2209 through the path designated as P36.

Figure 37:
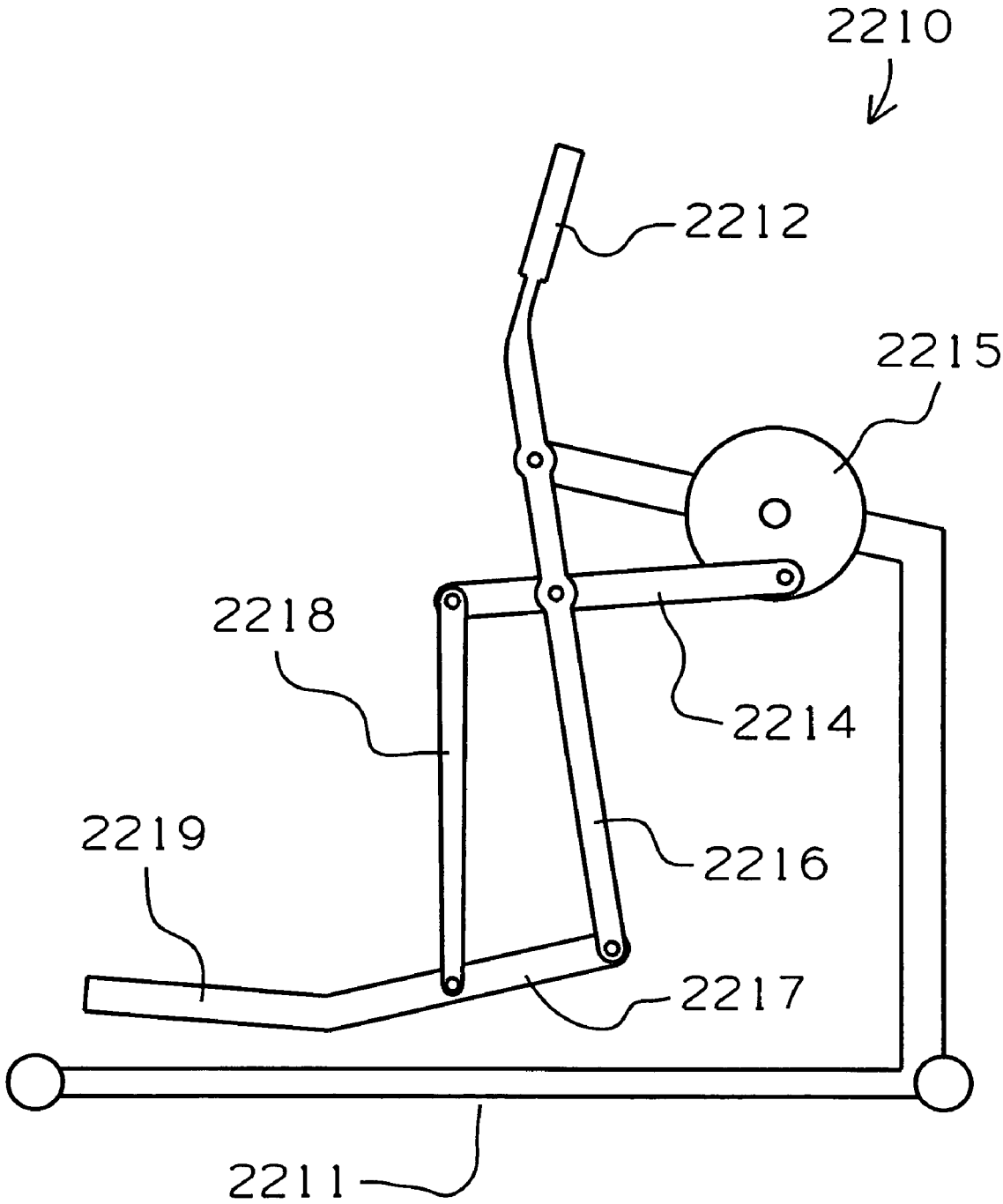
FIG. 37 is a side view of yet another exercise apparatus constructed according to the principles of the present invention.

Still another embodiment of the present invention is designated as 2210 in FIG. 37. The exercise apparatus 2210 includes a frame 2211 having a base designed to occupy a fixed position relative to a floor surface, and a stanchion extending upward from an end of the base. Left and right connector links 2214 have (a) first ends rotatably connected to respective cranks 2215, which in turn, are rotatably mounted on opposite sides of the stanchion; (b) intermediate portions rotatably connected to respective rocker links 2216, which in turn, are rotatably connected to opposite sides of the stanchion; and (c) second, opposite ends rotatably connected to upper ends of respective intermediate links 2218. Opposite, lower ends of the intermediate links 2218 are rotatably connected to intermediate portions of respective foot supporting links 2217.

Each rocker link 2216 has (a) a lower end rotatably connected to a forward end of a respective foot supporting link 2217; (b) a relatively lower intermediate portion rotatably connected to a respective connector link 2214; (c) a relatively higher intermediate portion rotatably connected to the stanchion; and (d) an upper end 2212 sized and configured for grasping. A rearward end 2219 of each foot supporting link 2217 is sized and configured to support a respective foot of a standing person.

The foot supporting links 2219 and connector links 2214 extend substantially parallel to an underlying floor surface, and the intermediate links 2218 and rocker links 2216 extend substantially perpendicular to the underlying floor surface. The resulting linkage assembly links rotation of the cranks 2215 to generally elliptical movement of the foot supports 2219.

Figures 38, 39:
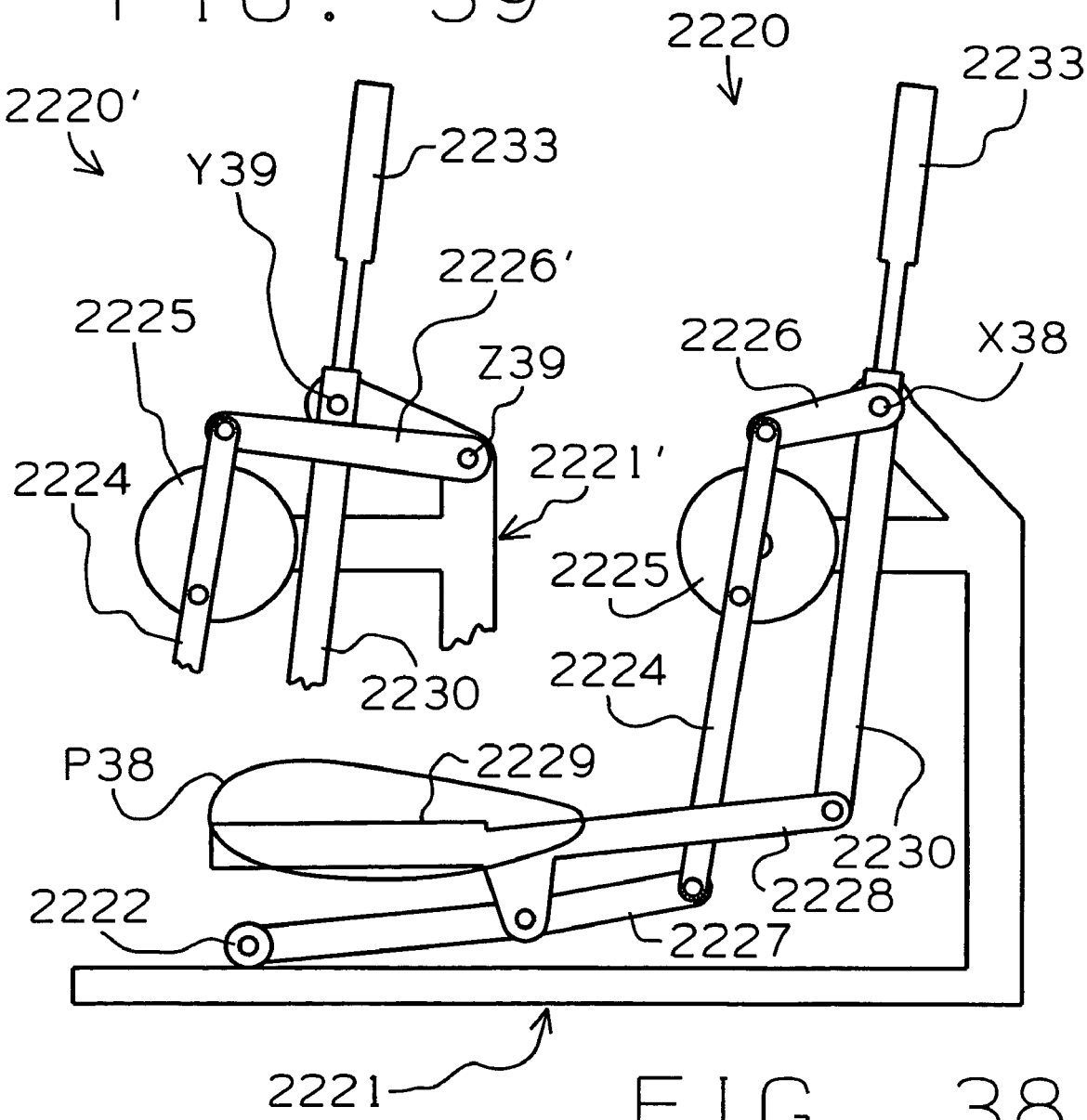
FIG. 38 is a side view of still another exercise apparatus constructed according to the principles of the present invention.
FIG. 39 is a side view of an alternative linkage arrangement suitable for use on the apparatus of FIG. 38.

In FIG. 38, another variation of the present invention is designated as 2220. The exercise apparatus 2220 includes a frame 2221 having a base designed to occupy a fixed position relative to a floor surface, and a stanchion extending upward from an end of the base. Left and right connector links 2224 have (a) first ends rotatably connected to respective rocker links 2226, which in turn, are rotatably connected to opposite sides of the stanchion; (b) intermediate portions rotatably connected to respective cranks 2225, which in turn, are rotatably mounted on opposite sides of the stanchion; and (c) second, opposite ends rotatably connected to forward ends of respective rolling links 2227.

Left and right rollers 2222 are rotatably mounted on rearward ends of respective rolling links 2227 and bear against underlying surfaces on the frame 2221. Left and right foot supporting members 2228 have intermediate portions which are rotatably connected to intermediate portions of respective roller links 2227. A rearward end 2229 of each foot supporting member 2228 is sized and configured to support a respective foot of a standing person. An opposite, forward end of each foot supporting member 2228 is rotatably connected to a lower end of a respective rocker link 2230. An intermediate portion of each rocker link 2230 is rotatably connected to the stanchion, and an upper end 2233 of each rocker link 2230 is sized and configured for grasping.

The foot supporting members 2228, rolling links 2227, and rocker links 2226 extend substantially parallel to an underlying floor surface, and the connector links 2224 and rocker links 2230 extend substantially perpendicular to the underlying floor surface. Also, the rocker links 2230 and the rocker links 2226 share a common pivot axis X38 relative to the stanchion. The resulting linkage assembly links rotation of the cranks 2225 to generally elliptical movement of the foot supports 2229 through the path designated as P38.

FIG. 39 shows an alternative embodiment exercise apparatus 2200' which is similar in many respects to the previous embodiment 2200. However, distinct rocker links 2226' cooperate with a distinct frame 2221' to define a pivot axis Z39 which is spaced apart from the pivot axis Y39 defined between the frame 2221' and the other rocker links 2230.

Figure 40:
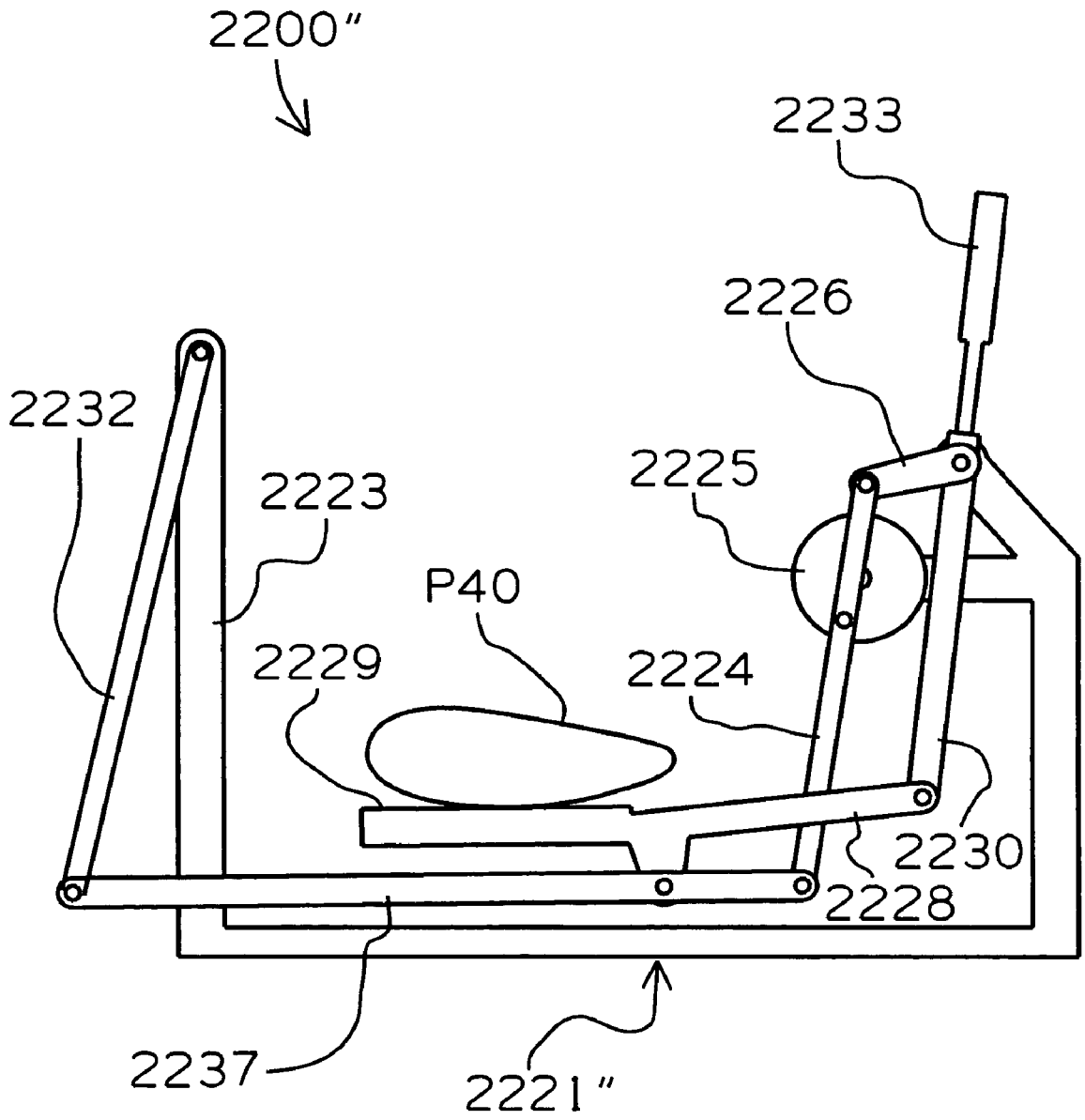
FIG. 40 is a side view of an exercise apparatus similar in many respects to the apparatus of FIG. 39.

FIG. 40 shows another alternative embodiment 2200" which is similar in many respects to the foregoing embodiment 2200. However, swinging links 2237 are substituted for the rolling links 2227, and left and right rocker links 2232 are rotatably connected between respective swinging links 2237 and a rearward stanchion 2223 on the frame 2221". The resulting linkage assembly links rotation of the cranks 2225 to generally elliptical movement of the foot supports 2229 through the path designated as P40.

Figure 41:
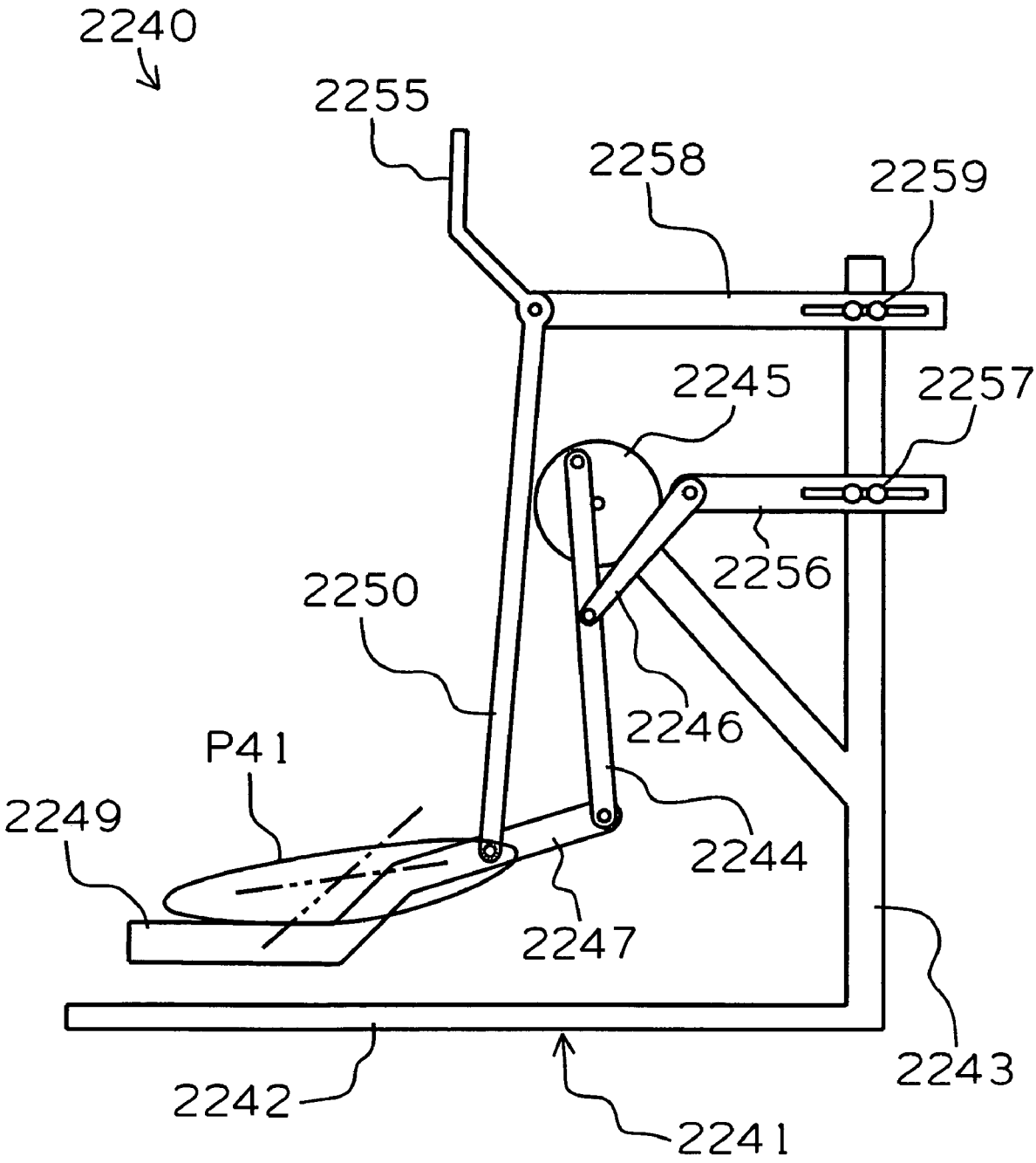
FIG. 41 is a side view of another exercise apparatus constructed according to the principles of the present invention.

Yet another embodiment of the present invention is designated as 2240 in FIG. 41. The exercise apparatus 2240 includes a frame 2241 having a base 2242 designed to occupy a fixed position relative to a floor surface, and a stanchion 2243 extending upward from an end of the base 2242. Left and right connector links 2244 have (a) first ends rotatably connected to respective cranks 2245, which in turn, are rotatably mounted on opposite sides of the stanchion 2243; (b) intermediate portions rotatably connected to respective rocker links 2246, which in turn, are rotatably connected to opposite sides of the stanchion 2243; and (c) second, opposite ends rotatably connected to forward ends of respective foot supporting members 2247.

An opposite, rearward end 2249 of each foot supporting member 2247 is sized and configured to support a respective foot of a standing person. An intermediate portion of each foot supporting members 2247 is rotatably connected to a lower end of a respective rocker link 2250. An intermediate portion of each rocker link 2250 is rotatably connected to the stanchion 2243, and an upper end 2255 of each rocker link 2250 is sized and configured for grasping.

The foot supporting members 2247 extend substantially parallel to an underlying floor surface, and the connector links 2244 and rocker links 2250 extend substantially perpendicular to the underlying floor surface. The resulting linkage assembly links rotation of the cranks 2245 to generally elliptical movement of the foot supports 2249 through the path designated as P41. The pivot axes of the rocker links 2246 and/or the rocker links 2250 may be adjusted relative to the frame 2241 to change the path of exercise motion. On the embodiment 2240, for example, each rocker link is rotatably connected to a respective bracket 2256 or 2258, which in turn, is movable horizontally relative to the stanchion 2243. Slots in the brackets 2256 and 2258 provide the necessary degree of freedom, and fasteners 2257 and 2259 releasably lock the respective brackets 2256 and 2258 in place.

Figure 42:
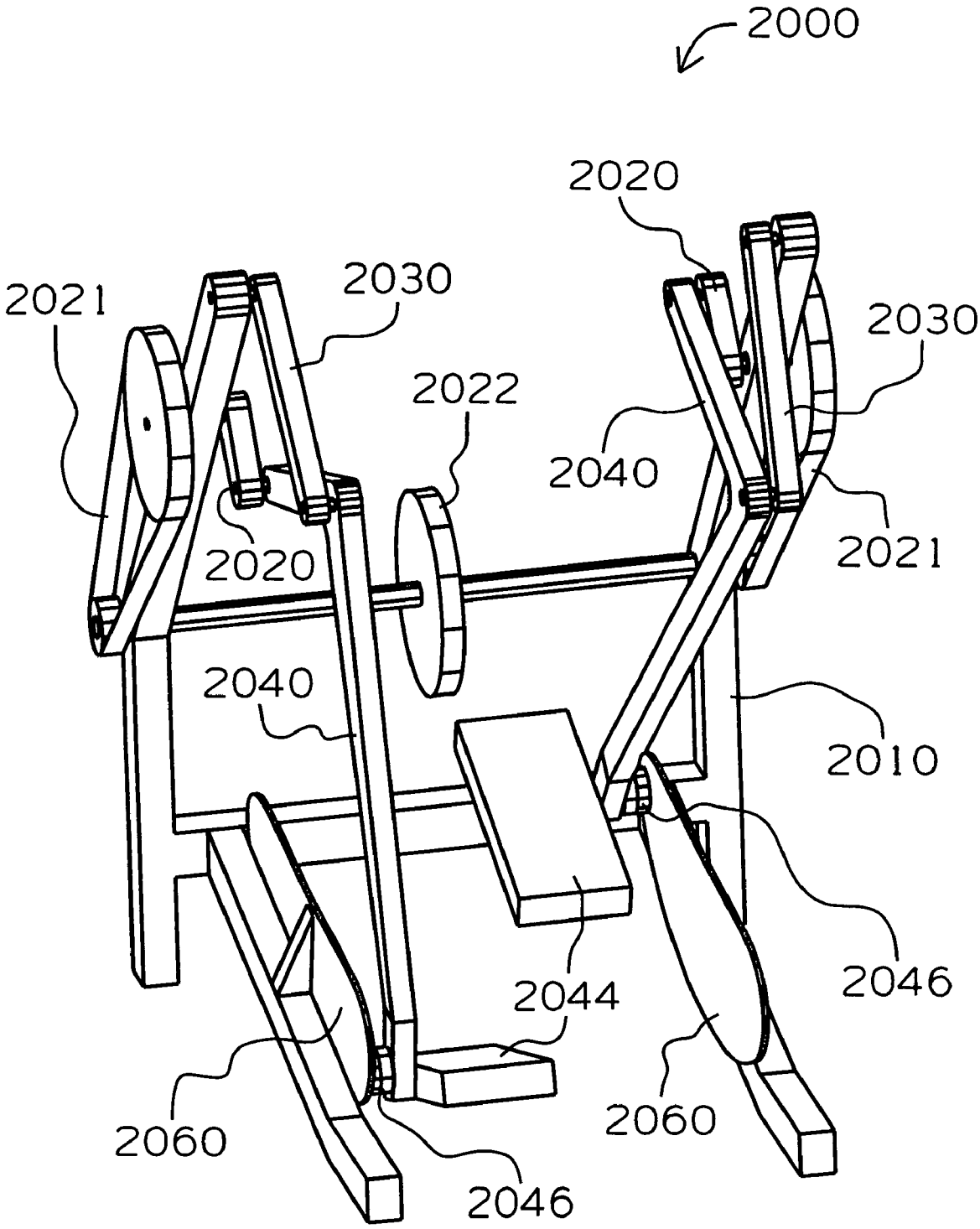
FIG. 42 is a perspective view of yet another exercise apparatus constructed according to the principles of the present invention.
Figure 43:
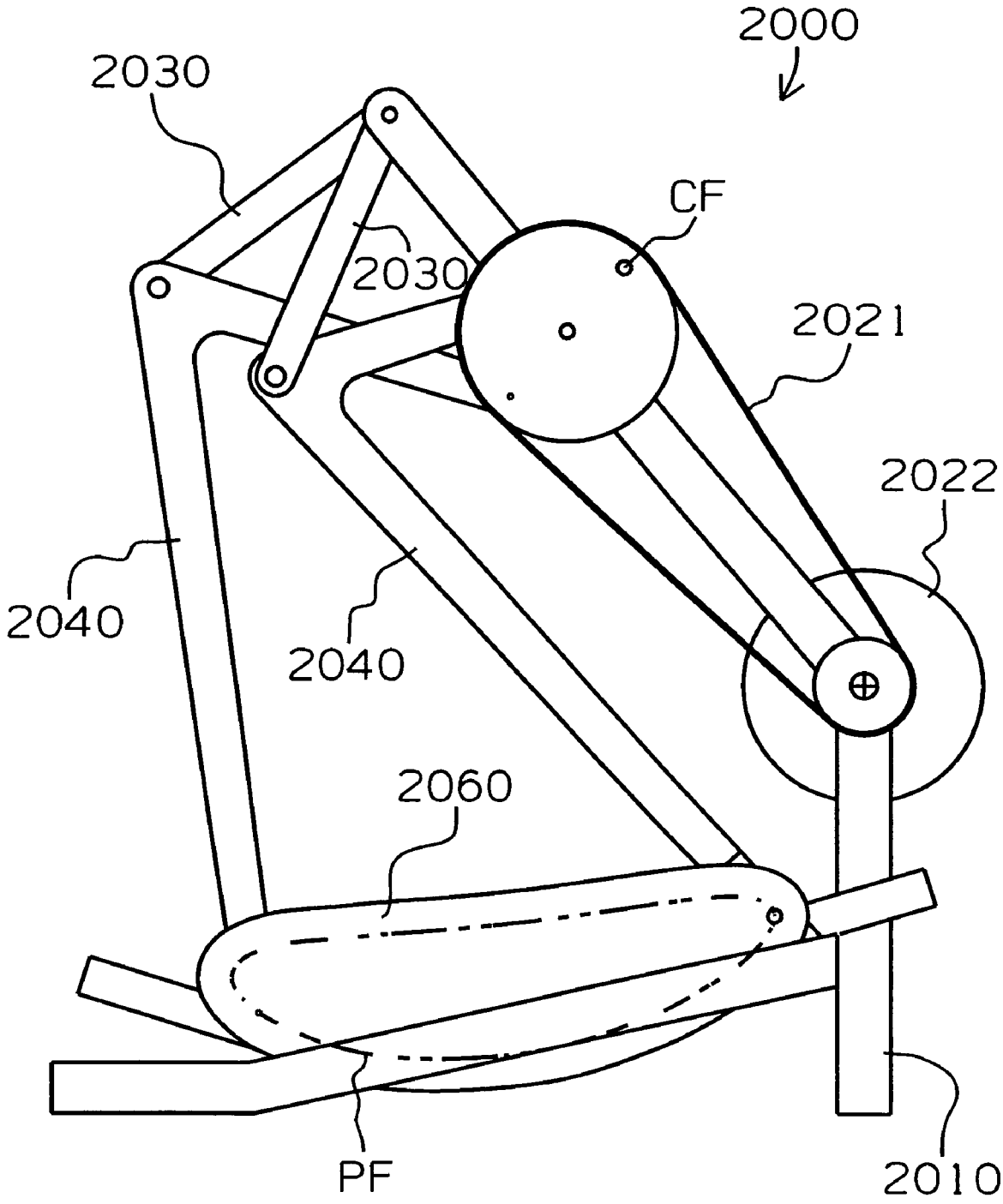
FIG. 43 is a side view of the apparatus of FIG. 42.

Another aspect of the present invention is described with reference to the exercise apparatus designated as 2000 in FIGS. 42-43. The apparatus 2000 includes a frame 2010 designed to occupy a fixed position relative to a horizontal floor surface. Left and right cranks 2020 are rotatably mounted on opposite sides of the frame 2010 and synchronized to rotate together with a flywheel shaft by means of pulleys and belts 2021 disposed on each side of the frame 2010. The pulleys and belts 2021 interconnect the cranks 2020 in a manner which causes the flywheel shaft and flywheel 2022 to rotate in "stepped-up" fashion relative thereto.

Connector links 2040 have first connection points which are rotatably connected to radially offset portions of respective cranks 2020 (see CF in FIG. 43), and second connection points which are rotatably connected to distal ends of respective rocker links 2030. Opposite ends of the rocker links 2030 are rotatably connected to opposite sides of the frame 2010. Foot supporting platforms 2044 are connected to third connection points on respective connector links 2040. The three connection points on each connector link 2040 cooperate to define the vertices of a triangle. The connector links 2040 need not span all three sides of the triangle in order to effect all of the necessary connections. On the embodiment 2000, the connector links 2040 extend from the third connection points to the second connection points and then to the first connection points. In other words, the connector links 2040 do not extend directly between the first connection points and the third connection points but could do so without departing from the scope of the present invention.

The above-described arrangement of components is such that rotation of the cranks 2020 is linked to movement of the foot supports 2044 through generally elliptical paths of motion designated as PF. Rigid plates 2060, which are sized and configured to cover or span the paths of motion PF, are rigidly secured to opposite sides of the frame 2010, just outside respective paths of motion PF. Bearing members 2046 project laterally from respective foot supports 2044 and bear against respective plates 2060. The bearing members 2046 and plates 2060 are manufactured to facilitate movement of the former across the latter. An advantage of this arrangement is a reduction in side loading forces acting on the rotational joints.

Although numerous embodiments and/or applications are shown and/or described herein, persons skilled in the art are likely to recognize many additional embodiments, modifications, and/or features which nonetheless fall within the scope of the present invention. Among other things, modifications may be made to the size, configuration, and/or arrangement of the linkage assembly components as a matter of design choice, and/or portions thereof may be replaced with mechanical equivalents. Also, many of the linkages are operable in both a "forward" direction and a "rearward" direction, or, in other words, the user may face either "forward" or "backward" relative to many of the linkages. Moreover, many of the features disclosed herein with reference to one embodiment may be mixed and matched with other embodiments to arrive at still more embodiments. Recognizing that the foregoing description sets forth only some of the possible modifications and variations, the scope of the present invention is to be limited only to the extent of the claims which follow.

What is claimed is:

1. An exercise apparatus, comprising:

a frame including a flat base adapted to rest on a floor surface, and a stanchion extending upward from a forward end of the base;

a seat mounted on an opposite, rearward end of the base, wherein the seat and the frame cooperate to define a U-shaped configuration;

a rotating member mounted on the frame for rotation about an axis;

a rocker link pivotally mounted on the frame; and a connector link having a first portion connected to a radially displaced portion of the rotating member, a second portion connected to the rocker link, and a third portion connected to a foot support, wherein rotation of the rotating member is linked to movement of the foot support through a generally elliptical path.

2. The exercise apparatus of claim 1, wherein the rotating member is disposed forward of the seat.

3. The exercise apparatus of claim 2, wherein the rocker link is also disposed forward of the seat.

4. The exercise apparatus of claim 3, wherein the connector link is also disposed forward of the seat.

5. The exercise apparatus of claim 1, further comprising a flywheel mounted on the frame and linked to the rotating member.

6. The exercise apparatus of claim 1, wherein the seat is disposed at a first elevation above the floor surface, and the rocker link is disposed above the first elevation.

7. The exercise apparatus of claim 1, wherein the rotating member is mounted on the stanchion at an elevation above the first elevation.

8. The exercise apparatus of claim 1, wherein the foot support is rigidly secured to the connector link.

9. An exercise apparatus, comprising:

a frame including a flat based adapted to rest on a floor surface, and a stanchion extending upward from a forward end of the base;

a seat mounted on an opposite, rearward end of the base, wherein the seat and the frame cooperate to define a U-shaped configuration;

a rotating member mounted on the frame for rotation about an axis;

a guide mounted on the frame;

a connector link having a first portion connected to a radially displaced portion of the rotating member, a second portion connected to the guide, and a third portion connected to a foot support, wherein rotation of the rotating member is linked to movement of the foot support through a generally elliptical path; and a handle linked to the connector link and constrained to move as the rotating member rotates.

10. The exercise apparatus of claim 1, further comprising a handle movably mounted on the frame and constrained to move as the rotating member rotates.

11. The exercise apparatus of claim 9, wherein the guide is a rocker link.

12. The exercise apparatus of claim 9, wherein the seat is disposed at a first elevation above the floor surface, and the guide is disposed above the first elevation.

13. The exercise apparatus of claim 12, wherein the rotating member is mounted on the stanchion at an elevation above the first elevation.

14. An exercise apparatus, comprising:

a frame including a flat base adapted to rest on a floor surface, and a stanchion extending upward from a forward end of the base;

a seat mounted on an opposite, rearward end of the base, wherein the seat and the frame cooperate to define a U-shaped configuration;

a rotating member mounted on the frame for rotation about an axis;

a guide mounted on the frame, wherein the seat is disposed at a first elevation above the floor surface, and the guide is disposed above the first elevation; and a connector link having a first portion connected to a radially displaced portion of the rotating member, a second portion connected to the guide, and a third portion connected to a foot support, wherein rotation of the rotating member is linked to movement of the foot support through a generally elliptical path.

15. The exercise apparatus of claim 14, wherein the rotating member is also disposed above the first elevation.

16. The exercise apparatus of claim 14, wherein the guide is a rocker link.

17. The exercise apparatus of claim 14, further comprising a handle movably mounted on the frame and constrained to move as the rotating member rotates.

18. The exercise apparatus of claim 14, wherein the foot support is rigidly secured to the connector link.

19. An exercise apparatus, comprising:

a frame including a flat base adapted to rest on a floor surface, and a stanchion extending upward from a forward end of the base;

a seat mounted on an opposite, rearward end of the base, wherein the seat and the frame cooperate to define a U-shaped configuration;

a rotating member mounted on the frame for rotation about an axis;

a guide mounted on the frame;

a connector link having a first portion connected to a radially displaced portion of the rotating member, a second portion connected to the guide, and a third portion rigidly connected to a foot support, wherein rotation of the rotating member is linked to movement of the foot support through a generally elliptical path.

20. The exercise apparatus of claim 19, further comprising a handle linked to the connector link and constrained to move as the rotating member rotates.

21. The exercise apparatus of claim 19, further comprising a handle movably mounted on the frame and constrained to move as the rotating member rotates.

22. An exercise apparatus, comprising:

a U-shaped frame including a flat base adapted to rest on a floor surface;

a seat mounted on an upper rearward end of the U-shaped frame;

a rotating member mounted on an upper forward end of the U-shaped frame for rotation about an axis;

a guide mounted on the frame;

a connector link having a first portion connected to a radially displaced portion of the rotating member, a second portion connected to the guide, and a third portion connected to a foot support in a space defined within the U-shaped frame, wherein rotation of the rotating member is linked to movement of the foot support through a generally elliptical path.

23. Th exercise apparatus of claim 22, further comprising a handle disposed between the seat and the connector link, linked to the connector link, and constrained to move as the rotating member rotates.

24. The exercise apparatus of claim 23, wherein the foot support is rigidly connected to the connector link.

25. The exercise apparatus of claim 22, further comprising a handle movably mounted on the upper forward end of the U-shaped frame, and constrained to move as the rotating member rotates.

26. The exercise apparatus of claim 25, wherein the foot support is rigidly connected to the connector link.

27. The exercise apparatus of claim 22, wherein the foot support is rigidly connected to the connector link.

28. The exercise apparatus of claim 22, wherein the guide is mounted on the upper forward end of the U-shaped frame.

29. The exercise apparatus of claim 28, further comprising a handle disposed between the seat and the connector link, linked to the connector link, and constrained to move as the rotating member rotates.

30. The exercise apparatus of claim 29, wherein the foot support is rigidly connected to the connector link.

31. The exercise apparatus of claim 28, further comprising a handle movably mounted on the upper forward end of the U-shaped frame, and constrained to move as the rotating member rotates.

32. The exercise apparatus of claim 31, wherein the foot support is rigidly connected to the connector link.

33. The exercise apparatus of claim 28, wherein the foot support is rigidly connected to the connector link.

* * * * *